US011692788B2

(12) United States Patent
Summers et al.

(10) Patent No.: US 11,692,788 B2
(45) **Date of Patent: *Jul. 4, 2023**

(54) ARCHERY ASSEMBLY AND METHOD

(71) Applicant: QTM, LLC, Madison Heights, VA (US)

(72) Inventors: Daniel A. Summers, Alpine, WY (US); Kevin S. Fry, Madison Heights, VA (US); Jonathan M. Loomis, Lynchburg, VA (US)

(73) Assignee: QTM, LLC, Madison Heights, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/737,678

(22) Filed: May 5, 2022

(65) Prior Publication Data

US 2022/0276019 A1 Sep. 1, 2022

Related U.S. Application Data

(63) Continuation of application No. 17/093,114, filed on Nov. 9, 2020, now Pat. No. 11,359,884, which is a continuation of application No. 16/682,416, filed on Nov. 13, 2019, now Pat. No. 10,859,339.

(60) Provisional application No. 62/760,633, filed on Nov. 13, 2018.

(51) Int. Cl.
*F41B 5/14* (2006.01)
*F41B 5/22* (2006.01)

(52) U.S. Cl.
CPC ..... *F41B 5/143* (2013.01); *F41B 5/14* (2013.01)

(58) Field of Classification Search
CPC .... F41B 5/00; F41B 5/065; F41B 5/14; F41B 5/143
See application file for complete search history.

(56) References Cited

U.S. PATENT DOCUMENTS

| | | | |
|---|---|---|---|
| 3,163,938 | A | 1/1965 | Reynolds |
| 3,410,644 | A | 11/1968 | McLendon |
| 3,574,944 | A | 4/1971 | Reynolds |
| 3,769,956 | A | 11/1973 | Simo |
| 3,844,268 | A | 10/1974 | Ikeya |
| 3,864,836 | A | 2/1975 | Haines |
| 4,136,461 | A | 1/1979 | Gasser |

(Continued)

OTHER PUBLICATIONS

Hoyt Striker Bow, Hoyt USA catalogue, 1998 ("Hoyt I") (5 pages), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated Jan. 30, 2023.

(Continued)

*Primary Examiner* — John A Ricci
(74) *Attorney, Agent, or Firm* — Barclay Damon LLP

(57) ABSTRACT

An archery assembly and method are disclosed herein. The archery assembly, in an embodiment, includes a coupler configured to be coupled to a riser of an archery bow. At least part of the coupler is configured to be positioned behind a rear surface of the riser. The archery assembly also includes a device configured to be coupled to the coupler. The coupler and the device are configured to cooperate so that the device is adjustably moveable relative to the coupler, and such movement occurs along a vertical axis.

83 Claims, 55 Drawing Sheets

(56) References Cited

U.S. PATENT DOCUMENTS

| | | | | |
|---|---|---|---|---|
| 5,289,814 | A * | 3/1994 | Maisano | F41G 1/467 124/87 |
| 5,372,119 | A * | 12/1994 | Kidney | F41B 5/143 124/44.5 |
| 5,383,441 | A | 1/1995 | Lightcap | |
| 5,524,601 | A | 6/1996 | Slates et al. | |
| 6,178,959 | B1 * | 1/2001 | Troncoso, Jr. | F41B 5/143 124/44.5 |
| 6,477,778 | B1 | 11/2002 | Lorocco | |
| 6,688,297 | B1 * | 2/2004 | Clague | F41B 5/143 124/44.5 |
| 7,021,301 | B2 | 4/2006 | Nagle | |
| 7,219,662 | B1 * | 5/2007 | Henry | F41B 5/143 124/44.5 |
| 7,409,950 | B2 | 8/2008 | Ellig et al. | |
| 7,681,566 | B2 * | 3/2010 | Mertens | F41B 5/143 124/44.5 |
| 8,065,994 | B2 * | 11/2011 | Holmberg | F41B 5/14 124/88 |
| 8,544,457 | B1 * | 10/2013 | Munsell | F41B 5/143 124/44.5 |
| 8,701,643 | B2 * | 4/2014 | Ellig | F41B 5/1438 124/44.5 |
| 8,939,137 | B2 | 1/2015 | Hunt | |
| 9,004,054 | B2 | 4/2015 | Khoshnood | |
| 9,151,567 | B1 * | 10/2015 | Estridge | F41B 5/143 |
| 9,651,330 | B1 | 5/2017 | LoRocco et al. | |
| 9,829,270 | B2 | 11/2017 | Summers | |
| 9,933,229 | B2 * | 4/2018 | Coalson | F41B 5/143 |
| 10,088,264 | B2 | 10/2018 | Summers et al. | |
| 10,295,296 | B2 | 5/2019 | Summers | |
| 10,539,390 | B2 | 1/2020 | Summers et al. | |
| 11,359,884 | B2 * | 6/2022 | Summers | F41B 5/14 |
| 2013/0233292 | A1 * | 9/2013 | Gardner | F41B 5/1426 124/25.6 |
| 2020/0149838 | A1 | 5/2020 | Summers et al. | |

OTHER PUBLICATIONS

Photograph of a Hoyt Intensity Bow and Integra Sight Mount (1 page), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated Jan. 30, 2023.

Photographs of a "Conventional Mount Blk" (2 pages), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated Jan. 30, 2023.

Kodiak Outdoor Bow, Hunting Forums | Realtree, May 28, 2007 ("Kodiak") (1 page), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated Jan. 30, 2023.

Compilation of: (a) Ripcord Fall-Away Arrow Rest Photographs, (b) Excerpts of Eastmans' Bowhunting Journal (cover page) stating "May-Jun. 2009," and (c) Excerpts of Eastmans' Bowhunting Journal (pp. 74-75) stating "New for 2008" (12 pages), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated Jan. 30, 2023.

Shrewd Remedy Arrow Rest, www.shrewdarchery.com, Facebook, Jul. 13, 2017, including photograph of disassembled arrow rest at p. 16 ("Shrewd") (16 pages), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated Jan. 30, 2023.

DS Advantage Arrow Rest—Photos and Copies of Internet Posts, certain sheets of which are dated Jan. 3, 2014 and Dec. 14, 2012 (8 pages), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated Jan. 30, 2023.

*Lasermarx, Inc D/B/A Quality Archery Designs, Inc. and QTM, LLC* v. *Hamskea Archery Solutions, LLC*; Civil Action No. 1:22-cv-01956, Defendant Hamskea Archery Solutions, LLC's Initial Invalidity Contentions, Dated Jan. 30, 2023 (581 pages).

Hoyt Integra Direct Sight Manual Excerpt; "Hoyt Integra Direct Sight Mounting;" Dated on or Before Aug. 24, 2015; p. No. 11, 1 page.

"Hoyt Intensity Bow and Integra Sight Mount;" Dated on or Before Aug. 24, 2015; retrieved from the Internet: https://www.popscreen.com/prod/MTI2MTM4ODY5/Hoyt-USA-Intensity-Compound-Bow-with-Integra-Sight-eBay; 1 page.

Hoyt Integra Direct Sight Manual; Dated on or Before Aug. 24, 2015; 23 pages.

Hunter's Friend; "Bow Sight Selection Guide—Archery Help—Hunter's Friend;" Feb. 12, 2007; retrieved from the Internet ,https://www.huntersfriend.com/archery-help/bow-sight-selection-guide.html>; 3 pages.

Barnett Outdoors, LLC; "Barnett Outdoors Lil Banshee Jr. Compound Youth Archery Set", Dated on or Before Aug. 12, 2013; 11 pages.

Trophy Ridge; "Vertical Drop Away Arrow Rest Manual;" Dated on or Before Apr. 11, 2015; 2 pages.

Ripcord X-Factor; Ripcord Arrow Rest; on or before Sep. 23, 2015; retrieved from the Internet: <http://ripcordarrowrest.com/ripcord-xfactor>, 4 pages.

Hamskea Full Capture VersaRest; Hamskea Archery Solutions; on or before Sep. 23, 2015; retrieved from the Internet <http://ripcordarrowrest.com/ripcord-xfactor>; 2 pages.

Hoyt Bow User Manual; Dated on or Before Aug. 24, 2015; 23 pages.

Elvish, Tac, Amazon; "Elvish Tac Picatinny Rail for Compound Bow-Stabilizer Mount—Bowhunting Bowfishing"; Oct. 17, 2019; retrieved from the Internet, <https://www.amazon.com/Elvish-Tac-Picatinny-Compound-Bow-Stabilizer/dp/B07Z8HJCCX/ref=pd_lpo_1?pd_rd_i=B07Z8HJCCX&psc=1>; 11 pages.

*Lasermarx, Inc D/B/A Quality Archery Designs, Inc. and QTM, LLC* v. *Hamskea Archery Solutions, LLC*; Case 1:22-cv-01956-KLM, Document 17, Motion for Dismissal and Summary Judgment of Invalidity; Filed Oct. 7, 2022, USDC Colorado (54 pages).

*Lasermarx, Inc. D/B/A Quality Archery Designs, Inc. and QTM, LLC* v. *Hamskea Archery Solutions, LLC*; Case 1:22-cv-01956-KLM, Document 28, Motion for Dismissal and Summary Judgment of Invalidity and Non-Infringement; Filed Nov. 11, 2022, USDC Colorado (38) pages).

Shrewd Remedy Arrow Rest; May 14, 2017; Case 1:22-cv-01956-NYW, Document 28-6; Filed Nov. 11, 2022, USDC Colorado (23 pages).

* cited by examiner

20

PRIOR ART (U.S. PATENT NO. 9,829,270)

ARCHERY ASSEMBLY AND METHOD

CROSS-REFERENCE TO RELATED APPLICATIONS

This application is a continuation of, and claims the benefit and priority of, U.S. patent application Ser. No. 17/093,114 filed on Nov. 9, 2020, which is a continuation of, and claims benefit and priority of, U.S. patent application Ser. No. 16/682,416 filed on Nov. 13, 2019, now U.S. Pat. No. 10,859,339, which is a non-provisional of and claims the benefit and priority of, U.S. Provisional Patent Application No. 62/760,633 filed on Nov. 13, 2018. The entire contents of such applications are hereby incorporated herein by reference.

BACKGROUND

Archery accessories, such as arrow rest devices and sight devices, have been attached to archery bows in a variety of ways. In one example, the archery riser has a hole that extends into its side. The known arrow rest may be attached to the archery riser using a screw that is inserted into the hole. The process of screwing the arrow rest onto the archery riser can be difficult and cumbersome. Also, it can be time consuming and challenging to fine tune the arrow rest, that is, adjust the position of the arrow rest to meet the archer's unique preference. Additionally, the known archery riser and arrow rest are not designed to enable the arrow rest to be conveniently uninstalled and reinstalled to match the fine tune settings previously determined by the archer.

Furthermore, the known arrow rest has a U-shaped arrow holder. Archers often desire to fine tune the arrow holder, that is, adjust the angle of the arrow holder relative to the archery riser. The known arrow rest has several drawbacks with respect to adjusting the U-shaped arrow holder. The known process is complex and time consuming, requiring the archer to use a tool. The process does not enable the archer to make controlled, incremental adjustments that are repeatable. Also, once the archer arrives at a desired angle, the U-shaped arrow holder is prone to become loose, causing a loss in the desired setting as the result of repeated use of the arrow rest. This loss in the setting leads to shooting inaccuracies when archery arrows are repeatedly fired over a period of time.

Also, the U-shaped arrow holder is prone to cause wear and tear on the arrow shaft during prolonged use of the known arrow rest. The use of worn, damaged arrows can decrease shooting accuracy. This can also lead to increased costs for replacing arrows.

The foregoing background describes some, but not necessarily all, of the problems, disadvantages and shortcomings related to archery risers and archery accessories.

SUMMARY

An embodiment of an archery riser comprises a handle and a mounting portion coupled to the handle. The mounting portion comprises a plurality of side surfaces that extend along a shooting plane and a plurality of first mount surfaces. Each of the plurality of first mount surfaces extends along a first mount plane that intersects with the shooting plane. The mounting portion further comprises a plurality of second mount surfaces that each extend along a second mount plane and intersect the shooting plane. The mounting portion and the handle may be formed as a unitary structure and each of the first mount planes intersects with one of the second mount planes at an angle that is less than ninety degrees. Each of the angles is associated with a cavity defined by the mounting portion and each of the cavities is configured to at least partially receive a portion of an archery riser mount of an archery accessory.

In another embodiment, the archery riser comprises a grasp structure and a mounting portion coupled to the grasp structure. The mounting portion comprises a plurality of side surfaces that extend along a shooting plane and a plurality of first mount surfaces. Each of the first mount surfaces extends along a first mount plane that intersects the shooting plane. The mounting portion further comprises a plurality of second mount surfaces that each extend along a second mount plane that intersects the shooting plane. Each of the first mount planes intersects with one of the second mount planes at an angle that is less than ninety degrees. The mounting portion defines a plurality of cavities and each of the plurality of cavities is associated with one of the angles.

An embodiment of a method of manufacturing an archery riser comprises configuring a riser structure so that the riser structure comprises a grasp structure and a mounting portion coupled to the grasp structure. The mounting portion comprises a plurality of side surfaces that extend along a shooting plane and a plurality of first mount surfaces that each extends along a first mount plane that intersects the shooting plane. The mounting portion further comprises a plurality of second mount surfaces that each extends along a second mount plane that intersects the shooting plane. Each of the first mount planes intersects with one of the second mount planes at an angle that is less than ninety degrees. The mounting portion defines a plurality of cavities that are each associated with one of the angles.

Additional features and advantages of the present disclosure are described in, and will be apparent from, the following Brief Description of the Drawings and Detailed Description.

DETAILED DESCRIPTION

Archery Riser

Figure 1:
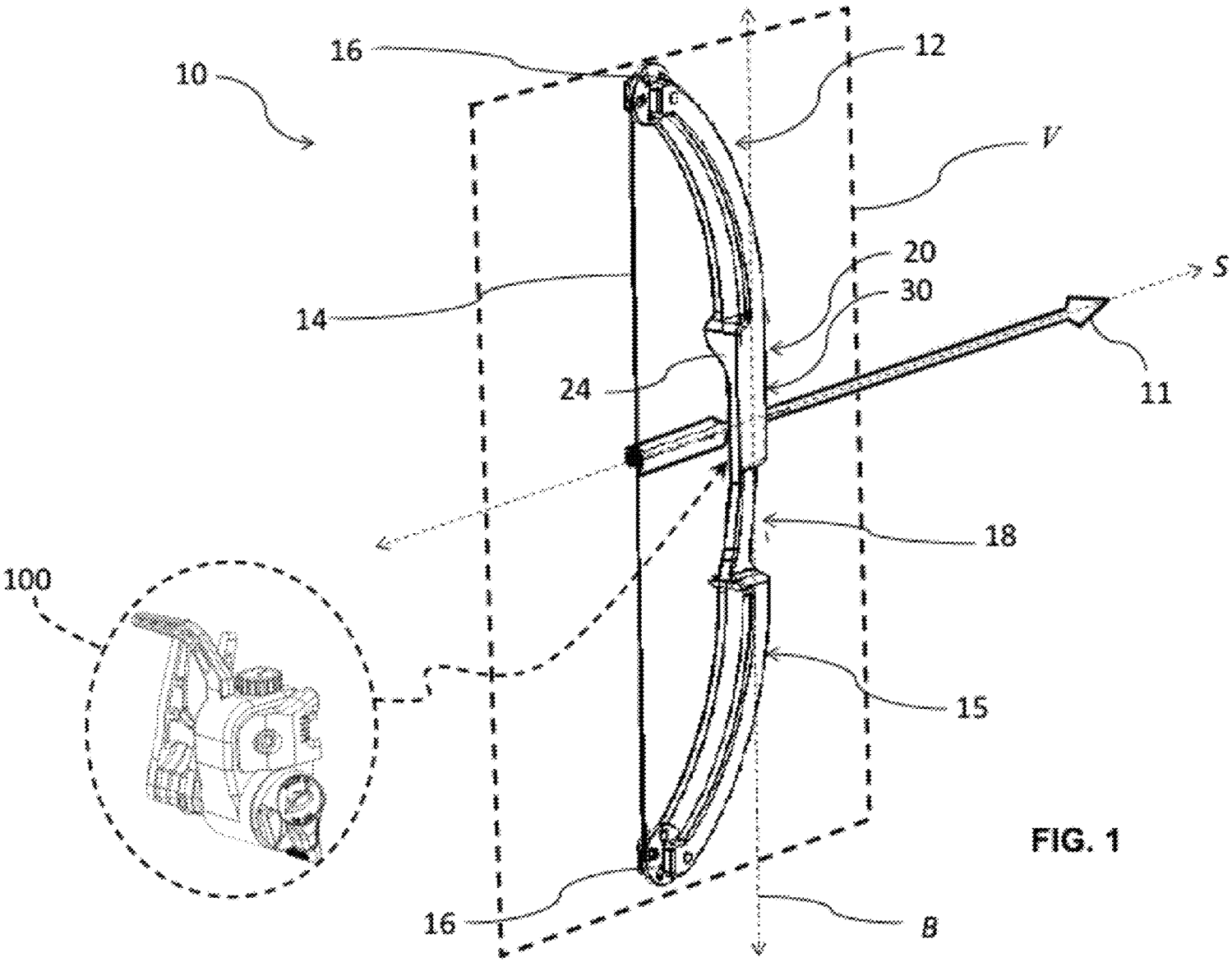
FIG. 1 is a rear, isometric view of an embodiment of an archery bow with a mounting portion configured to be coupled to an archery accessory.
Figure 2:
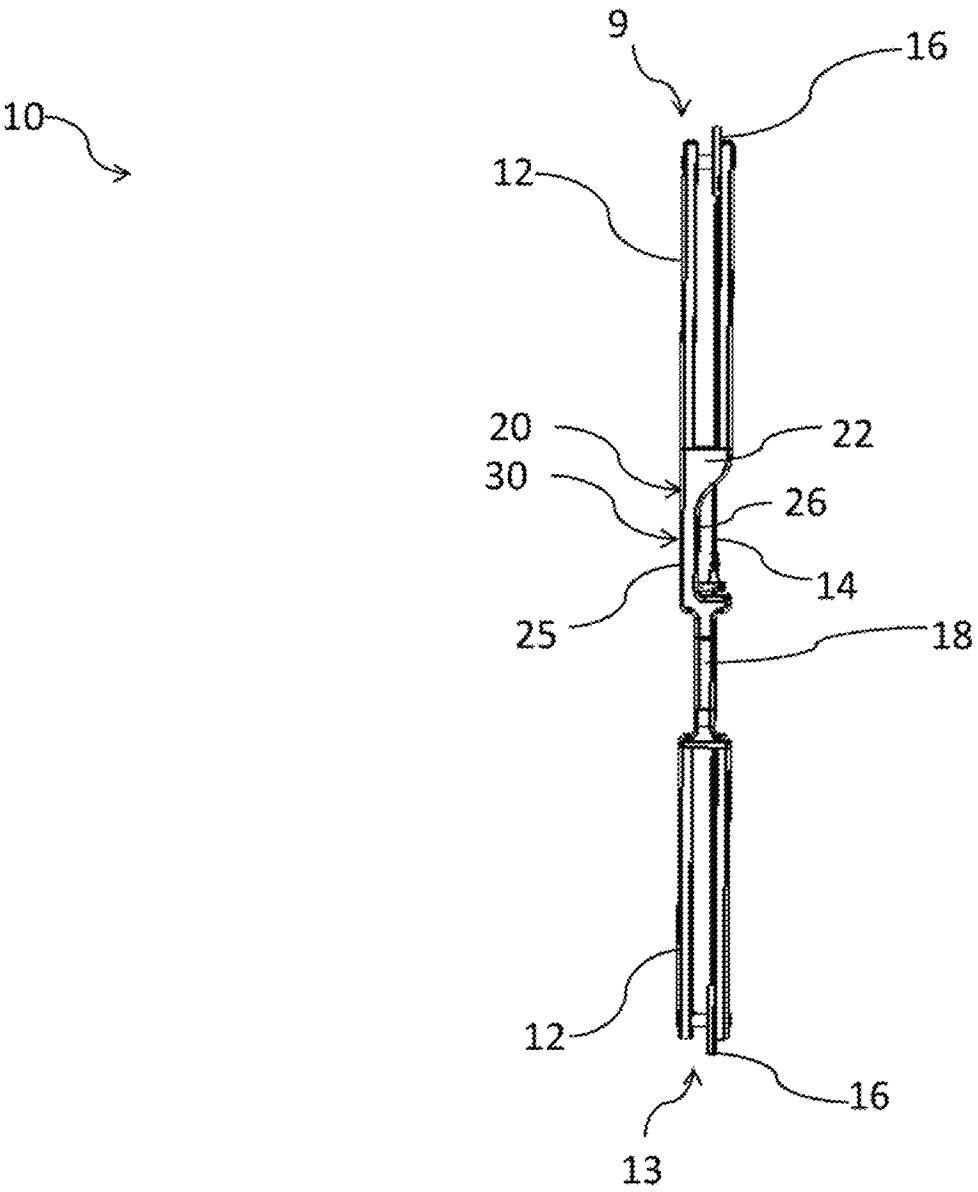
FIG. 2 is a front elevation view of the embodiment of the archery bow from FIG. 1.
Figure 3:
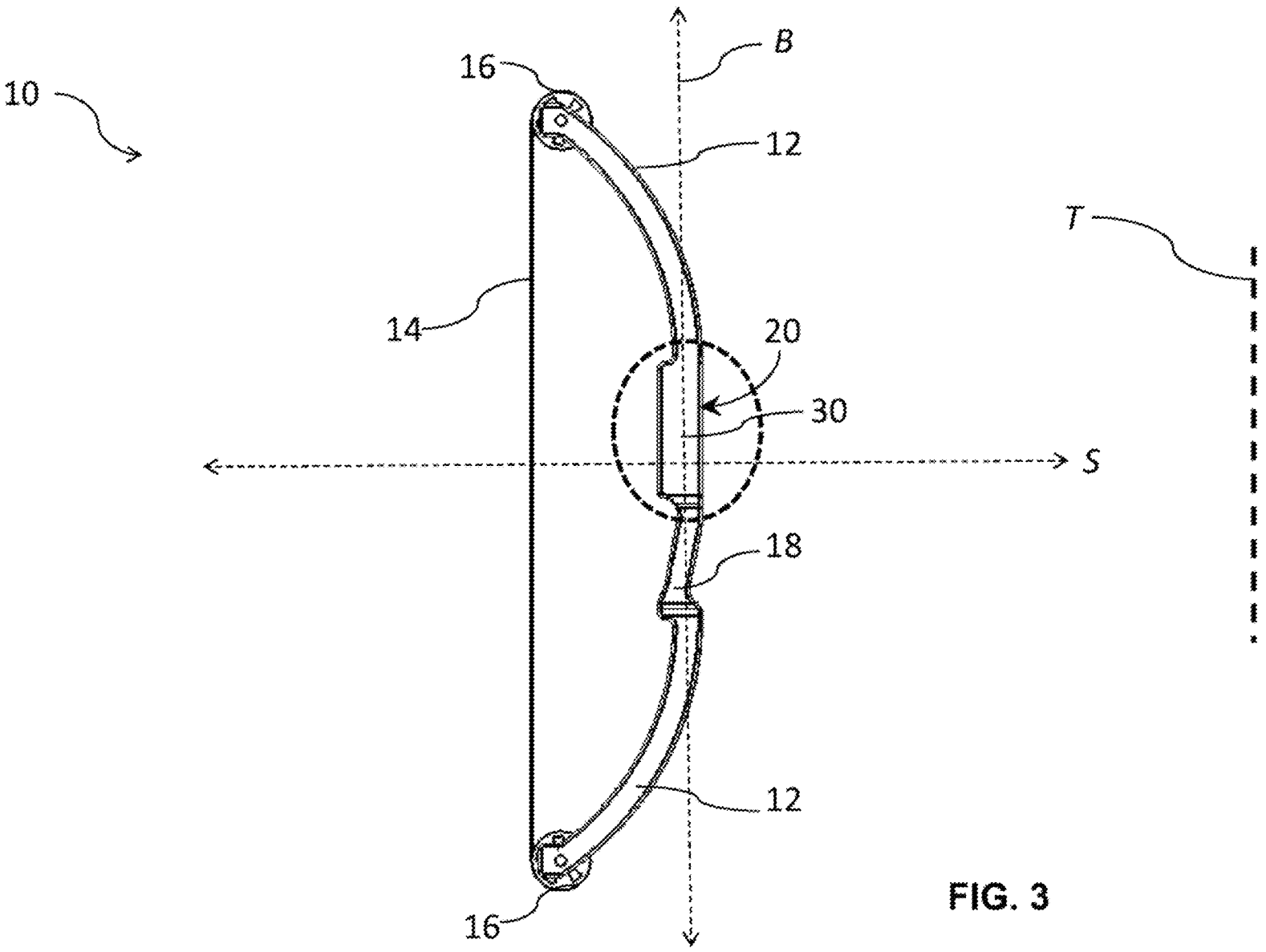
FIG. 3 is a side elevation view of the archery bow of FIG. 1, illustrating an embodiment of a mounting portion.
Figure 4:
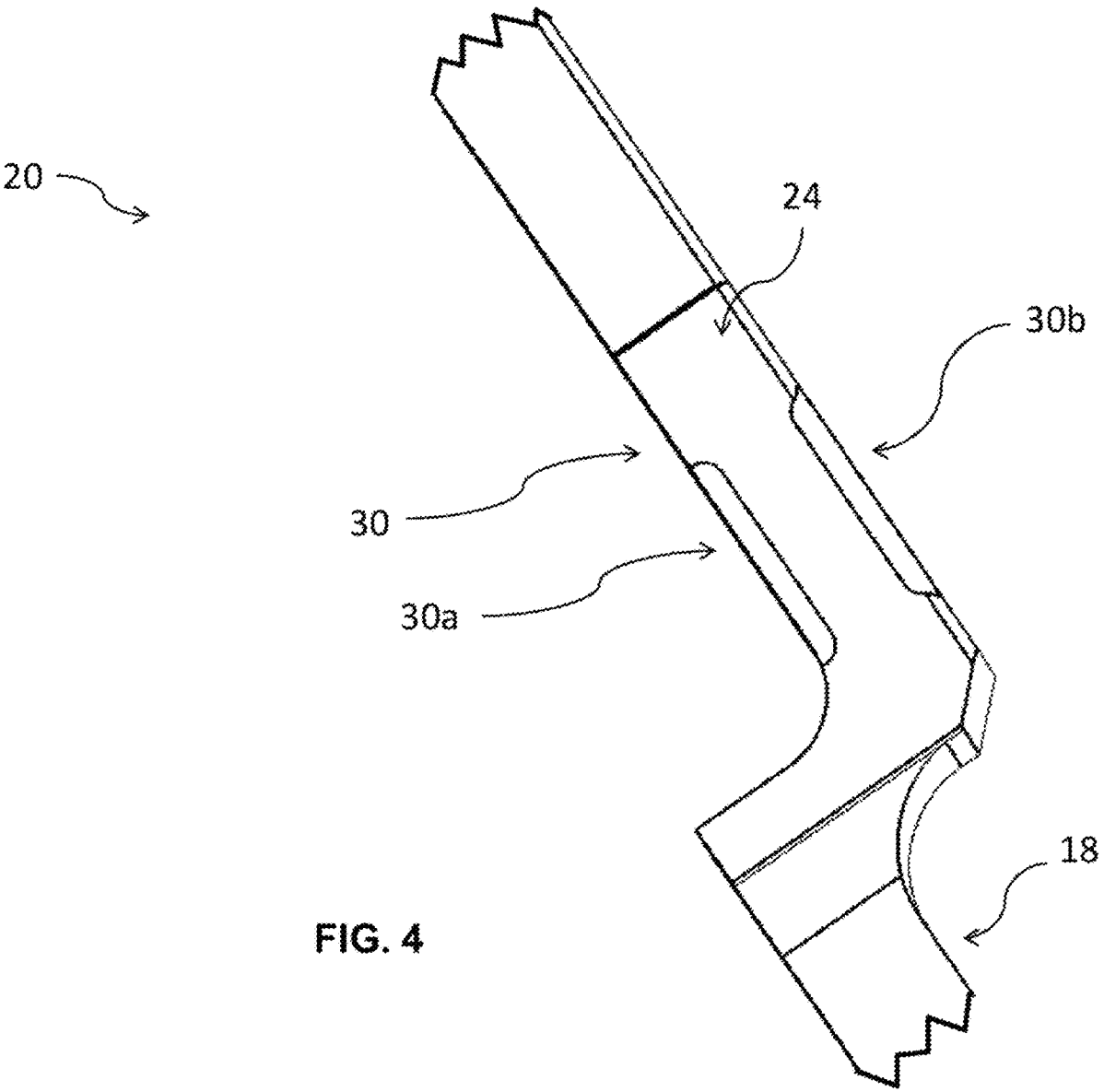
FIG. 4 is an enlarged, rear isometric view of the mounting portion of the archery bow of FIG. 3.

Referring to FIGS. 1-3, an archery bow 10, in an embodiment, includes a top 9 and a bottom 13 and includes a bow riser or archery riser 20 coupled to a grasp structure, handle section or handle 18. A first limb 12 extends upward from the archery riser 20 towards the top 9 of the bow 10, and a second limb 15 extends downward from the handle 18 toward the bottom 13 of the bow 10. Each of the limbs 12, 15 is coupled to at least one rotor 16. Depending on the embodiment, the rotor 16 can be a circular pulley having a circular cord engagement portion or an eccentric member or cam that has one or more asymmetric cord engagement portions. A bowstring or draw cord 14 extends between the upper and lower rotors 16. A shooting plane V extends through the vertical-extending segment of the cord 14. As shown in FIGS. 1 and 3, the bow 10 extends along a bow axis B. In particular, the bow axis B extends through at least part of the archery riser 20, and the bow axis B is parallel or substantially parallel to the shooting plane V.

The archery bow 10 shown in the FIGS. 1-3 is a compound archery bow having two rotors 16. It should be appreciated that, depending upon the embodiment, the archery riser 20 can be a part of (or unitarily integrated into) other types of archery bows and weapons, including, but not limited to, recurve bows, crossbows, fishing bows, rifles and firearms. When integrated into a non-archery weapon (such as a firearm), the stock, body or frame of the weapon includes the same structure and functionality as the archery riser 20.

Figure 5:
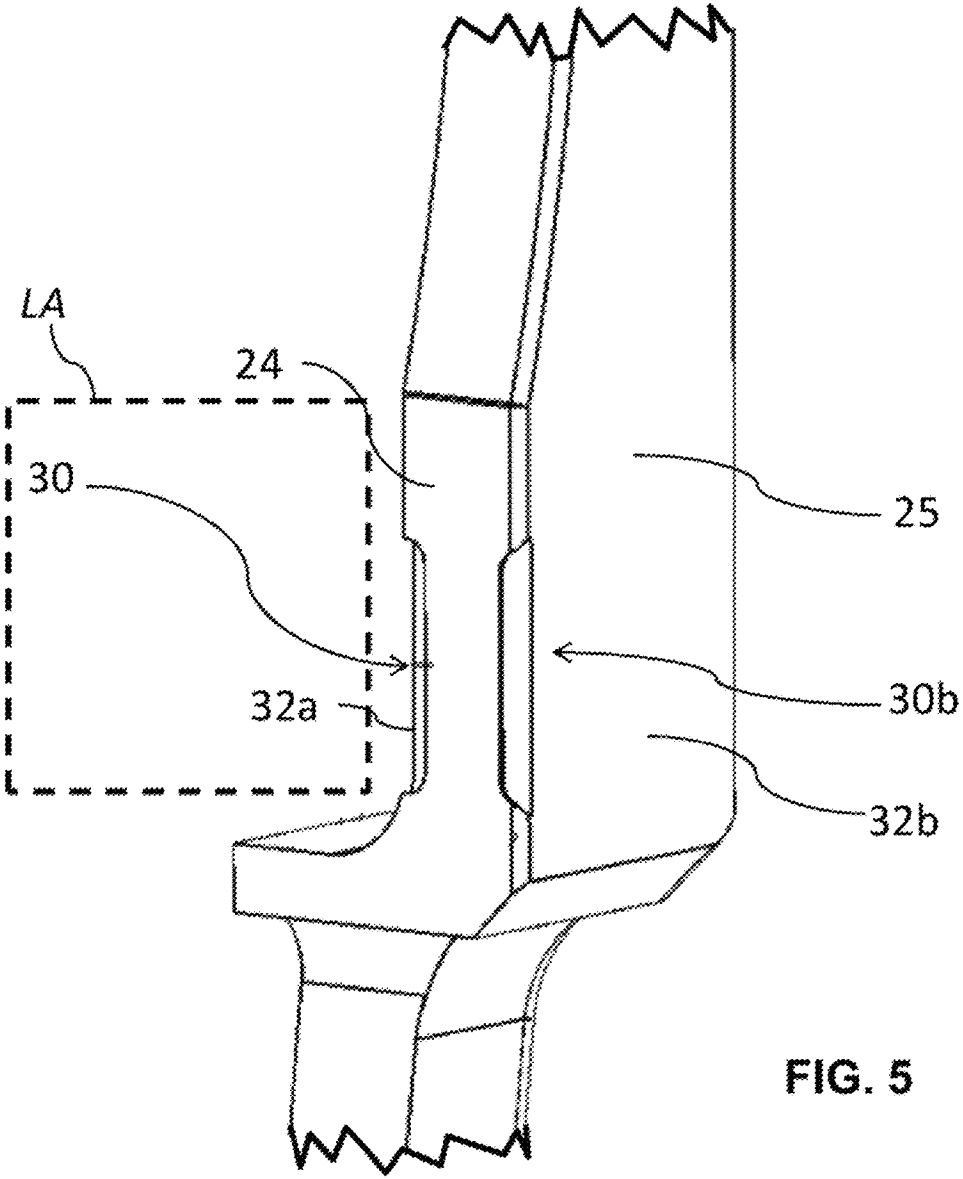
FIG. 5 is an enlarged, rear isometric view of the mounting portion of the archery bow of FIG. 3, illustrating the launching area.

Referring to FIG. 1, an archery arrow or projectile 11 is positioned in or on an archery accessory 100, such as an arrow rest, so that the projectile 11 extends along a shooting axis S that is directed towards a target T (FIG. 3). As shown in FIGS. 1 and 2, the archery riser 20 further includes a forward facing surface 22 that faces the target T and a rearward facing surface 24 that faces the user or archer. The mounting portion 30 includes an intermediate sub-portion 27 located beneath the rearward facing surface 24, a shown in FIG. 11. The intermediate sub-portion 27 is positioned between the cavities 40*a*, 40*b*. Referring to FIG. 5, a launching space or launching area LA is located proximate an inner side surface 26 (FIG. 2) of the archery riser 20. An outer side surface 25 is positioned opposite the inner side surface 26 and configured to face away from the inner side surface 26.

Referring generally to FIGS. 4-11, in an embodiment, the archery riser 20 includes a mounting portion 30 that is configured to couple to an archery accessory 100 (FIG. 1). The mounting portion 30 causes the archery riser 20 to be matingly compatible with the archery accessory 100. The mounting portion 30 includes a first mounting sub-portion 30*a* having at least a first side surface 32*a*. The mounting portion 30 also includes a second mounting sub-portion 30*b* having a second side surface 32*b*.

In the embodiment shown, the mounting portion 30 is integrally coupled to, and extends from, the handle 18 so as to form an integral or unitary structure with the handle 18. Also, the handle 18 and mounting portion 30 are integral with the archery riser 20, forming a unitary structure. Depending upon the embodiment, the handle 18, the mounting portion 30 and the archery riser 20 can be integrally constructed of a unitary structure, or the mounting portion 30 can be a separate component that is coupled or connected to the handle 18.

Figure 7:
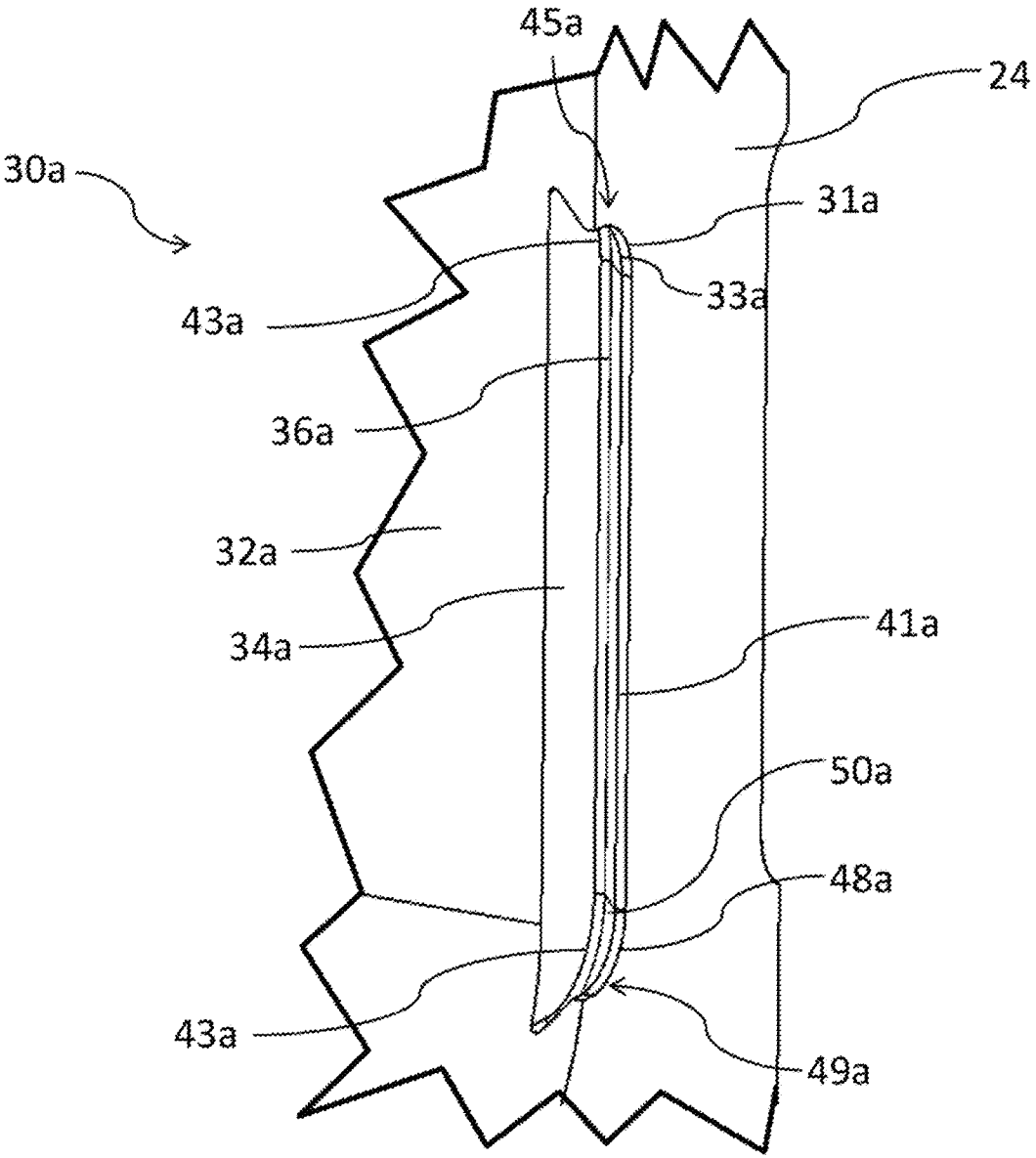
FIG. 7 is an enlarged, left side isometric view of the mounting portion of FIG. 6.

Each of the side surfaces 32*a*, 32*b* extends along the shooting plane V (FIG. 1). It should be appreciated that, depending on the embodiment, the side surfaces 32*a*, 32*b* can each be flat, dome-shaped, convex, concave, arc-shaped, hollow, or of any other suitable geometry or construction. Referring to FIG. 7, a first mount surface 34*a* and a second mount surface 36*a* are positioned between the rearward facing surface 24 and the first side surface 32*a*. Similarly, referring to FIG. 8, a first mount surface 34*b* and a second mount surface 36*b* are positioned between the rearward facing surface 24 and the second side surface 32*b*.

Figure 11:
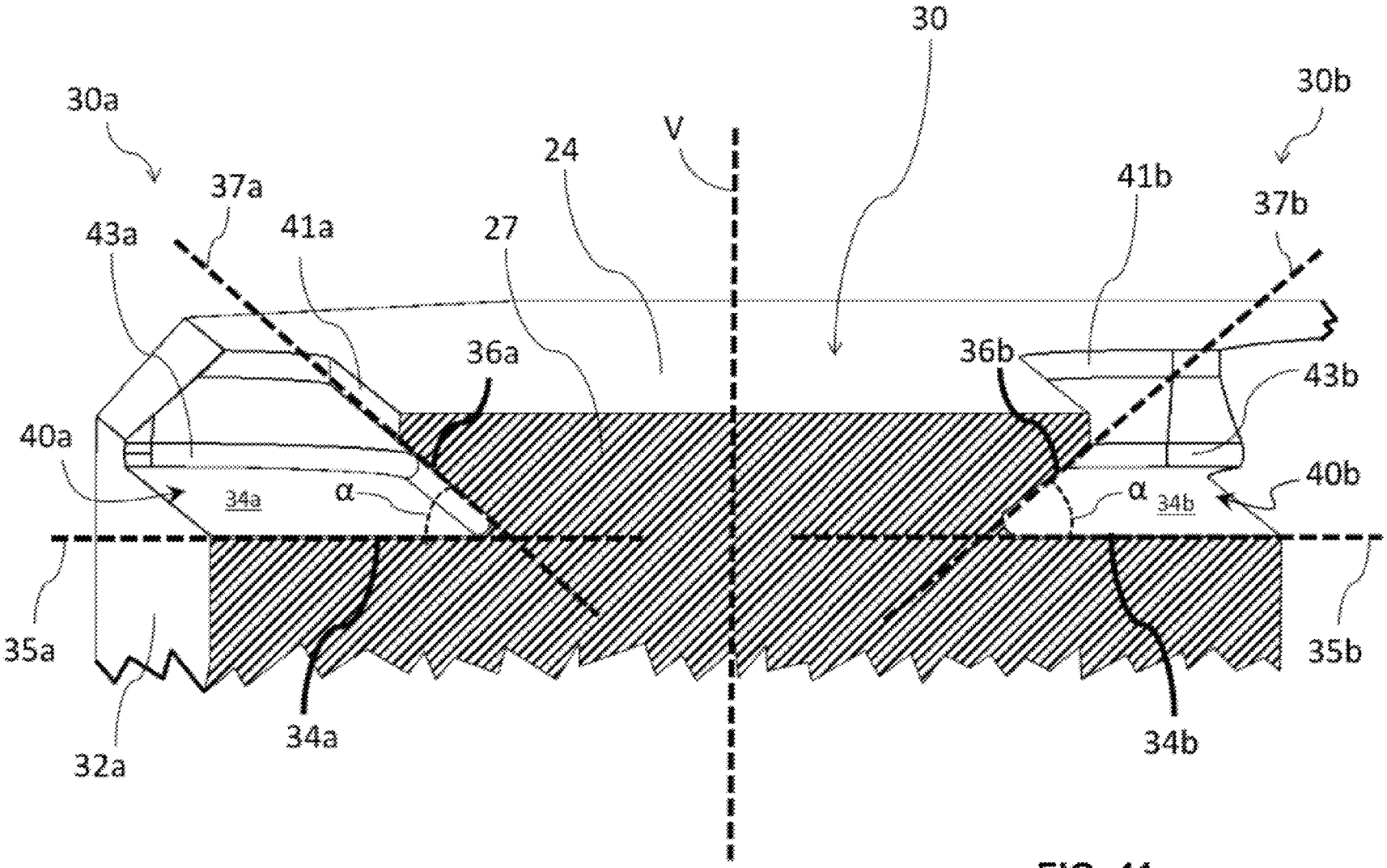
FIG. 11 is an enlarged, isometric cross sectional view of the mounting portion of FIG. 6, taken substantially along line 10-10 of FIG. 6.

Referring to FIG. 11, first mount surfaces 34*a*, 34*b* extend along first mount planes 35*a*, 35*b*, respectively. Second mount surfaces 36*a*, 36*b* extend along second mount planes 37*a*, 37*b*, respectively. As shown, the shooting plane V intersects with each of the first mount surfaces 34*a*, 34*b*, and the shooting plane V also intersects with each of the second mount surfaces 36*a*, 36*b*. In an embodiment, the mounting portion 30 may include a plurality of non-integral mount surfaces connected together.

With continued reference to FIG. 11, the mounting portion 30 may further define a plurality of rims 41*a*, 41*b*. As shown, each of the rims 41*a*, 41*b* extends along a plane that is substantially parallel to the shooting plane V, however in other embodiments, each of the rims 41*a*, 41*b* may extend along a plane that intersects with the shooting plane V. The second mount surface 36*a* extends from the rim 41*a* toward the first mount surface 34*a*. Similarly, the second mount surface 36*b* extends from the rim 41*b* toward the first mount surface 34*b*.

Figure 18A:
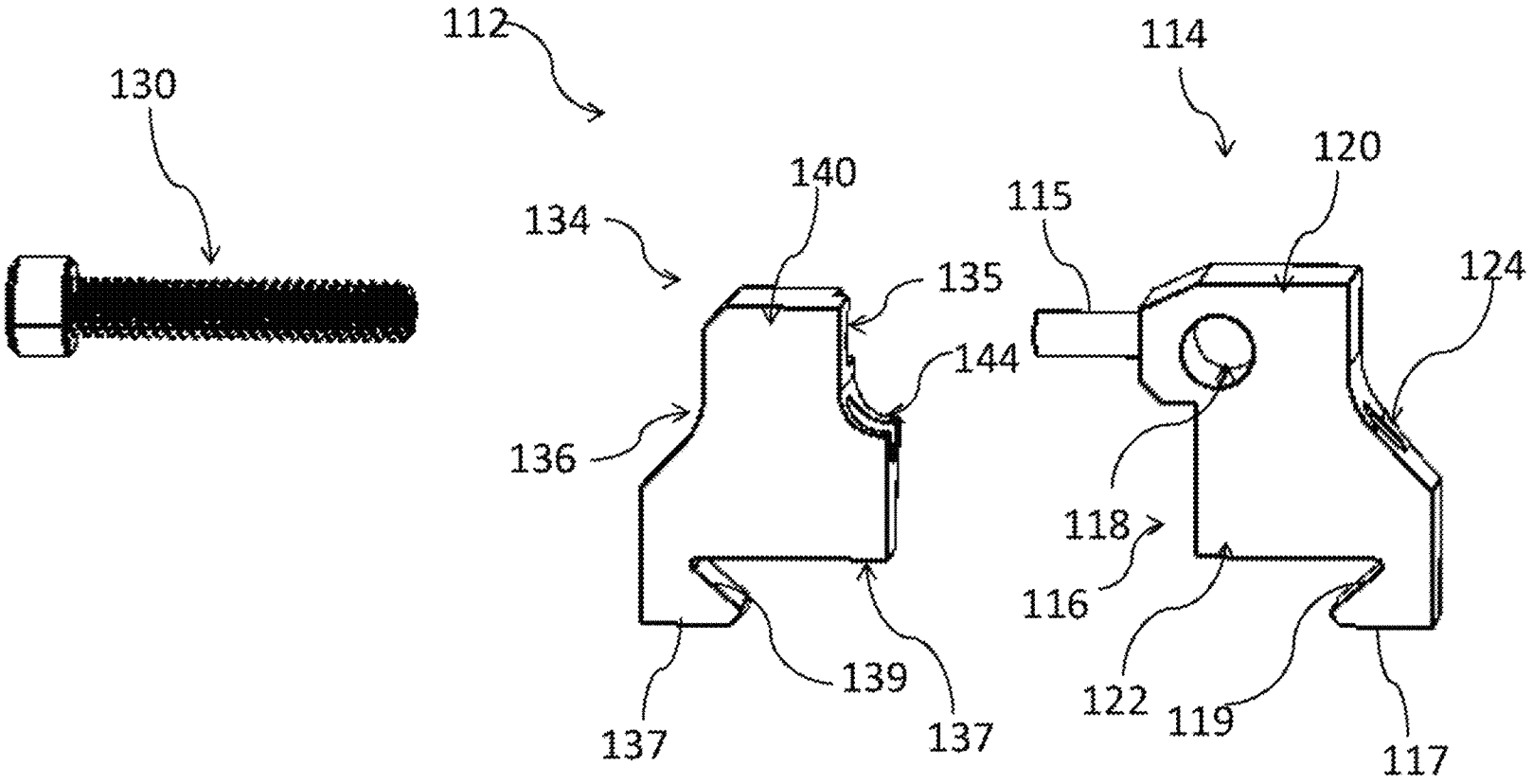
FIG. 18A is an exploded isometric view of an embodiment of a positioning clamp of the archery riser mount of FIG. 17.
Figure 18B:
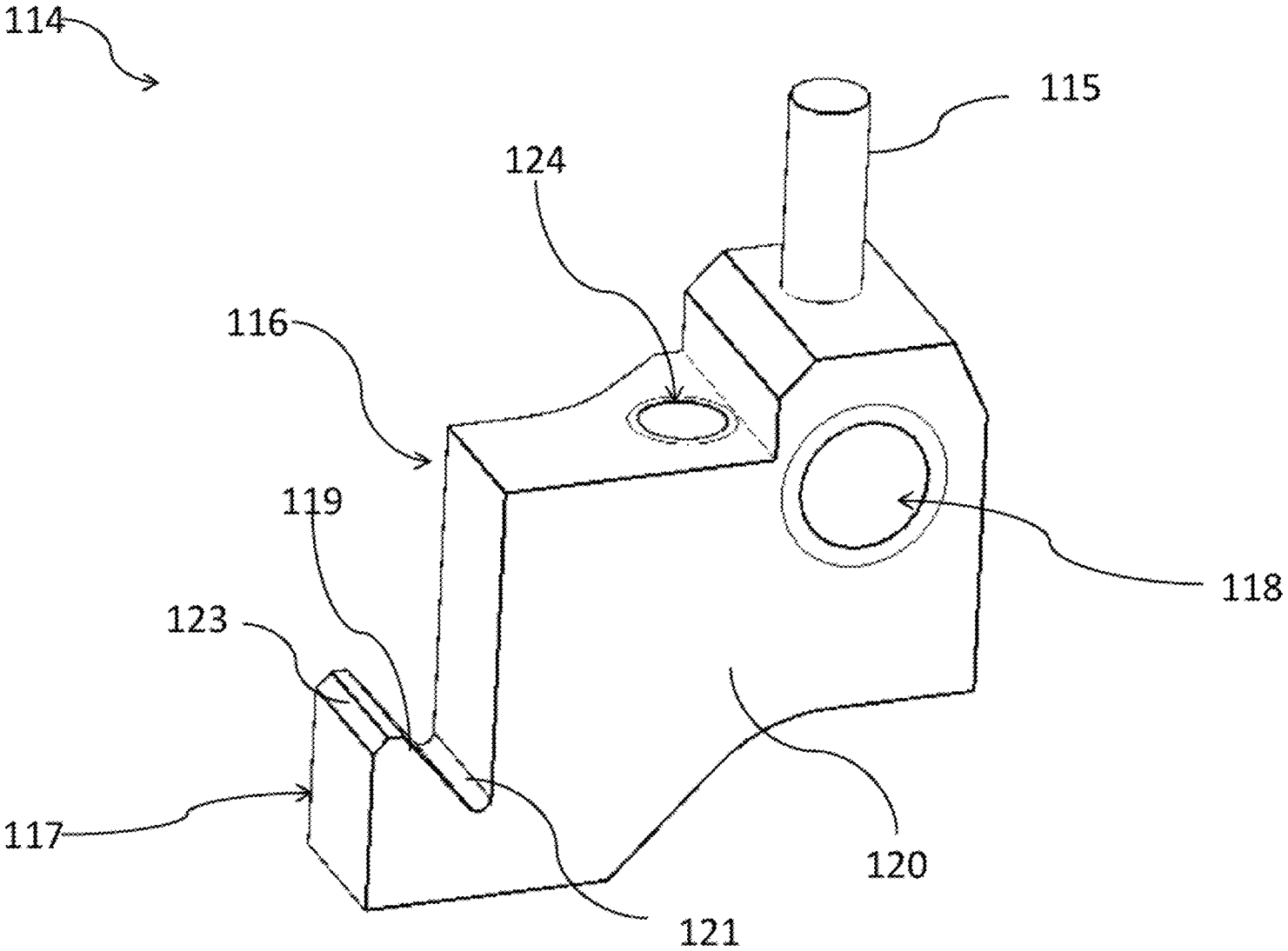
FIG. 18B is a top isometric view of an embodiment of a first clamp portion of the positioning clamp of FIG. 18A.
Figure 19:
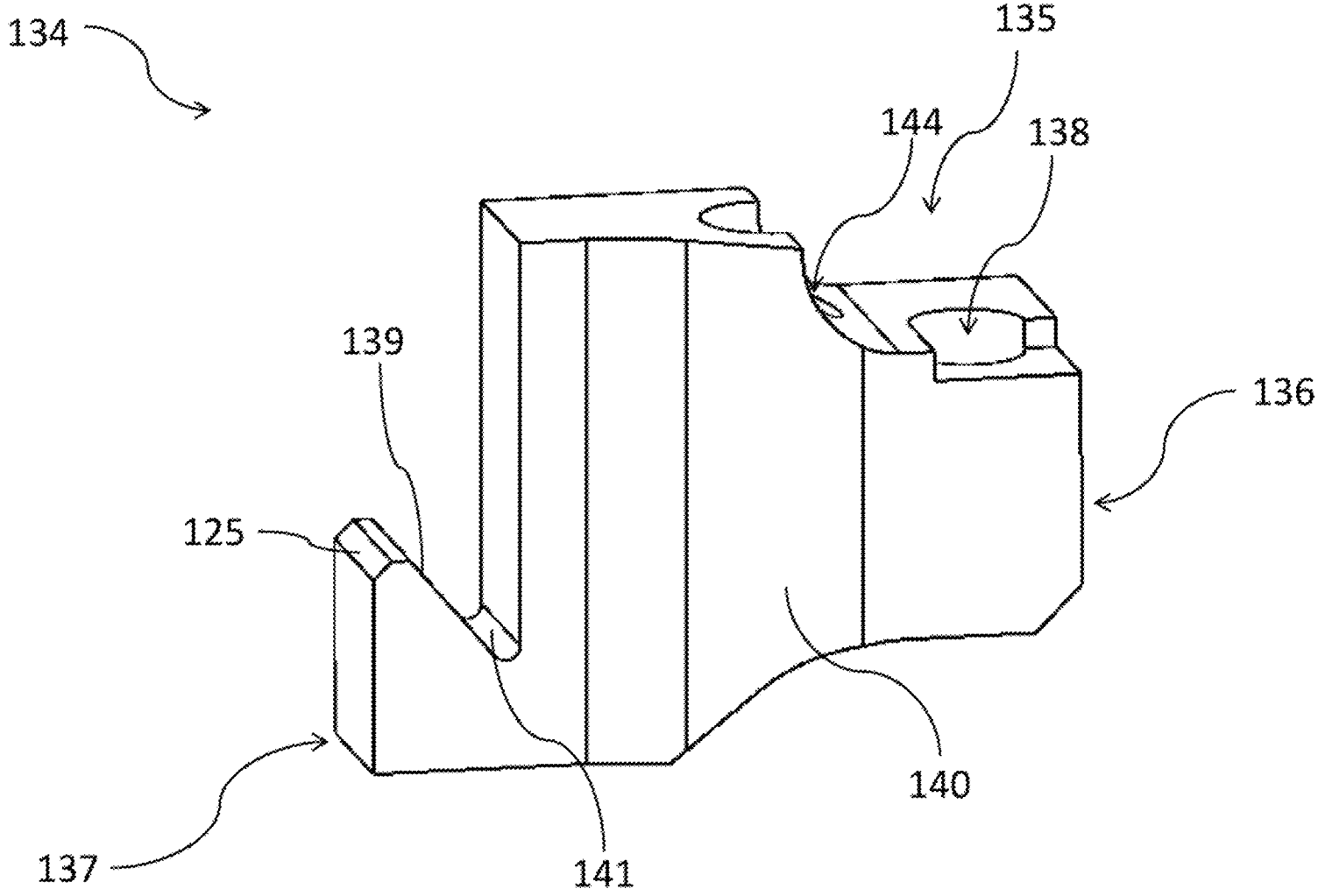
FIG. 19 is a bottom elevation view of an embodiment of a second clamp portion of the positioning clamp of FIG. 18A.

The mounting portion 30 also defines a trench 43*a* (FIG. 9A) extending from second mount surface 36*a*, and the mounting portion 30 defines a trench 43*b* (FIG. 9B) extending from the second mount surface 36*b*. In an embodiment, each of the trenches 43*a*, 43*b* is concave and arc-shaped. This concave shape improves the securement and mated fit of the trenches 43*a*, 43*b* with the clamp noses 123, 125, respectively (FIGS. 18B and 19) as described below.

Figure 9A:
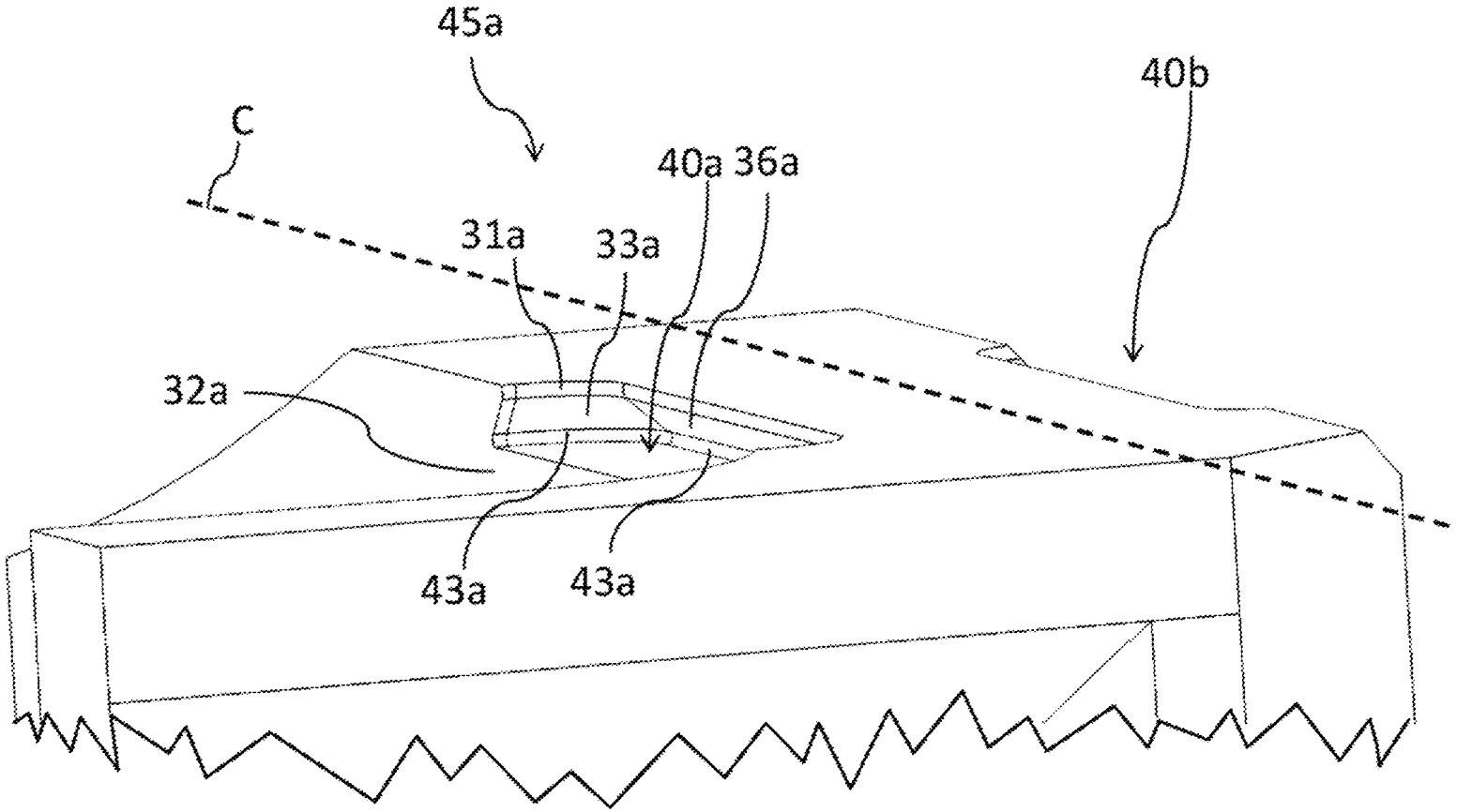
FIG. 9A is an enlarged, bottom isometric view of the mounting portion of FIG. 6.

In an embodiment illustrated in FIGS. 7 and 9A, the mounting sub-portion 30*a* has upper and lower ends or adjustment stoppers 45*a*, 49*a*, respectively. In the embodiment shown, each of the adjustment stoppers 45*a*, 49*a* has an arc shape configured to terminate or stop the motion of the archery accessory 100 when the user is adjusting the position of the archery accessory 100. As described below, the adjustment stoppers 45*a*, 49*a* improve the adjustment process by retaining the archery accessory 100 within a desirable vertical dimension range during the position adjustment process. As shown in FIG. 9A, the upper adjustment stopper 45*a* includes an upper rim portion 31*a* and an upper intermediate portion 33*a* extending from the upper rim portion 31*a*. The trench 43*a* extends from the upper intermediary portion 33*a* to the first mounting portion 34*a*. As shown in FIG. 7, the lower adjustment stopper 49*a* includes a lower rim portion 48*a* and a lower intermediary portion 50*a* extending from the lower rim portion 48*a*. The trench 43*a* extends from the lower intermediary portion 50*a* to the first mounting portion 34*a*.

Figure 8:
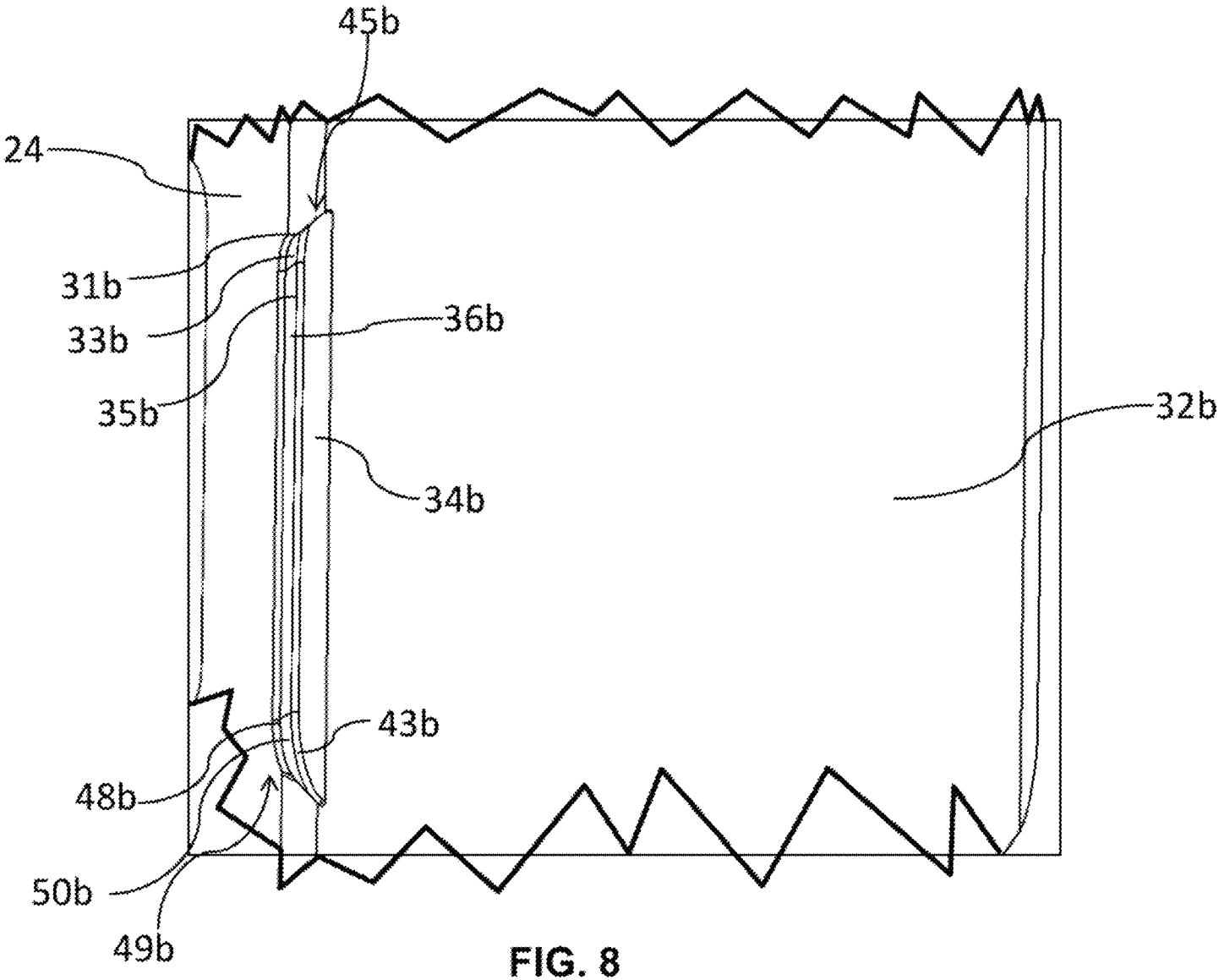
FIG. 8 is an enlarged, right side isometric view of the mounting portion of FIG. 6.
Figure 9B:
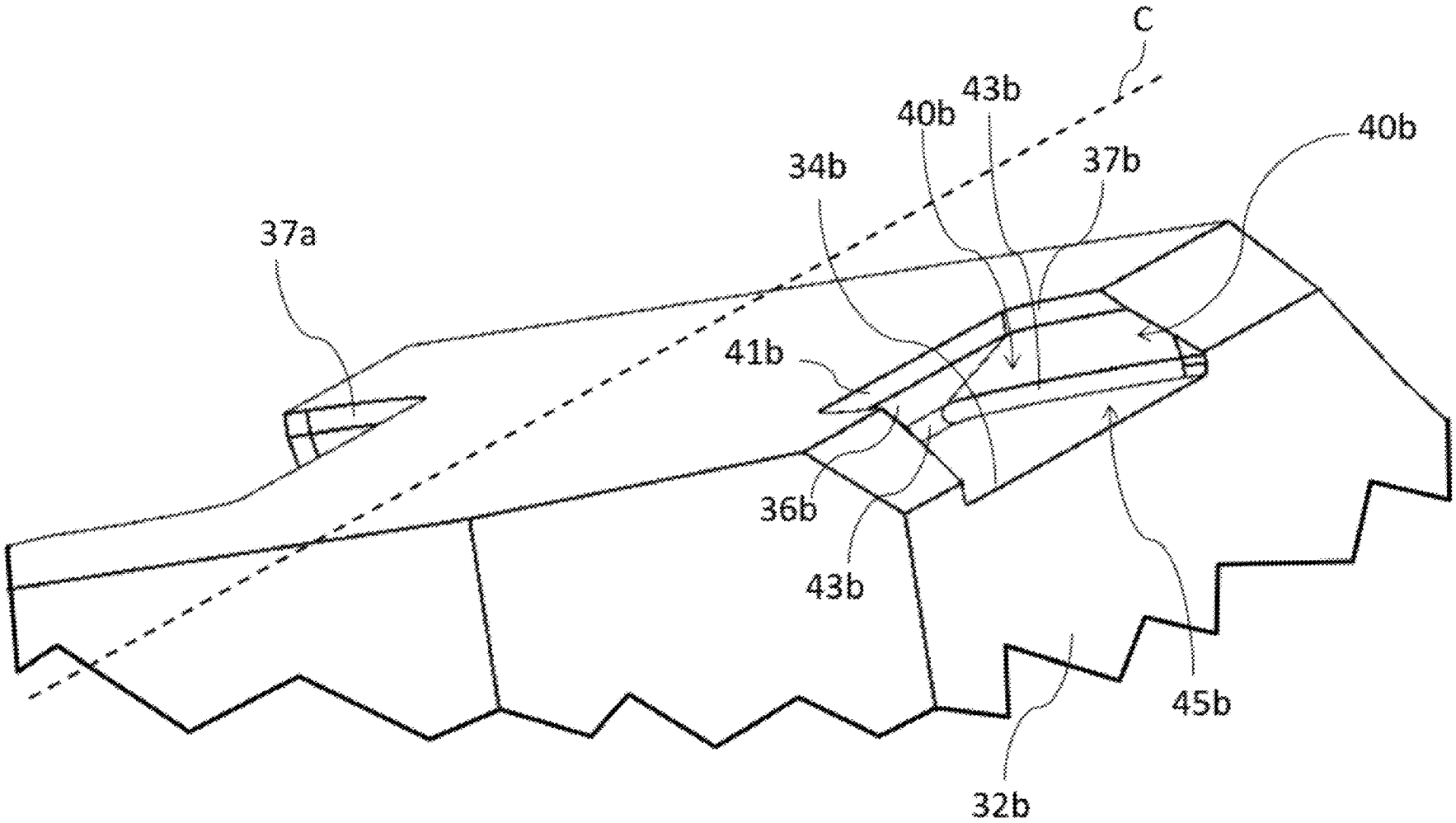
FIG. 9B is an enlarged, right side isometric view of the mounting portion of FIG. 6.

In an embodiment illustrated in FIGS. 8-9, the mounting sub-portion 30*b* has upper and lower arc-shaped ends 45*b*, 49*b*, respectively. As shown in FIG. 9B, the upper arc-shaped end 45*b* includes an upper rim portion 31*b* and an upper intermediate portion 33*b* extending from the upper rim portion 31*b*. The trench 43*b* extends from the upper intermediary portion 33*b* to the first mount surface 34*b*. As shown in FIG. 8, the lower arc-shaped end 49*b* includes a lower rim portion 48*b* and a lower intermediate portion 50*b* extending from the lower rim portion 48*b*. The trench 43*b* extends from the lower intermediary portion 50*b* to the first mount surface 34*b*.

Referring to FIGS. 9A and 9B, the mounting sub-portion 30*a* is undercut so that the trench 43*a* and at least part of the first mount surface 36*a* are located closer to the centerline C than the rim 41*a*. Similarly, as shown in FIG. 9B, the mounting sub-portion 30*b* is undercut so that the trench 43*b* and at least part of the second mount surface 36*b* are located closer to the centerline C than the rim 41*b*. This undercut configuration provides the mounting portion 30 with a dovetail shape that defines cavities 40*a*, 40*b*. In an embodiment not shown, the mounting portion 30 can define a single undercut cavity configured to mate with an archery accessory 100.

Figure 10:
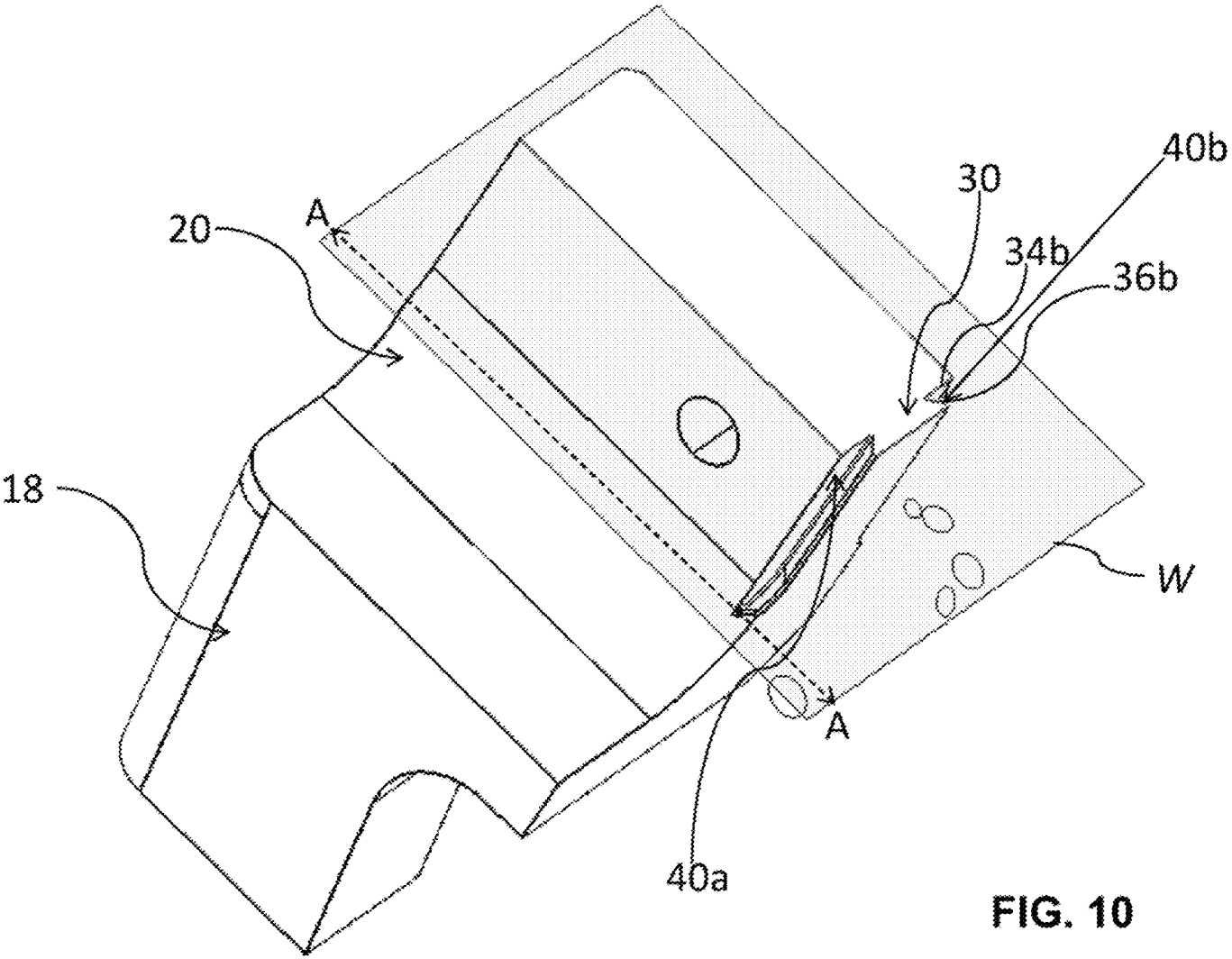
FIG. 10 is an isometric, cross sectional view of the mounting portion of FIG. 6, taken substantially along line 10-10 of FIG. 6 and showing plane W extending through both cavities of the mounting portion.

FIGS. 10 and 11 illustrate a cross section along line A-A (FIG. 6), showing plane W extending through both cavities 40*a*, 40*b* of the dovetail structure or mounting portion 30 and between the forward facing surface 22 and the rearward facing surface 24 of the archery riser 20. As shown, the mounting portion 30 defines the cavities 40*a*, 40*b*. The specific shape of the mounting portion 30 depends on the orientation of the first mounting sub-portion 30*a* and the second mounting sub-portion 30*b* with respect to each other. In an embodiment, the mounting portion 30 is configured to be received by and retained by an archery accessory 100 to releasably couple the archery accessory 100 to the archery riser 20 of the bow 10.

Figure 12:
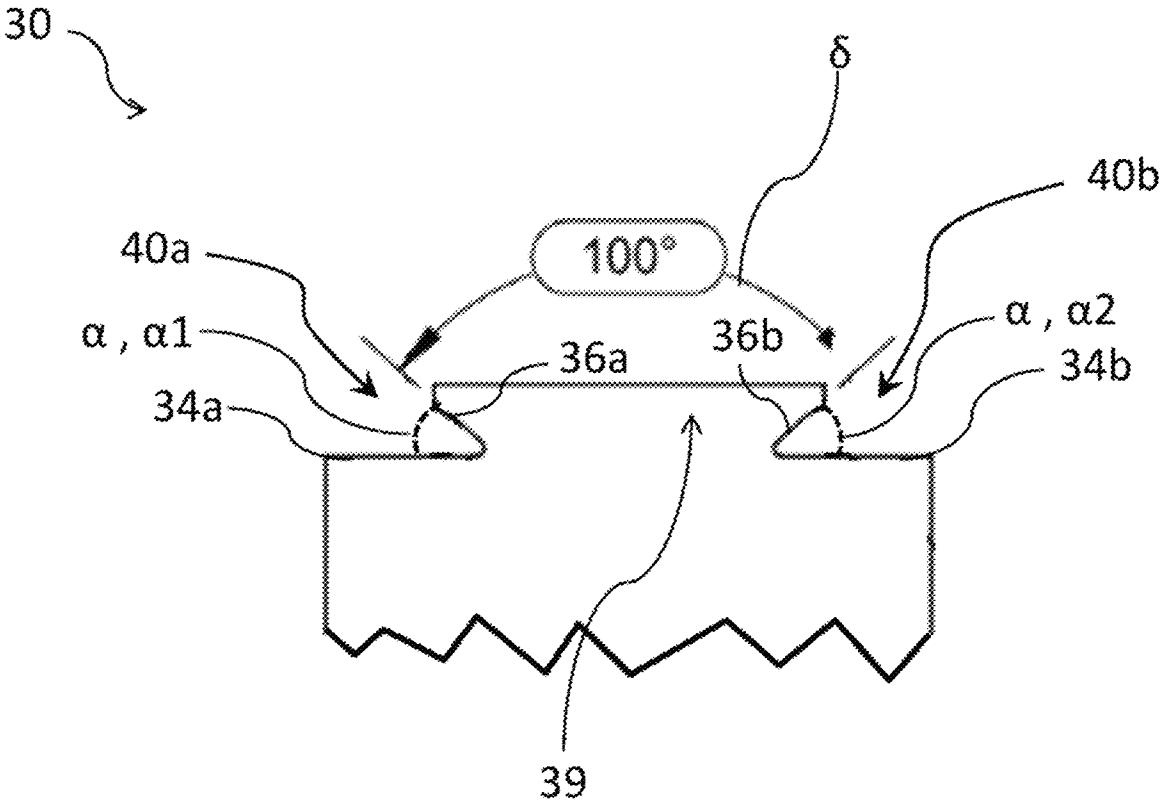
FIG. 12 is a cross sectional view of the mounting portion of FIG. 6, taken substantially along line 10-10 of FIG. 6, illustrating the angular relationships between first mounting surfaces and second mounting surfaces and between corresponding second mounting surfaces.

Referring to FIGS. 11-12, the first and second mounting sub-portions 30*a*, 30*b* are undercut to create an angle α that is less than 90°. In an embodiment, the angle α is less than 70°. In another embodiment, the angle α is less than 60°. In still another embodiment, the angle α is less than 50°. Depending upon the embodiment, the angle α can be any acute angle. As shown, cavity 40*a* is associated with, is partially defined by, and spans angle α1. Likewise, cavity 40*b* is associated with, is partially defined by and spans angle α2. Referring to FIG. 12, an angle δ exists between each of the second mount surfaces 36*a*, 36*b*. In this embodiment, angle δ is greater than 90°. In an embodiment, the angle δ is equal to or substantially 100°. In another embodiment, the angle δ is greater than 100°. Depending upon the embodiment, angle δ can be any obtuse angle.

Figure 13:
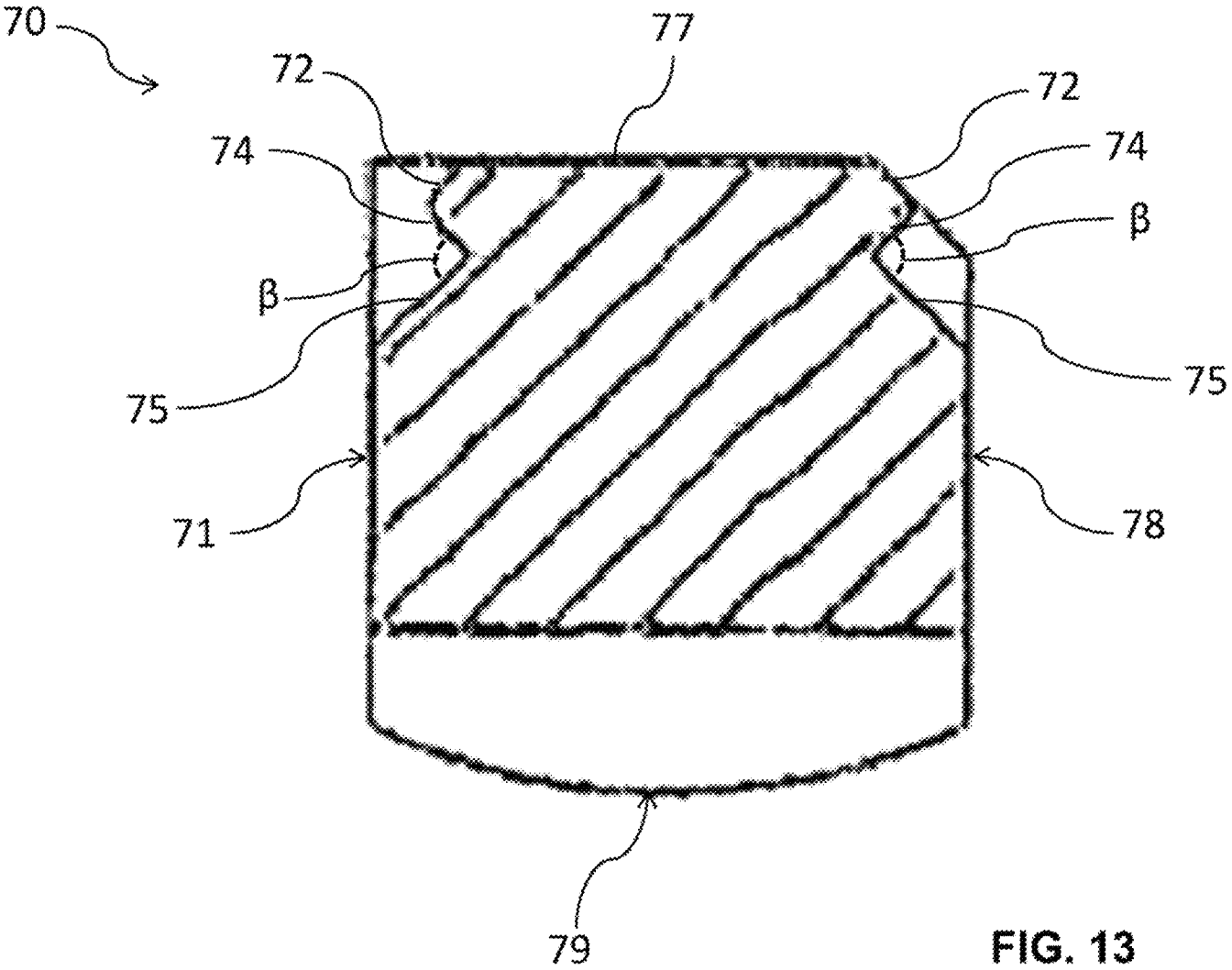
FIG. 13 is a cross sectional view of a prior art coupling portion disclosed in FIG. 8 of U.S. Pat. No. 9,829,270 issued on Nov. 28, 2017.

In comparison, as shown in FIG. 13, a prior art bow riser includes a coupling portion 70 disclosed in FIG. 8 of U.S. Pat. No. 9,829,270 issued on Nov. 28, 2017. FIG. 13 is a cross sectional view of the prior art coupling portion 70, taken along a line from a rearward facing surface 77 to a forward facing surface 79. The prior art coupling portion 70 has a first side surface 71, a first surface 72, a second surface 74, a third surface 75, and a second side surface 78. The second surface 74 extends at an angle β relative to the third surface 75, where β is not less than 90°.

The prior art coupling portion 70 differs from the mounting portion 30 in numerous aspects. In one aspect, angle α (FIG. 12) of mounting portion 30 is less than 90° in contrast to angle β of the prior art coupling portion 70. The relatively large angle β (FIG. 13) of the prior art coupling portion 70 has several disadvantages. For example, this large angle β makes it difficult to secure accessories to the prior art coupling portion 70. The difficulty is caused by a reduction in counteractive forces from the coupling portion 70. This large angle β reduces the compressive or securing forces that the coupling portion 70 can apply to an accessory. In contrast, the relatively small angle α (FIG. 12) enhances the entrapment of the accessory, providing an important improvement for accessory securement and adjustability. This enables the mounting portion 30 to apply increased securing forces to entrap the accessory after the accessory's position is set. Also, during the position adjustment of the accessory, the relatively small angle α aids in restraining the movement of the accessory to a predetermined path with less variability than the prior art coupling portion 70.

Figure 6:
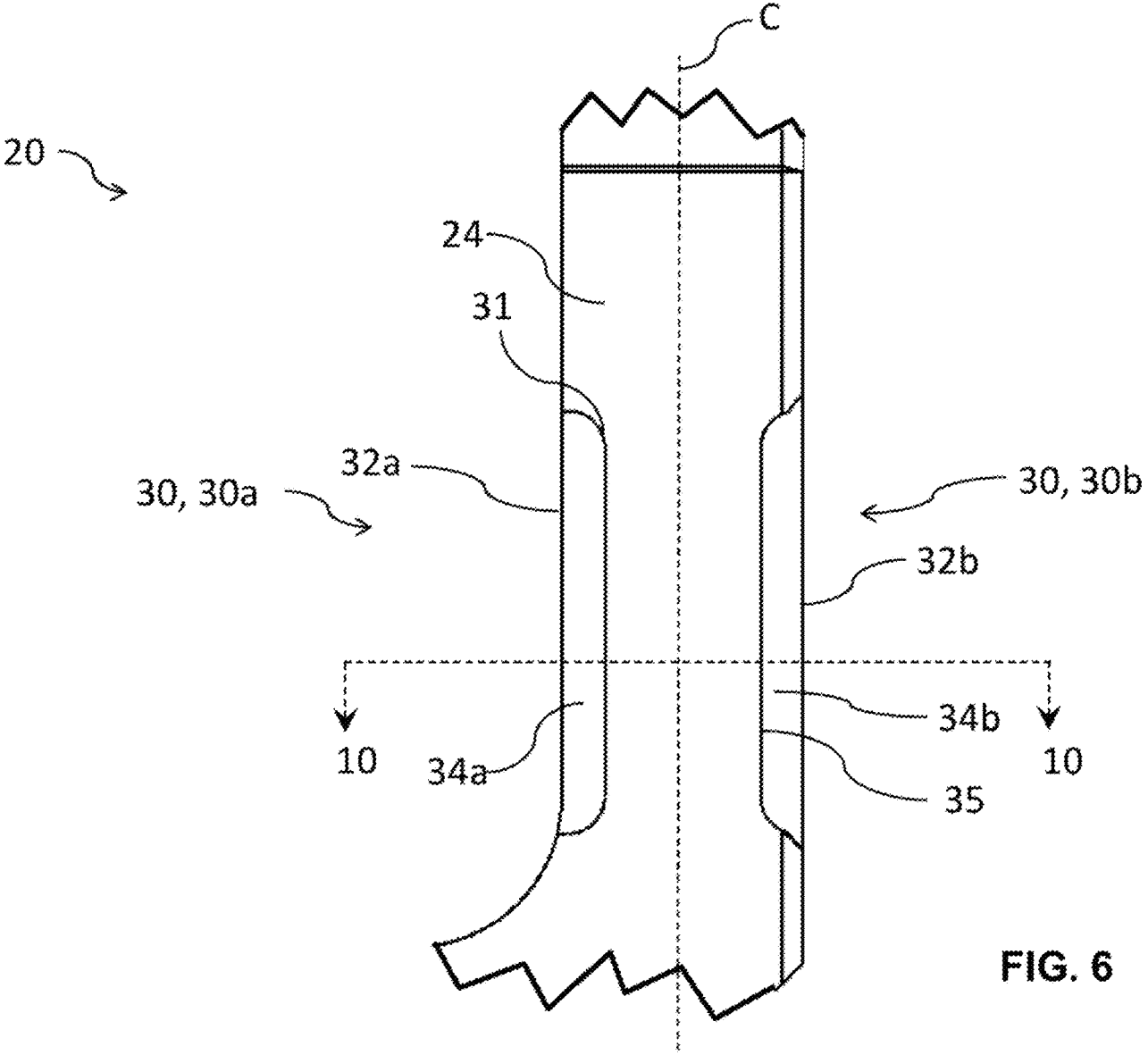
FIG. 6 is an enlarged, isometric view of the mounting portion of FIG. 5.

In the embodiment shown, the mounting sub-portions 30*a*, 30*b* are symmetrical relative to center line C (FIG. 6). That is, the structure, geometry and cavities of mounting sub-portion 30*a* are identical to, but mirror images of, the structure, geometry and cavities of mounting sub-portion 30*b*. In other embodiments, there are structural or geometric differences between mounting sub-portions 30*a*, 30*b*.

Archery Riser Mount

Figure 14:
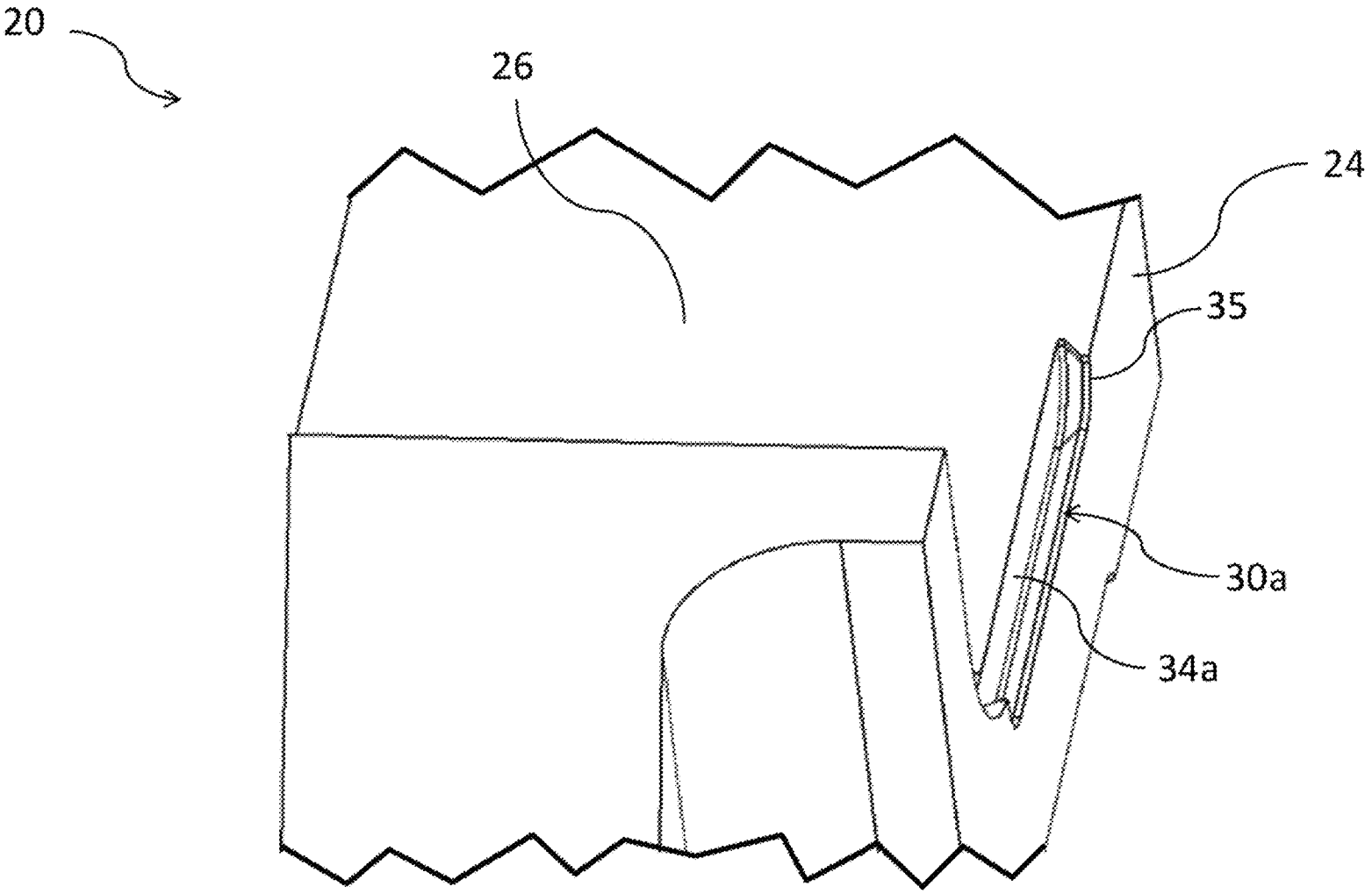
FIG. 14 is a bottom side isometric view of the mounting portion of FIG. 6, illustrating a first mounting sub-portion.
Figure 15:
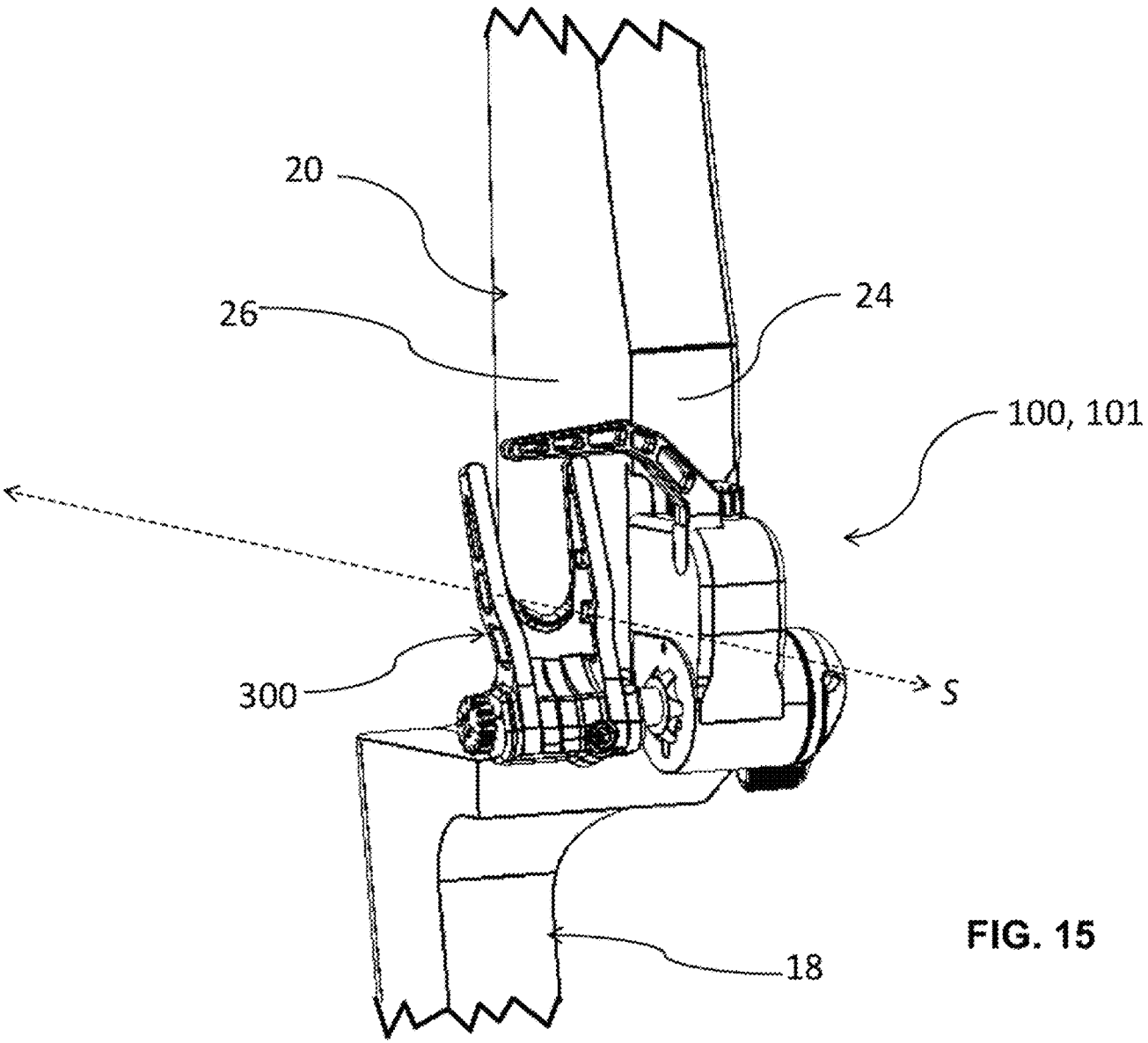
FIG. 15 is arear, isometric view of the embodiment of the archery riser of FIG. 5, illustrating an archery accessory coupled to the mounting portion.
Figure 16:
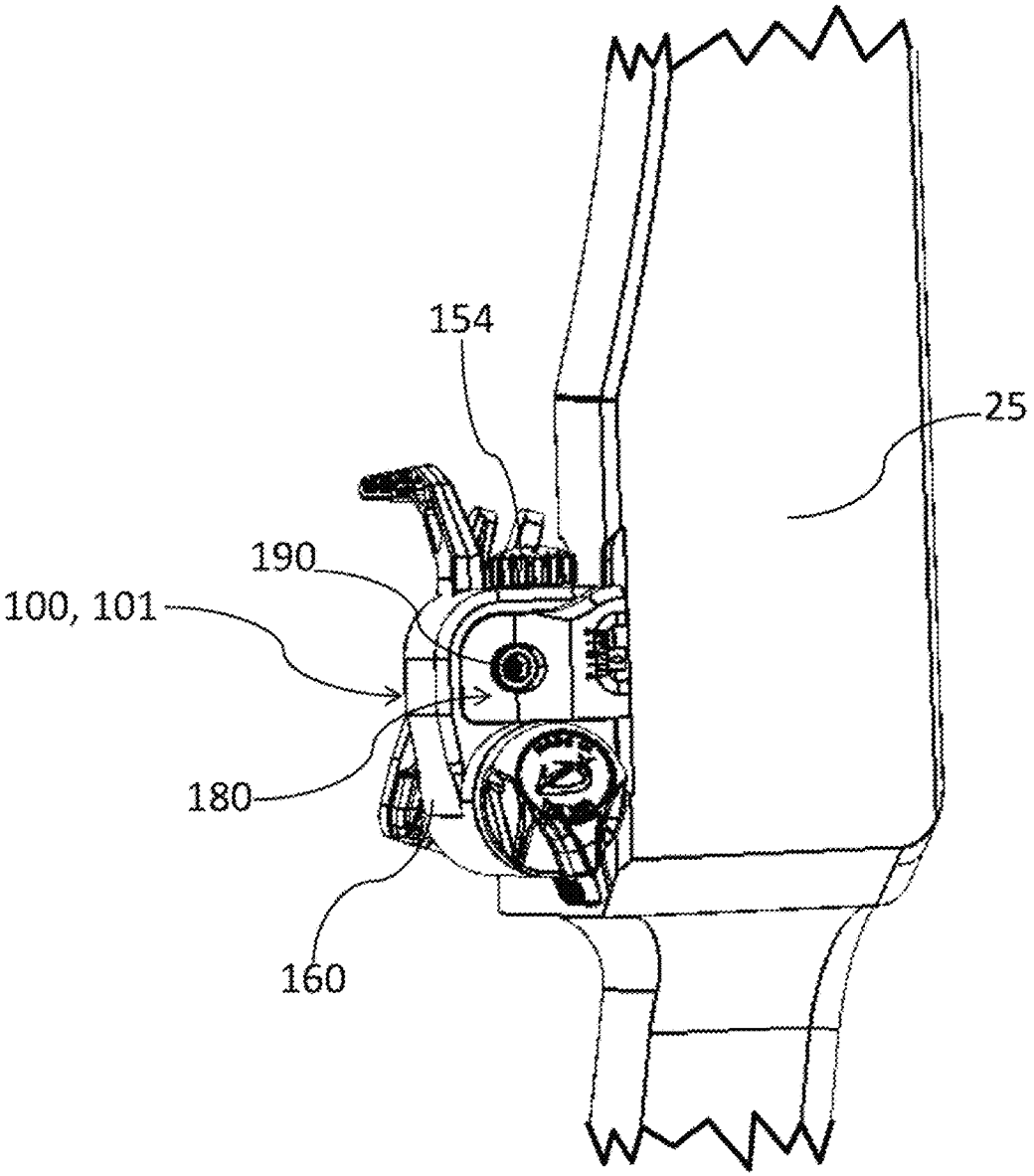
FIG. 16 is a right, isometric view of the embodiment of FIG. 15, showing the archery riser with the archery accessory coupled to the mounting portion.

Referring to FIGS. 14-16, an archery accessory 100 can be mounted to the mounting sub-portions 30*a*, 30*b* (FIGS. 4-13) of the archery riser 20. As shown, the mounting portion 30 is positioned on the rearward facing surface 24 of the archery riser 20, however in other embodiments, the mounting sub-portions 30*a*, 30*b* may be located on another side or face of the archery riser 20. In the embodiment shown, the archery accessory 100 is a fall-away, arrow rest device 101 having a launcher, arrow guide or projectile support device 300. As shown in FIG. 15, the arrow rest device 101 is positioned such that the projectile support device 300 is configured to support the projectile 11 (FIG. 1), keeping the projectile 11 positioned along a shooting axis S before the projectile 11 is launched.

Figure 17:
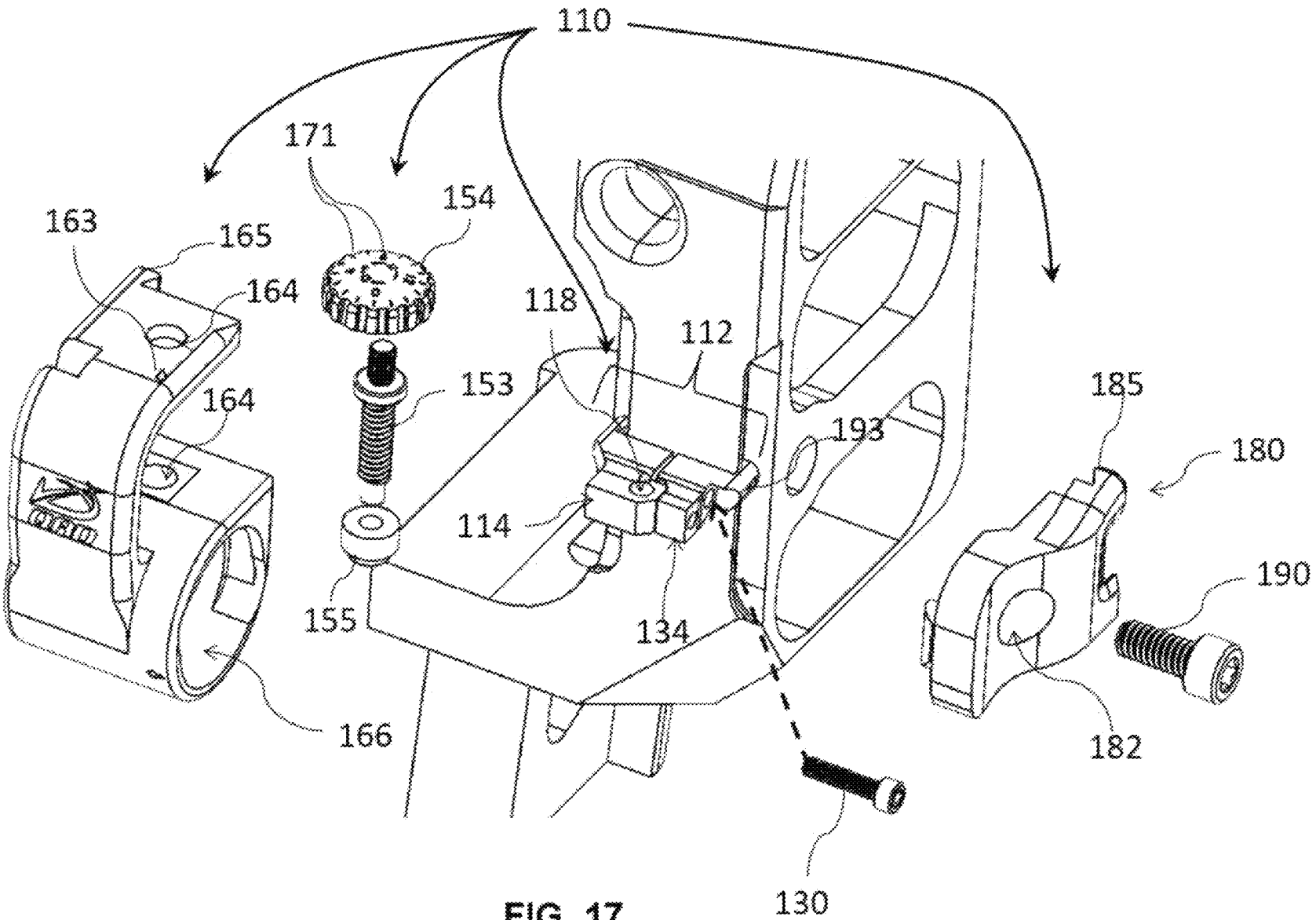
FIG. 17 is an exploded, isometric view of an embodiment of an archery riser mount of the archery accessory of FIG. 16.

Referring to FIGS. 16-19, the archery accessory 100 includes an archery riser mount 110 having a positioning clamp assembly 112. The positioning clamp assembly 112 includes a first clamp portion 114 and a second clamp portion 134, as illustrated in FIG. 17. As shown in FIG. 18B, the first clamp portion 114 includes a first body 116 defining a vertical hole or vertical bore 118 extending from a top surface 120 to a bottom surface 122 and having a projection 115 extending from one end. The vertical bore 118 extends along or parallel to the shooting plane V. A first clamp arm 117 extends from an opposing end and includes a first clamping surface 119 configured to contact the second mount surface 36*b* (FIG. 11) of the mounting sub-portion 30*b*. Also, the first clamp arm 117 includes a first clamp nose 123. The first clamp nose 123 has a convex, arc shape configured to mate with the trench 43*a* (FIG. 9A). As shown, a groove, valley or notch 121 may be formed between the first clamp arm 117 and the first body 116. The first clamp portion 114 further defines a first hole or first bore 124 extending between opposing sides of the first clamp portion 114 and along an axis that is substantially perpendicular to the axis of vertical bore 118 and that intersects with the shooting plane V. In an embodiment, the vertical bore 118 is positioned between the first bore 124 and the first clamp arm 117.

The second clamp portion 134 (FIG. 18A) includes a second body 136 having a top surface 140 and a bottom surface 122. The second clamp body 136 further defines a cavity or chamber 135 at one end that is configured to receive at least a portion of the projection 115 of the first clamp portion 114. In the embodiment shown, the chamber 135 includes a projection receiving bore 138. The projection receiving bore 138 is configured to receive the projection 115. In the embodiment shown, the projection receiving bore 138 is thread-less and configured to slideably receive the projection 115.

A second clamp arm 137 extends from an opposing end of the second clamp body 136 and includes a second clamping surface 139 configured to contact the first mount surface 36*a*

(FIG. 11) of the mounting sub-portion 30*a*. Also, the second clamp arm 137 includes a second clamp nose 125. The second clamp nose 125 has a convex, arc shape configured to mate with the trench 43*b* (FIG. 9B). As shown, a groove, valley or notch 141 may be formed between the second clamp arm 137 and the second body 136. The second clamp portion 134 further defines a second hole or second bore 144 extending along an axis that is substantially parallel to the chamber 135 and that intersects with the shooting plane V. In an embodiment, the second bore 144 may be positioned between the chamber 135 and the second clamp arm 137.

As shown in FIG. 17, a positioning fastener 130 is configured to be inserted into and extend through the first bore 124 and into the second bore 144 to draw the first clamp portion 114 and the second clamp portion 134 towards each other. By tightening the positioning fastener 130, a user can secure the archery accessory 100 in a desired position relative to the archery riser 20. This step occurs during the adjustment mode. As shown, the positioning fastener 130 may be threaded and configured to engage a set of complimentary threads located on one or more interior surfaces of the first bore 124 and the second bore 144. As described below, in a locking mode, a locking fastener 190 is configured to increase the compression force exerted by the positioning clamp assembly 112 on the archery riser 20. In the embodiment shown, the second clamp portion 134 includes a clamp indicator 193 (FIG. 17), which, as described below, aids in the adjustment process.

Figure 20:
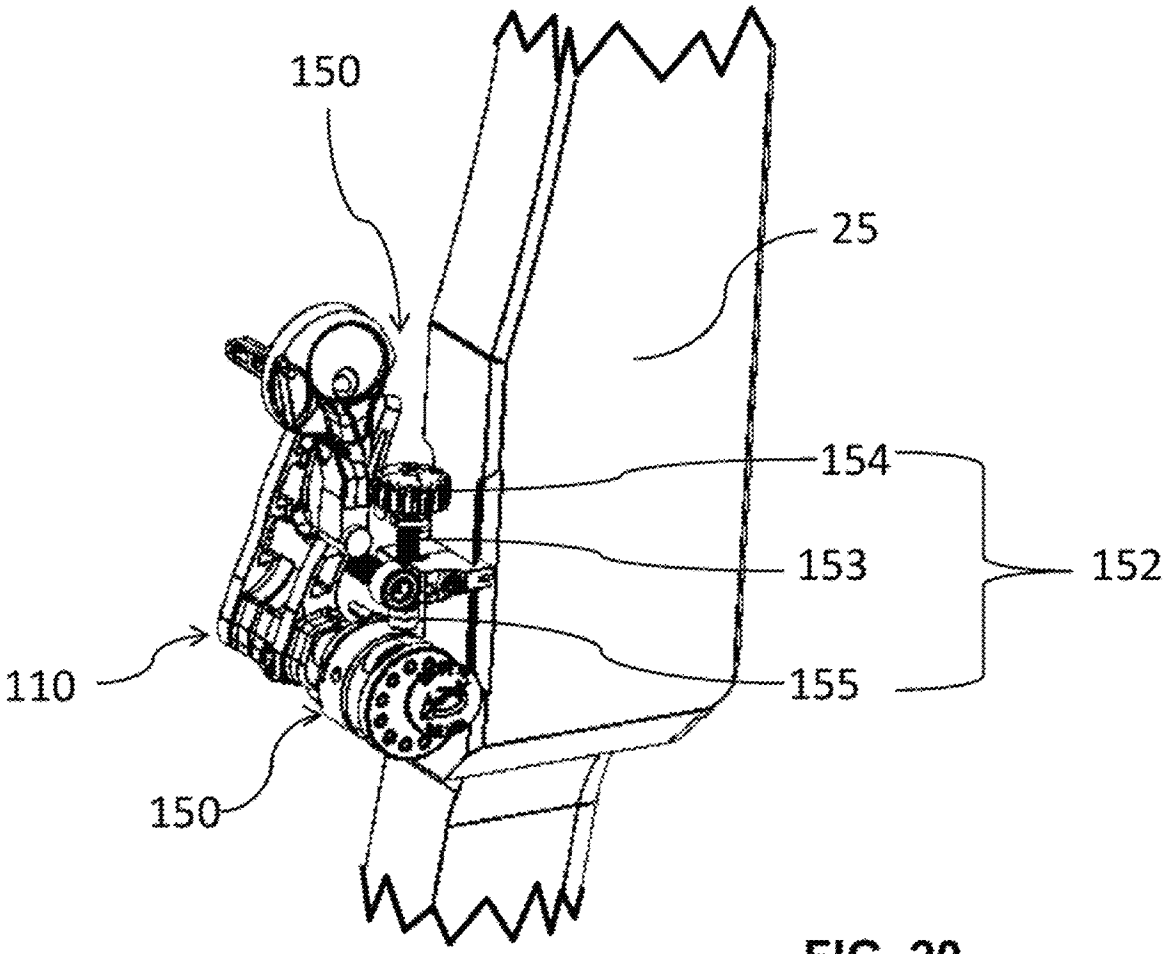
FIG. 20 is an embodiment of an accessory support of the archery riser mount where the accessory support further comprises an accessory support coupler configured to couple the accessory support to the mounting portion of the archery riser of FIG. 1.
Figure 21:
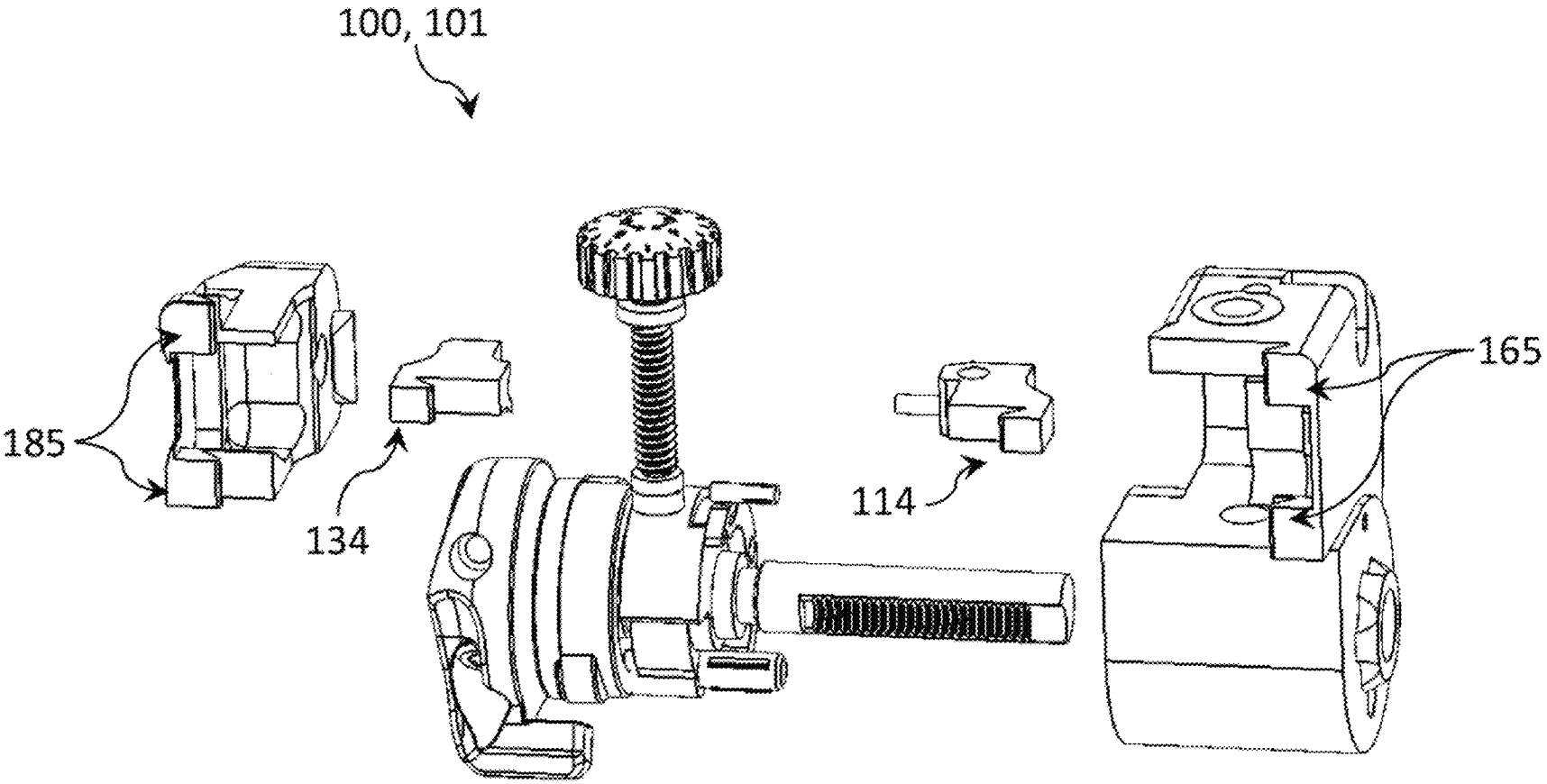
FIG. 21 is an exploded, isometric view of the archery accessory of FIG. 16.
Figure 22:
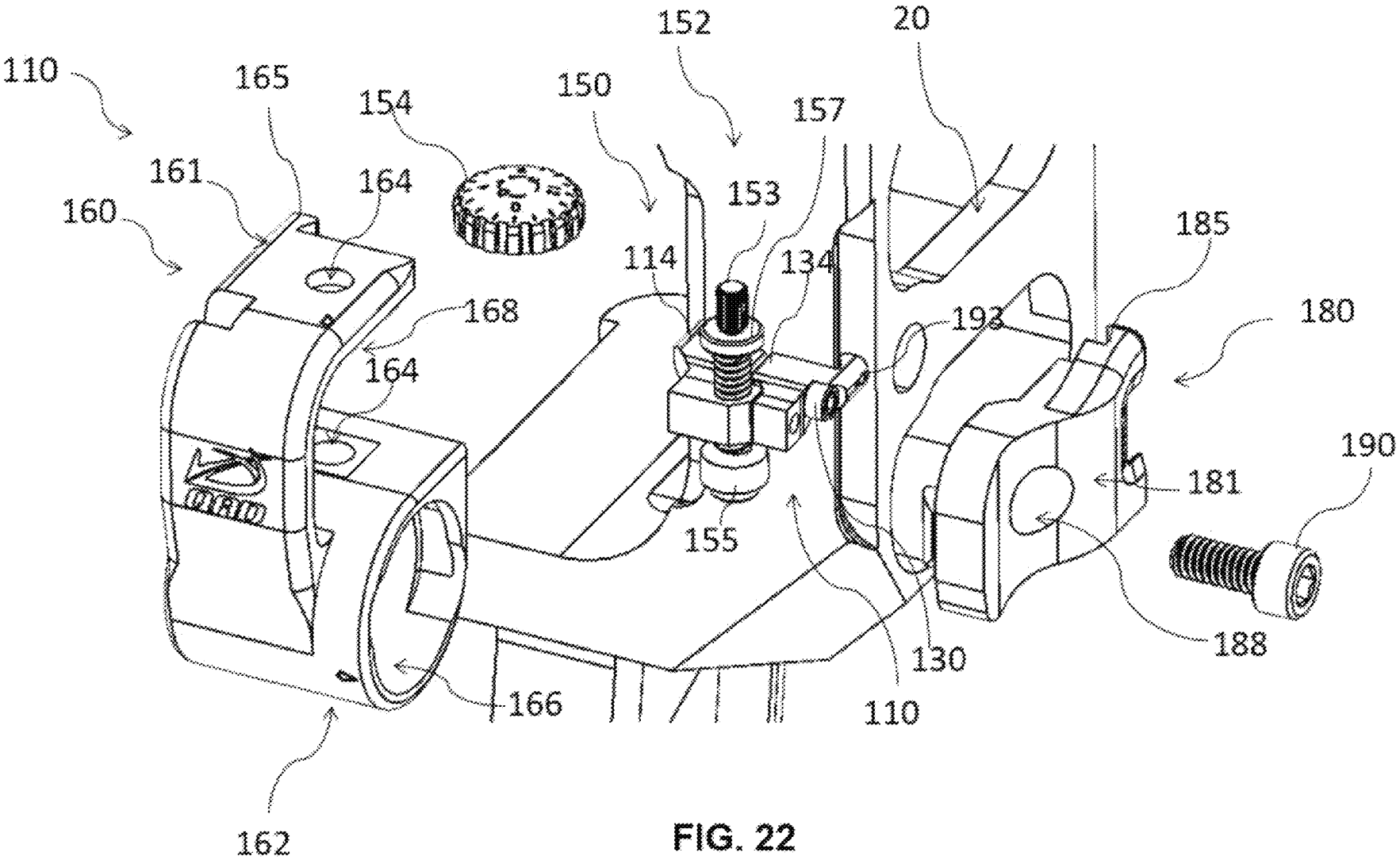
FIG. 22 is an exploded, isometric view of the archery accessory of FIG. 21 with the positioning clamp coupled to the mounting portion of the archery riser of FIG. 1.
Figure 23:
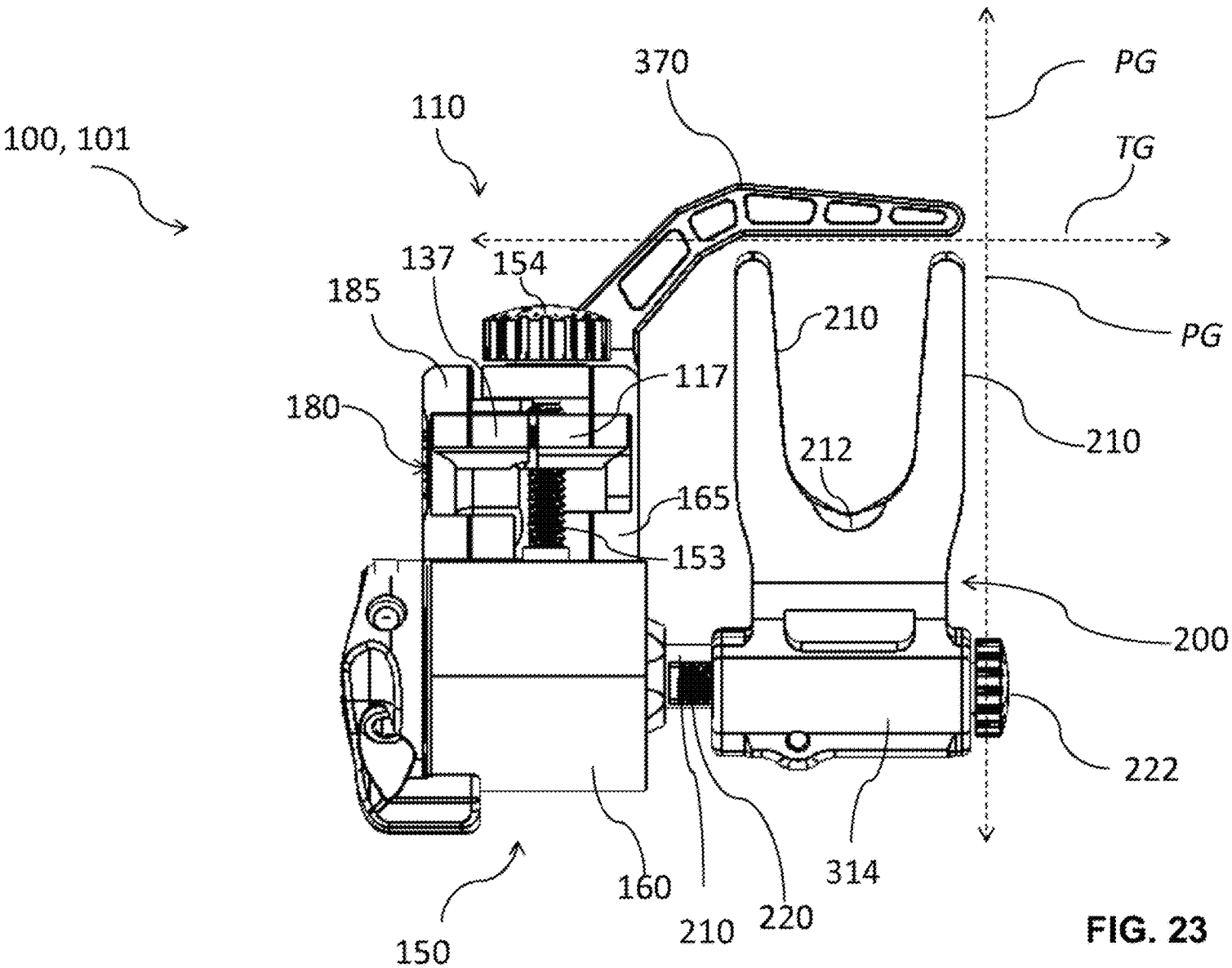
FIG. 23 is a front elevation view of an embodiment of an archery accessory adjustment assembly coupled to the archery riser mount of the arrow rest device shown in FIG. 15.
Figure 24B:
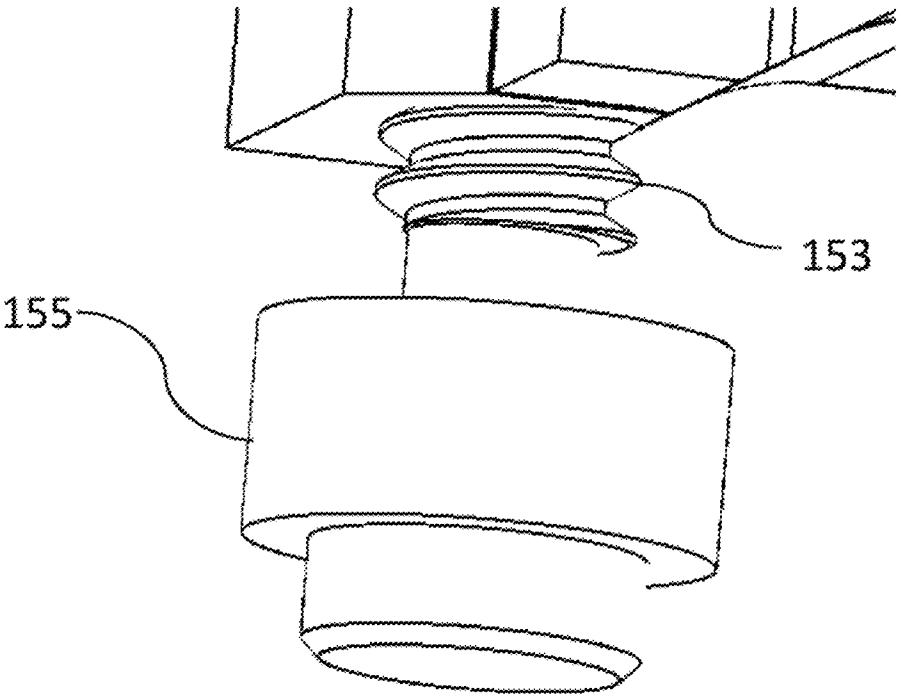
FIG. 24B is a bottom isometric view of the vertical adjuster of FIG. 24A coupled to a stopper at one end.
Figure 24A:
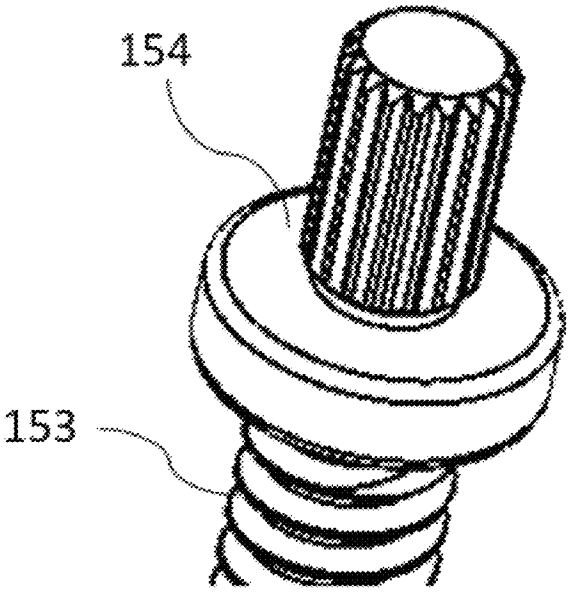
FIG. 24A is a top isometric view of an embodiment of a vertical adjuster coupled to an adjustment knob of the accessory support of FIG. 20.
Figure 25:
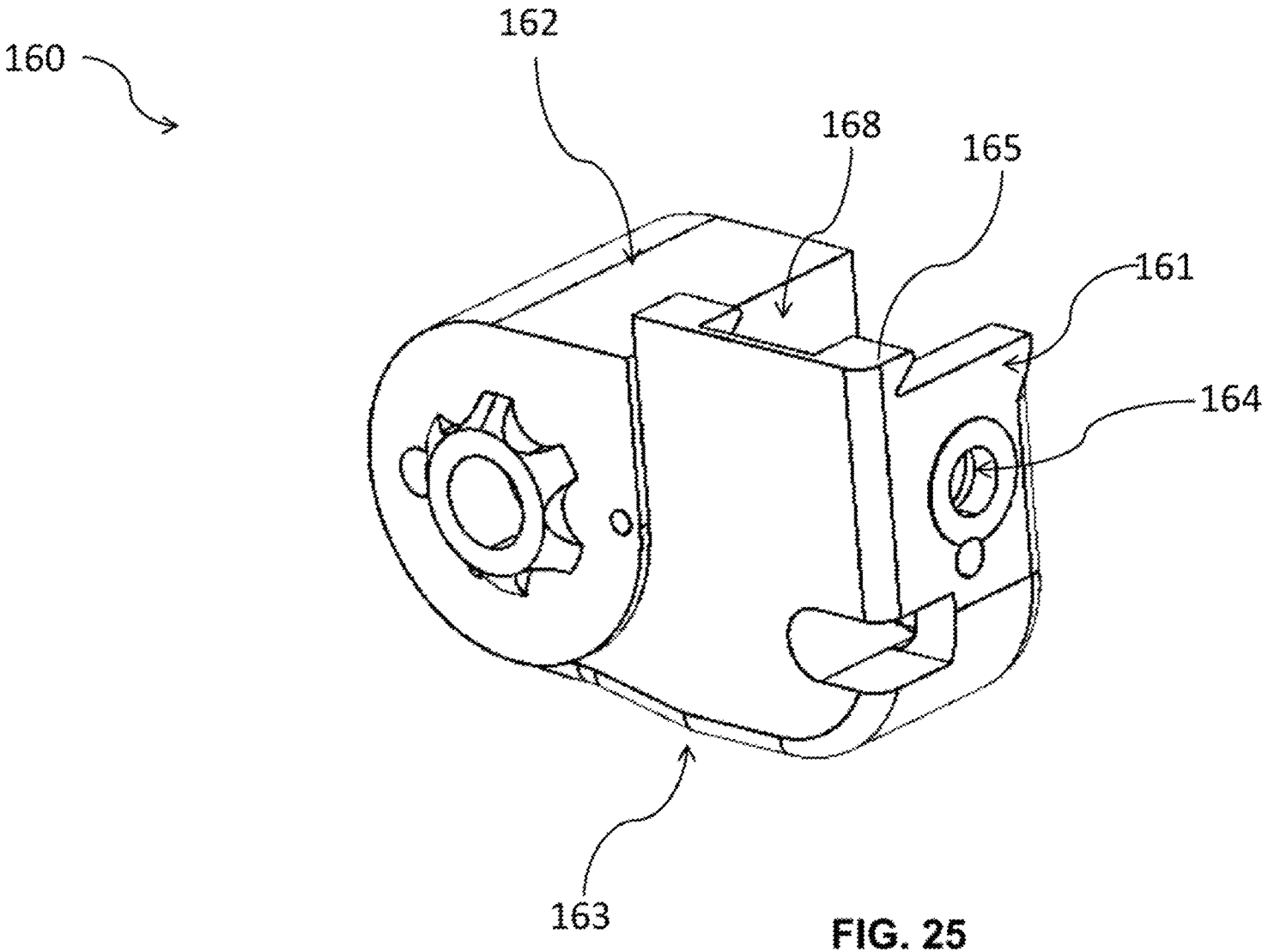
FIG. 25 is an isometric view of the exterior of an embodiment of a housing configured to cover at least a portion of the accessory support and the positioning clamp assembly of FIG. 20.
Figure 26:
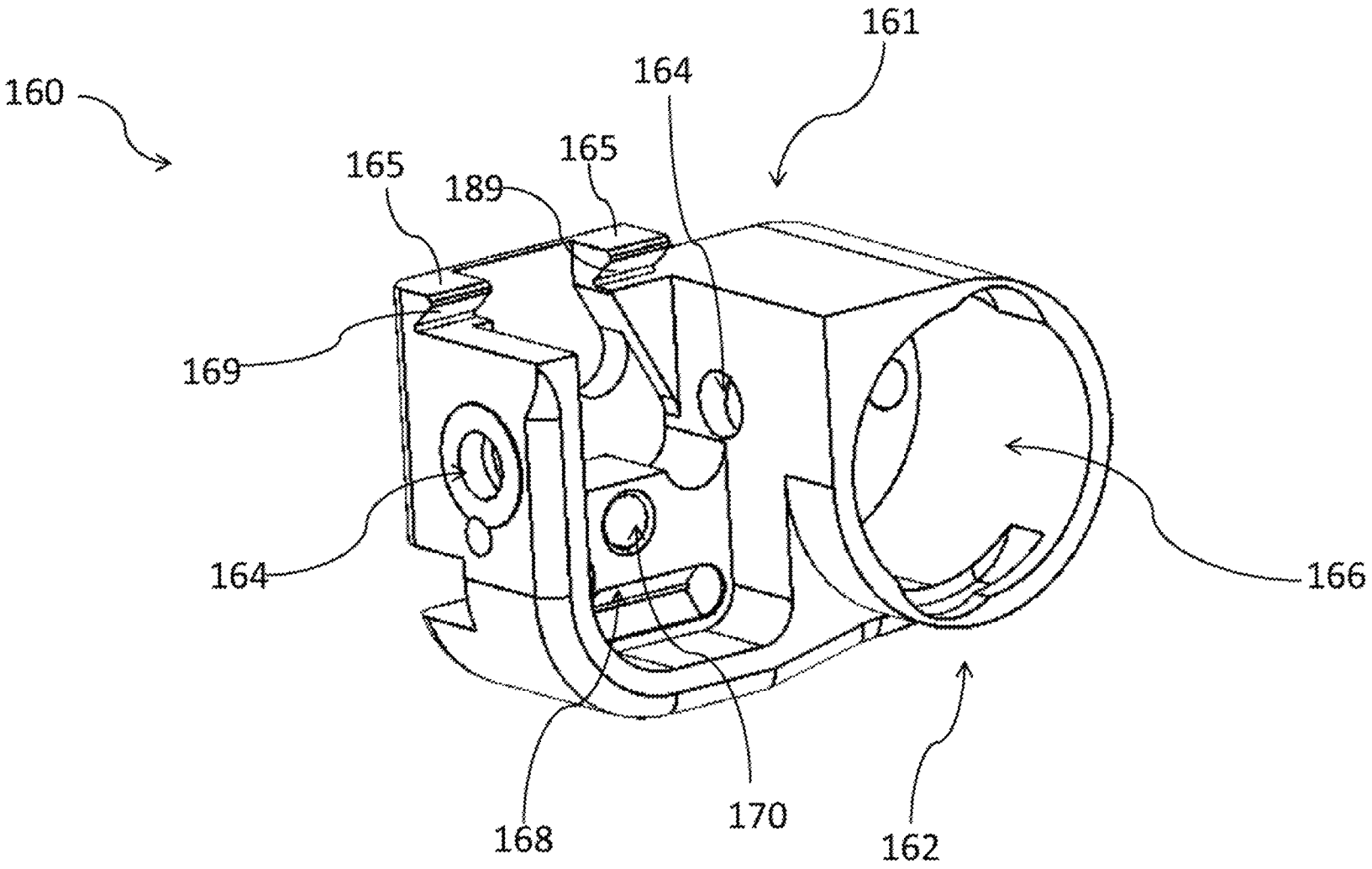
FIG. 26 is an isometric view of the interior of the embodiment of the housing from FIG. 25.

Referring to FIGS. 20-24, the archery riser mount 110 includes an accessory support 150. The accessory support 150 is configured to couple to the first clamp portion 114 by an accessory support coupler 152 (FIG. 20). In the embodiment shown, the accessory support 150 is a portion of the archery accessory 100, specifically, the arrow rest device 101. In other embodiments, the accessory support 150 can be any device configured to support an archery accessory 100. As shown, the accessory support coupler 152 includes a vertical adjuster 153 coupled to an adjustment knob 154, a lower bushing or lower stopper 155 coupled to the opposing end of the vertical adjuster 153, and an upper bushing or upper stopper 157 (FIG. 22). The vertical adjuster 153 may be configured to interact with complimentary threads on an interior surface of the vertical bore 118 (FIG. 17). Rotation of the adjustment knob 154 in one direction causes the accessory support 150 to move upward, incrementally raising the position of the archery accessory 100 relative to the archery riser 20 while the archery riser mount 110 is in the adjustment mode. Rotation of the adjustment knob 154 in the opposite direction causes the accessory support 150 to move downward, incrementally lowering the position of the archery accessory 100 relative to the archery riser 20 while the archery riser mount 110 is in the adjustment mode. The stoppers 155, 157 limit the upward and downward travel range of the accessory support 150, as described below.

Figure 32A:
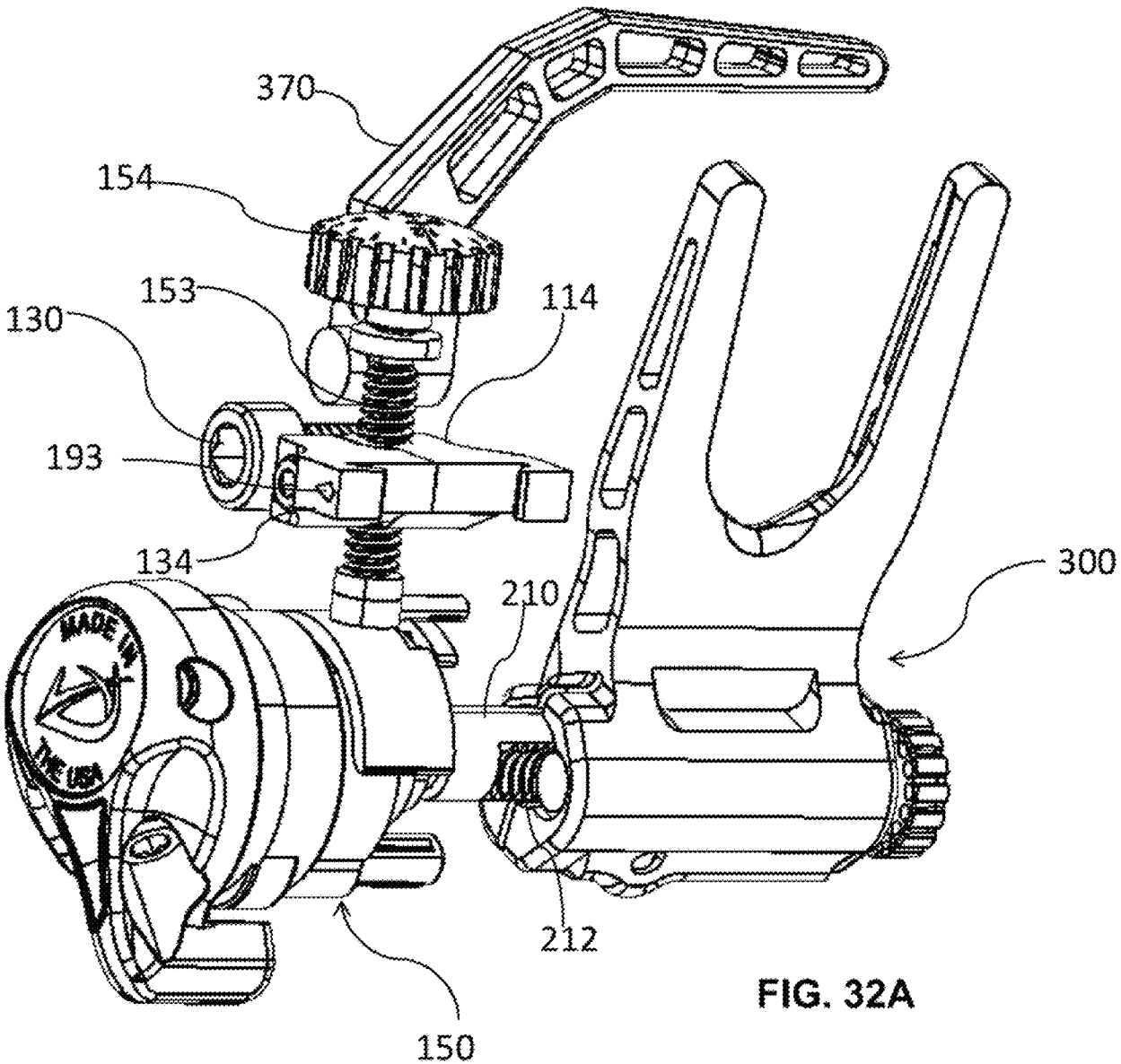
FIG. 32A is a front, isometric view of the arrow rest device of FIG. 23, illustrating the housing and locking device removed.

In the embodiment shown, the housing 160 is configured to house or cover at least a portion of the accessory support 150 and the positioning clamp assembly 112. As shown in FIGS. 21-27, the housing 160 may include a top 161 and a bottom 162 and may define one or more openings 164 (FIG. 22) that are configured to receive a portion of the accessory support coupler 152. The housing 160 may further include a main cavity 166 (FIG. 22) configured to surround at least a portion of the accessory support 150. One or more additional compartments 168 may be located above and/or around the main cavity 166 and may be configured to house additional accessory support 150 components. In an embodiment, the main cavity 166 houses and holds one or more links, springs and couplers that are connected to each other to control the position of the projectile support device 300 (FIG. 32A).

The housing 160 may further include at least one housing riser engager 165 (FIGS. 22 and 26) that is configured to engage the first mount surface 34*a* and second mount surface 36*a* of mounting sub-portion 30*a* (FIG. 11). In the embodiment shown, the housing 160 is formed as a single, unitary component, however in other embodiments, the housing 160 may be included of two or more components that are coupled together using fasteners, welded joints, or any other suitable coupling method. The housing 160 may include additional markings etched or embossed onto a surface of the housing 160, including a position indicator 163 that is configured to point to one of the adjustment measure markings 171 of the knob 154, as illustrated in FIG. 17.

Figure 27:
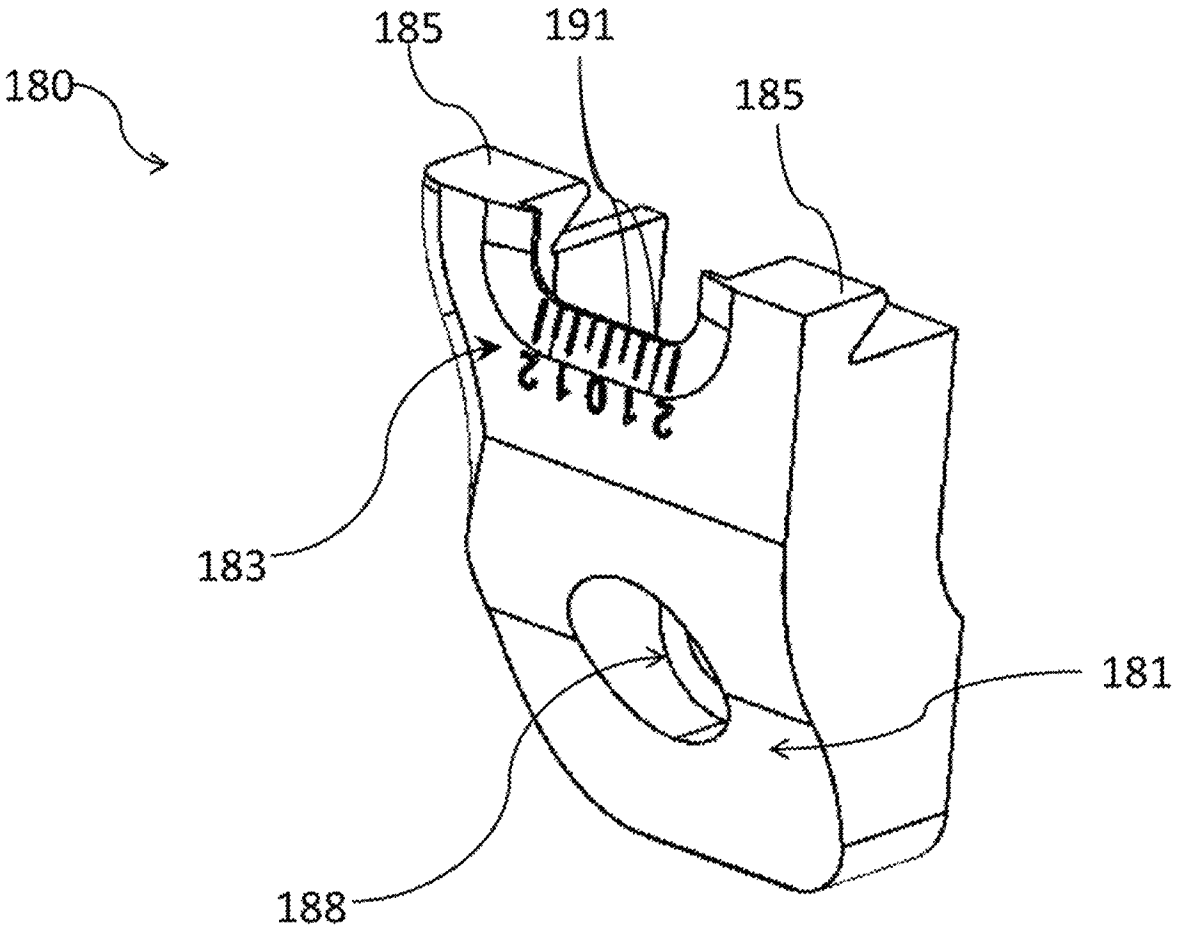
FIG. 27 is an isometric exterior view of an embodiment of a locking device of the archery riser mount of FIG. 17.
Figure 28:
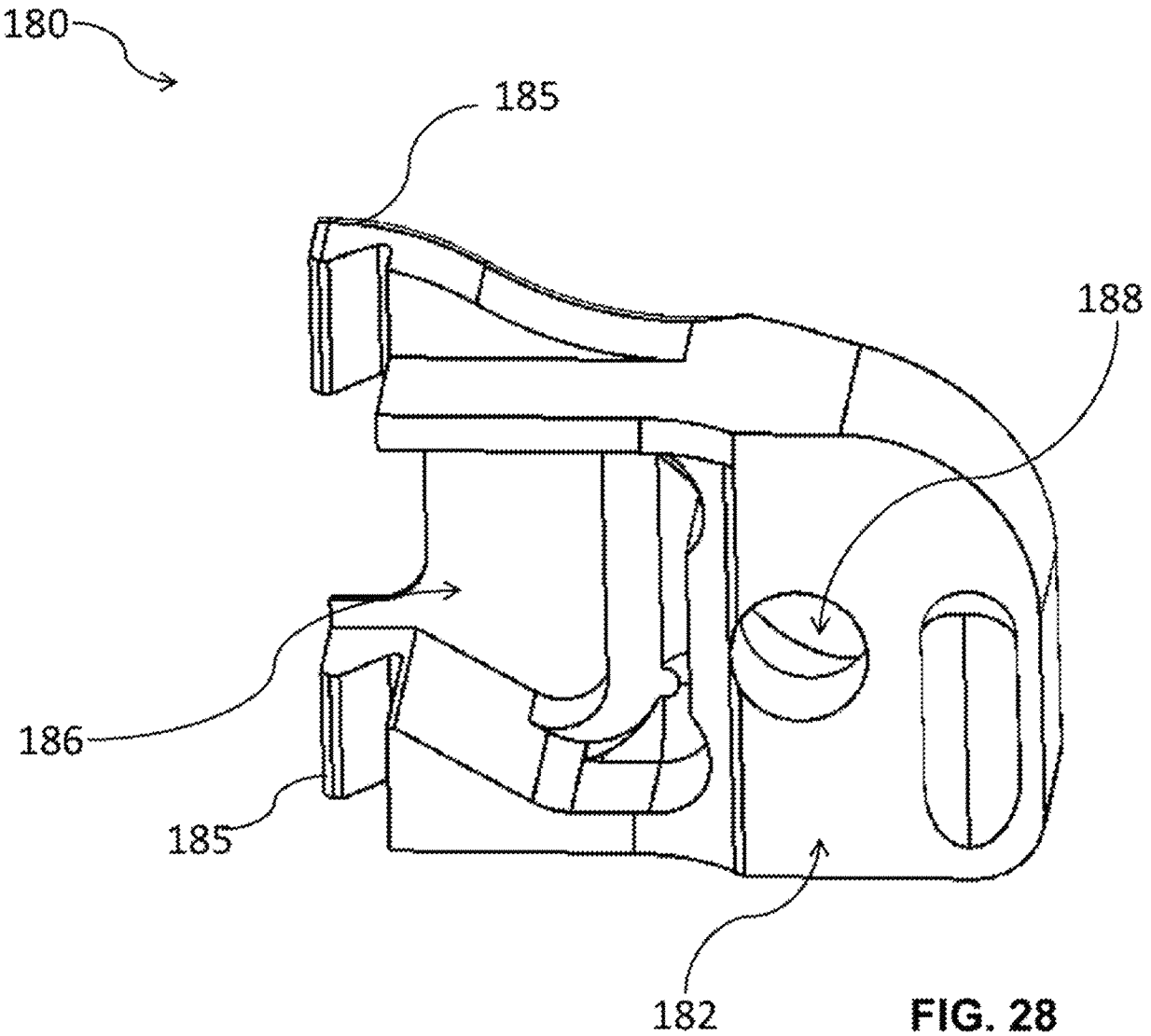
FIG. 28 is an isometric interior view of the embodiment of the locking device of FIG. 27.
Figure 29:
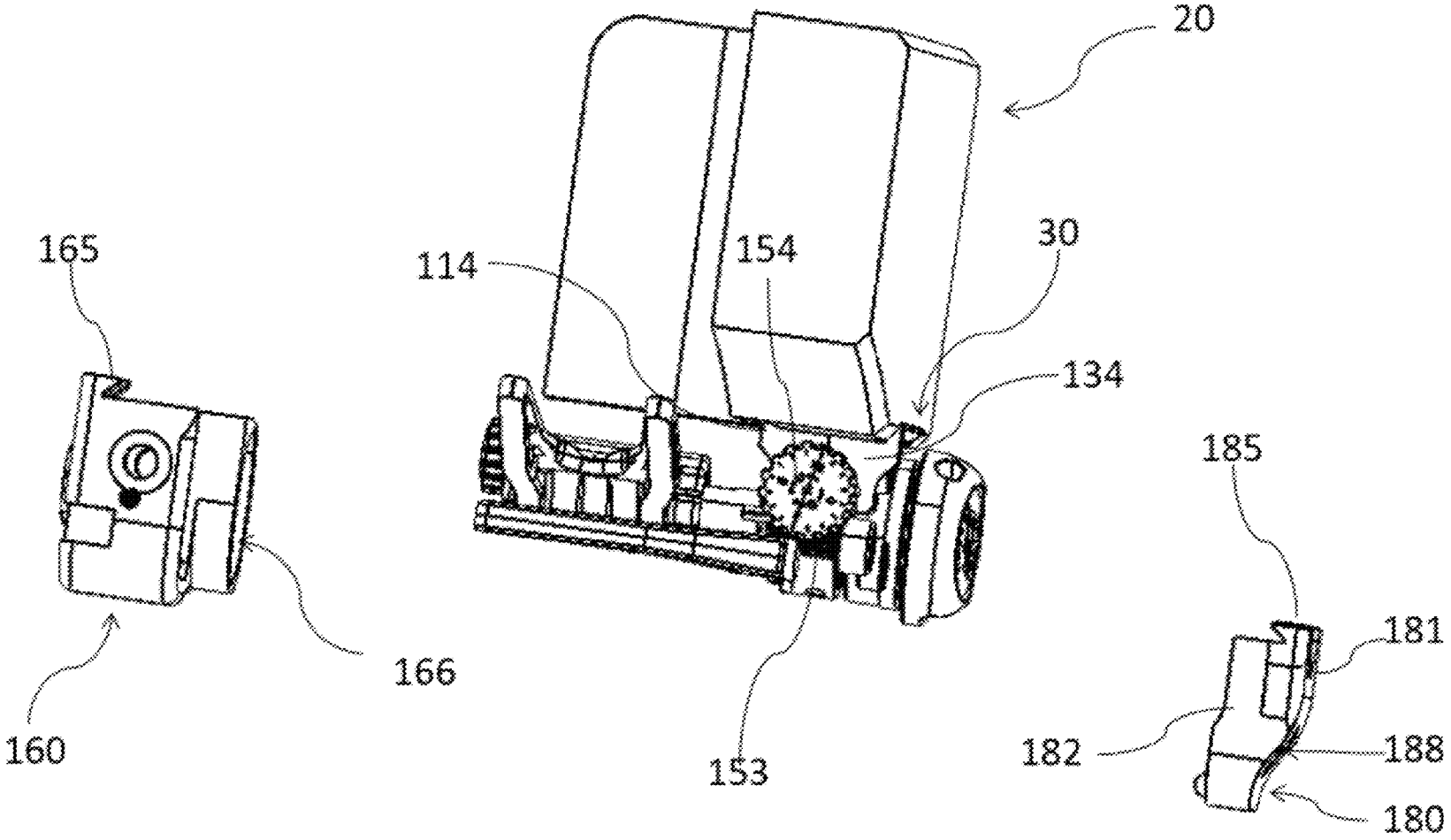
FIG. 29 is a top isometric view of the archery accessory of FIG. 15 with the housing and locking device exploded away from the archery accessory.

Referring to FIGS. 22 and 27-28, the archery riser mount 110 includes a locking device 180. The locking device 180 includes an outer surface 181 and an inner surface 182 and is configured to couple to the housing 160 and surround at least a portion of the positioning clamp assembly 112. The locking device 180 may further define one or more interior spaces or cavities 186 configured to house a portion of the positioning clamp assembly 112 and/or a portion of the accessory support 150. As shown in FIG. 22, the outer surface 181, opposed to one or more interior spaces or cavities 186 (FIG. 28), defines a locking bore 188. The locking bore 188 is configured to accept a locking fastener 190 (FIG. 30) in the locking mode to couple the locking device 180 to the housing 160 to lock the archery riser mount 110 in place on the archery riser 20.

Figure 30:
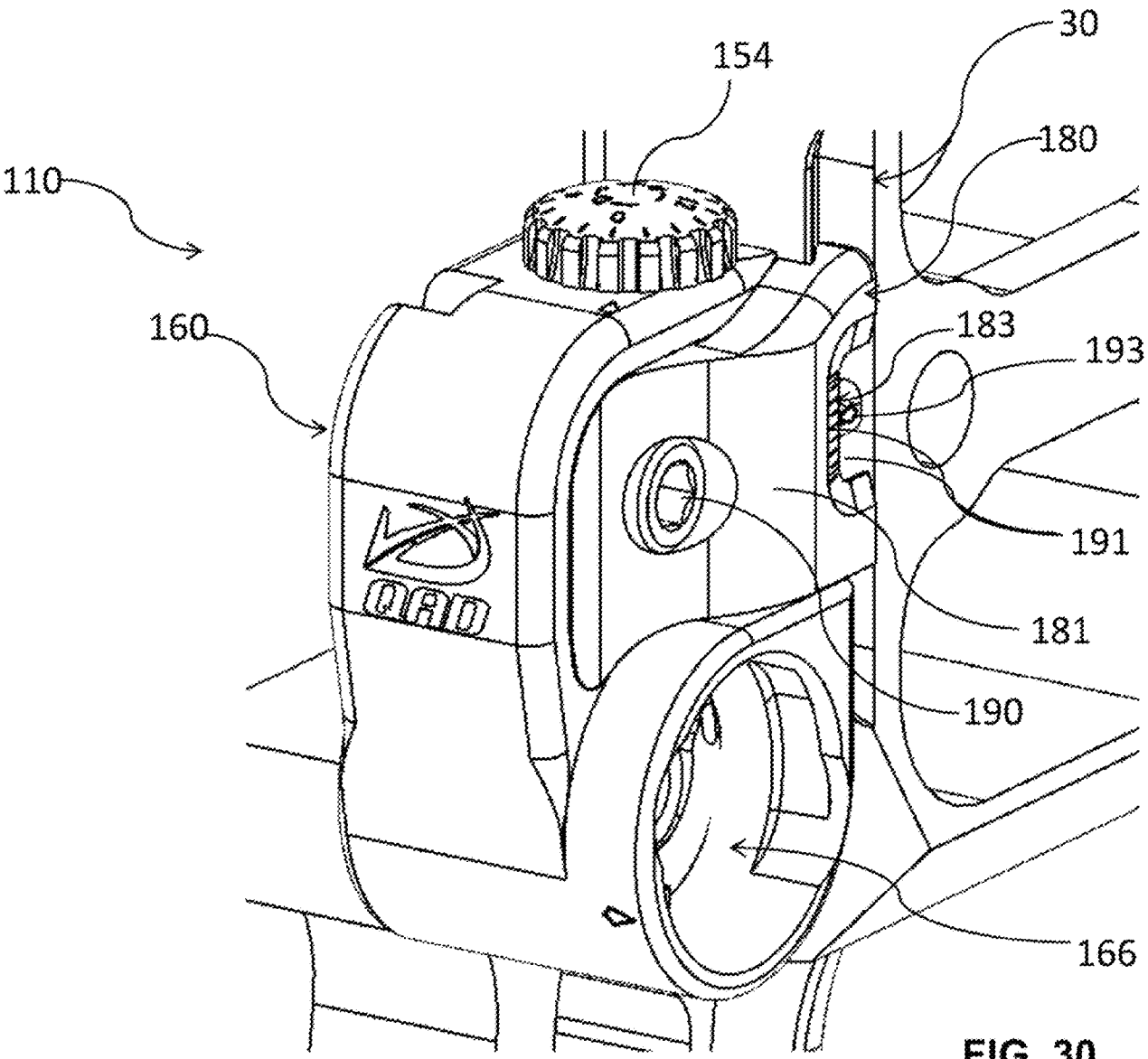
FIG. 30 is an isometric view of the housing of FIG. 25 coupled to the locking device and also engaging the mounting portion.
Figure 31:
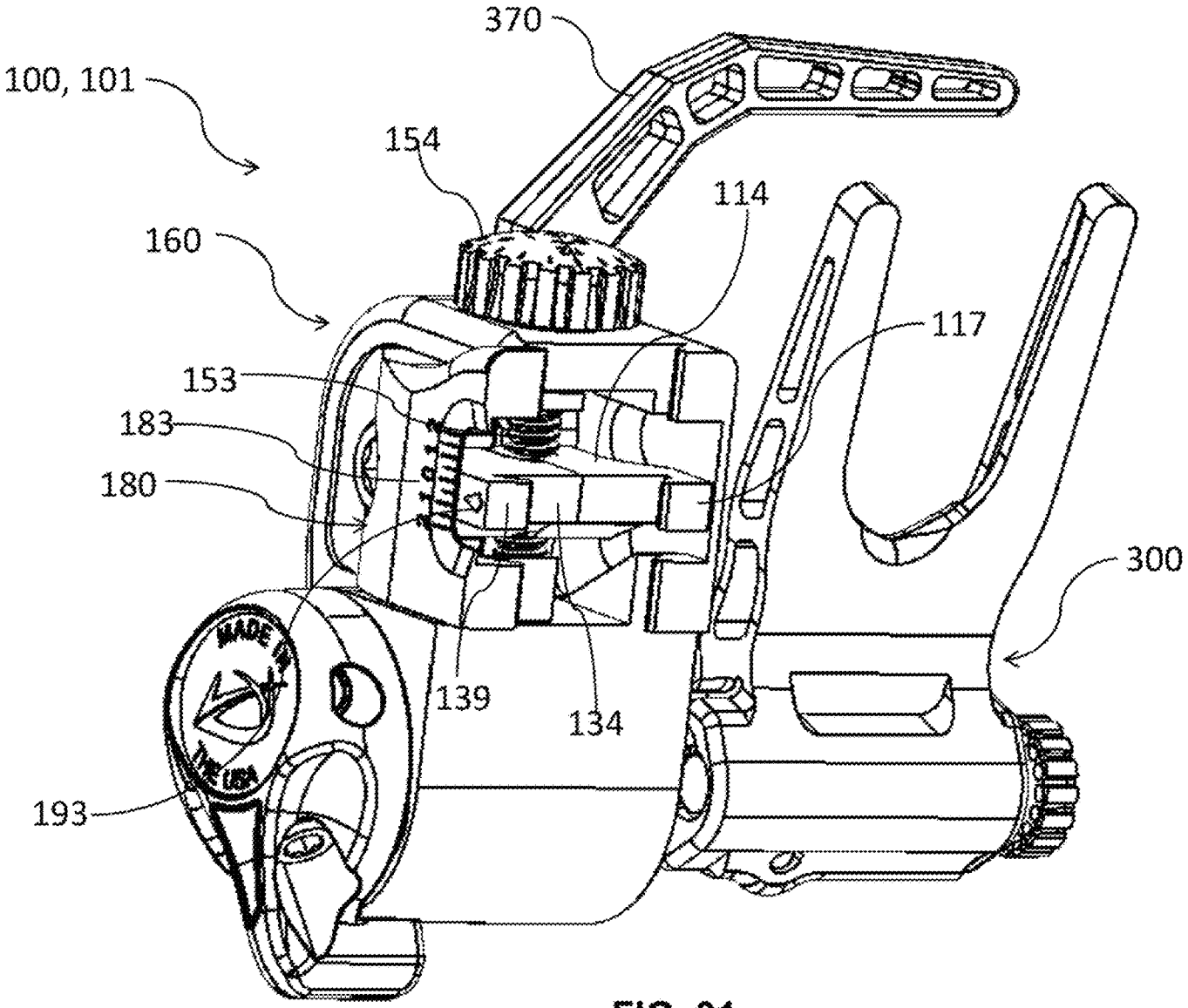
FIG. 31 is a front, isometric view of the arrow rest device of FIG. 23, illustrating the locking device and the positioning clamp assembly.

Referring to FIG. 27, the outer surface 181 further includes a locking device riser engager 185 that is configured to engage the first mount surface 34*b* and second mount surface 36*b* of mounting sub-portion 30*b* (FIG. 11) of the archery riser 20 in the positioning mode (FIG. 30). As shown in FIG. 27, the outer surface 181 of the locking device 180 defines a positioning window 183 that include a series of decals, etched or embossed markings or other adjustment measure markings 191 to aid in the repeatability of the vertical position adjustment of the archery riser mount 110. As illustrated in FIG. 30, when the user rotates the knob 154, the accessory support 150 moves vertically relative to the archery riser 20, and the user can stop the movement at a desired position where the clamp indicator 193 points at one of the measure markings 191.

Figure 32B:
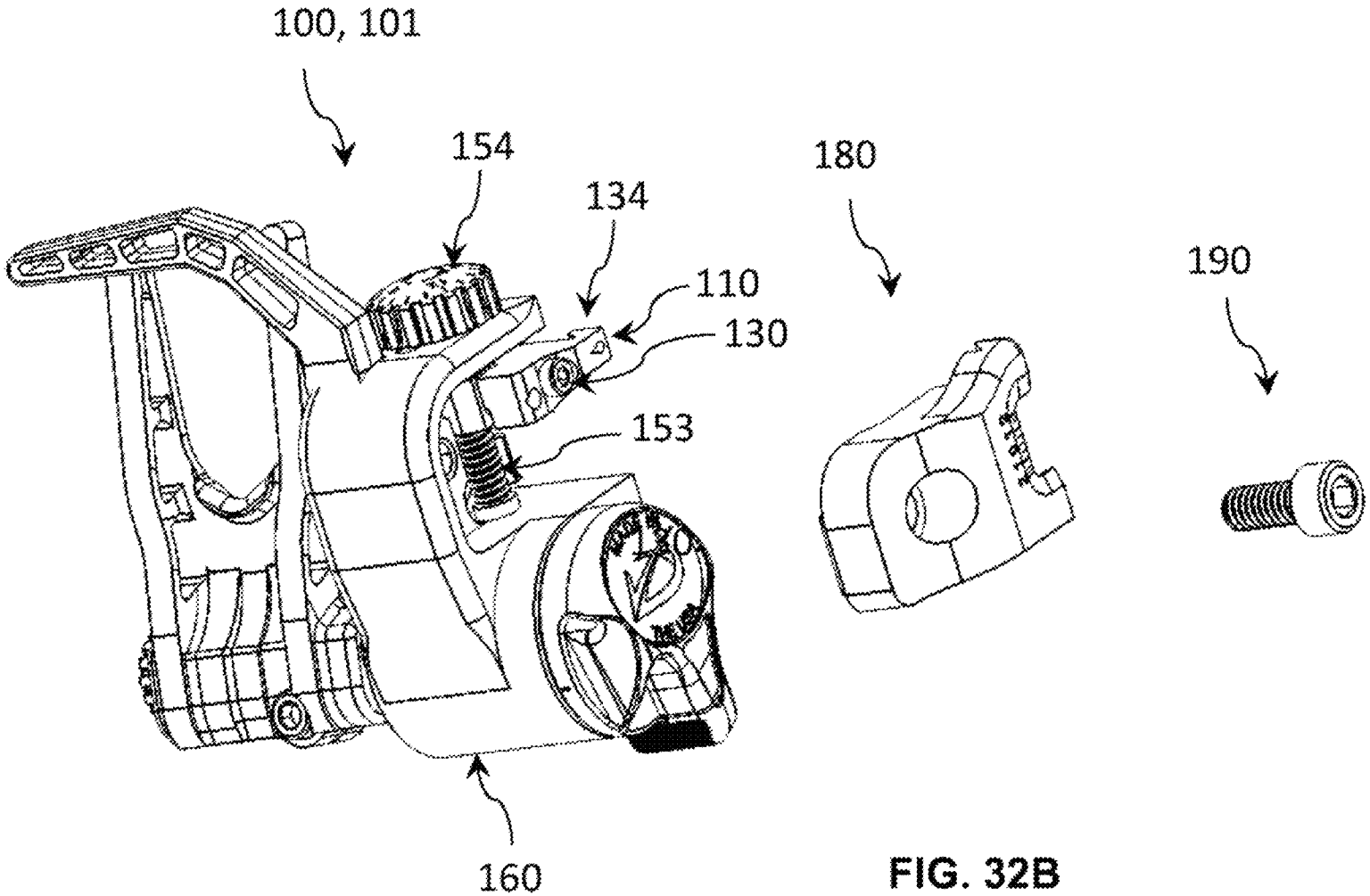
FIG. 32B is a rear isometric view of the arrow rest device of FIG. 23, illustrating the locking device exploded away.

Referring to FIGS. 17, 22 and 29-33, a user can install the archery riser mount 110 on the archery riser 20 through the following steps:

(a) A shown in FIG. 32B, the user removes the locking device 180 from the accessory 100/101 by fully unscrewing the locking fastener 190.

(b) At this point, the housing 160 and knob 154 remain coupled to the archery riser mount 110.

(c) In an adjustment mode, the user can loosen the positioning fastener 130 until the first and second clamp portions 114, 134 form a jaw size great enough to fit over the rearward facing surface 24 (FIG. 11).

(d) The user attaches the archery riser mount 110 (including clamp portions 114, 134) to the mounting portion 30 (FIG. 5) of the archery riser 20.

(e) The user partially tightens the positioning fastener 130.

(f) The user slides the archery riser mount 110 (including clamp portions 114, 134) upward or downward until reaching a desired, preliminary or initial vertical position on the archery riser 20. This initial position of the accessory 100/101 relative to the archery riser 20 may be preliminary, not necessarily, the final, fine-tuned position.

(g) The user fully tightens the positioning fastener 130, thereby generating an initial compression force on the archery riser 20.

(h) Next, the user rotates the knob 154 clockwise or counterclockwise to make a secondary adjustment-micro or fine tune adjustments of the vertical position of the accessory 100/101 relative to the archery riser 20.

(i) Once the use settles on a final vertical position, the user initiates the locking mode.

(j) In the locking mode, the user attaches the locking device 180 to the housing 160.

Figure 32C:
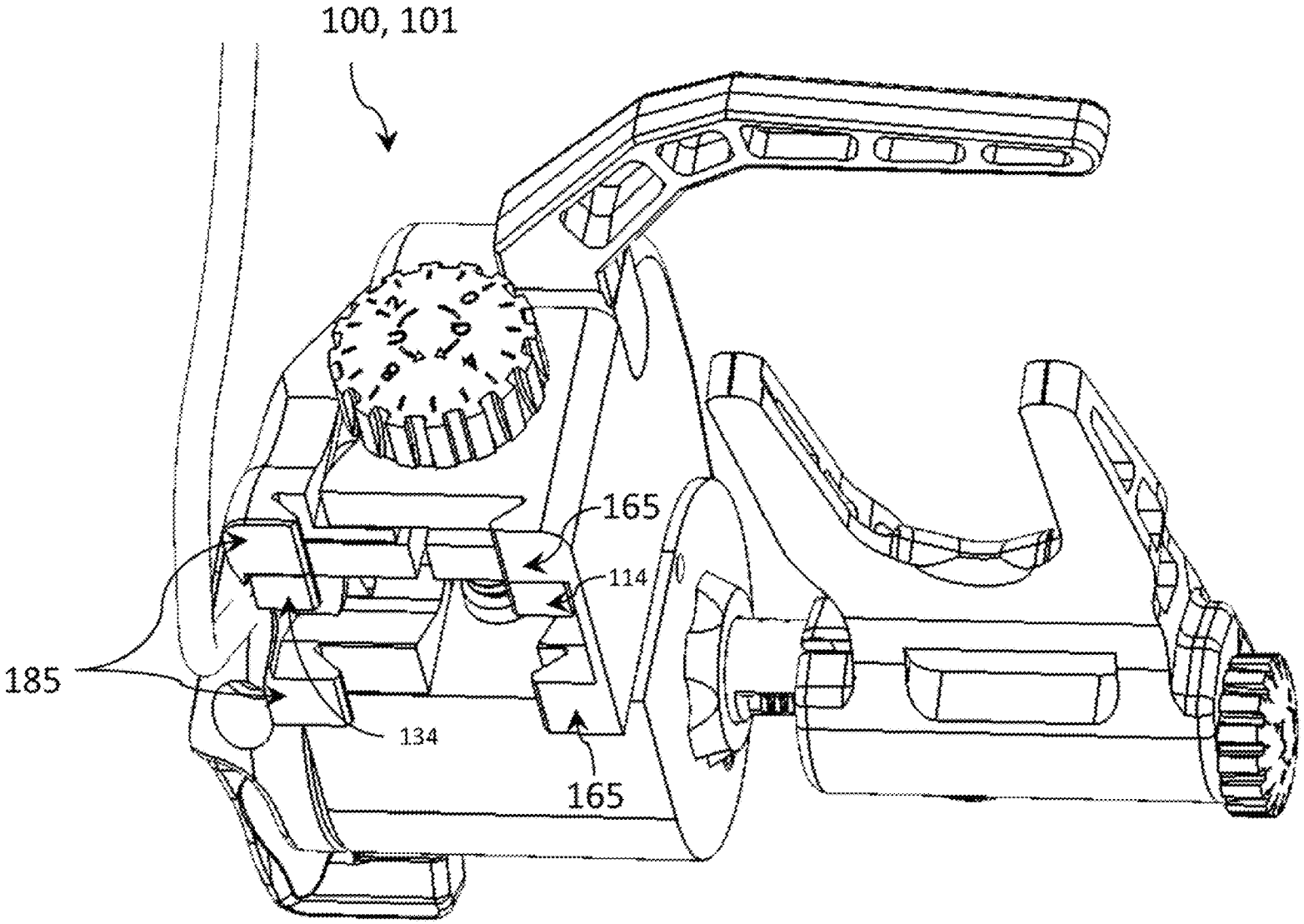
FIG. 32C is a top isometric view of the arrow rest device of FIG. 23, illustrating the housing riser engager and locking device riser engager.
Figure 33:
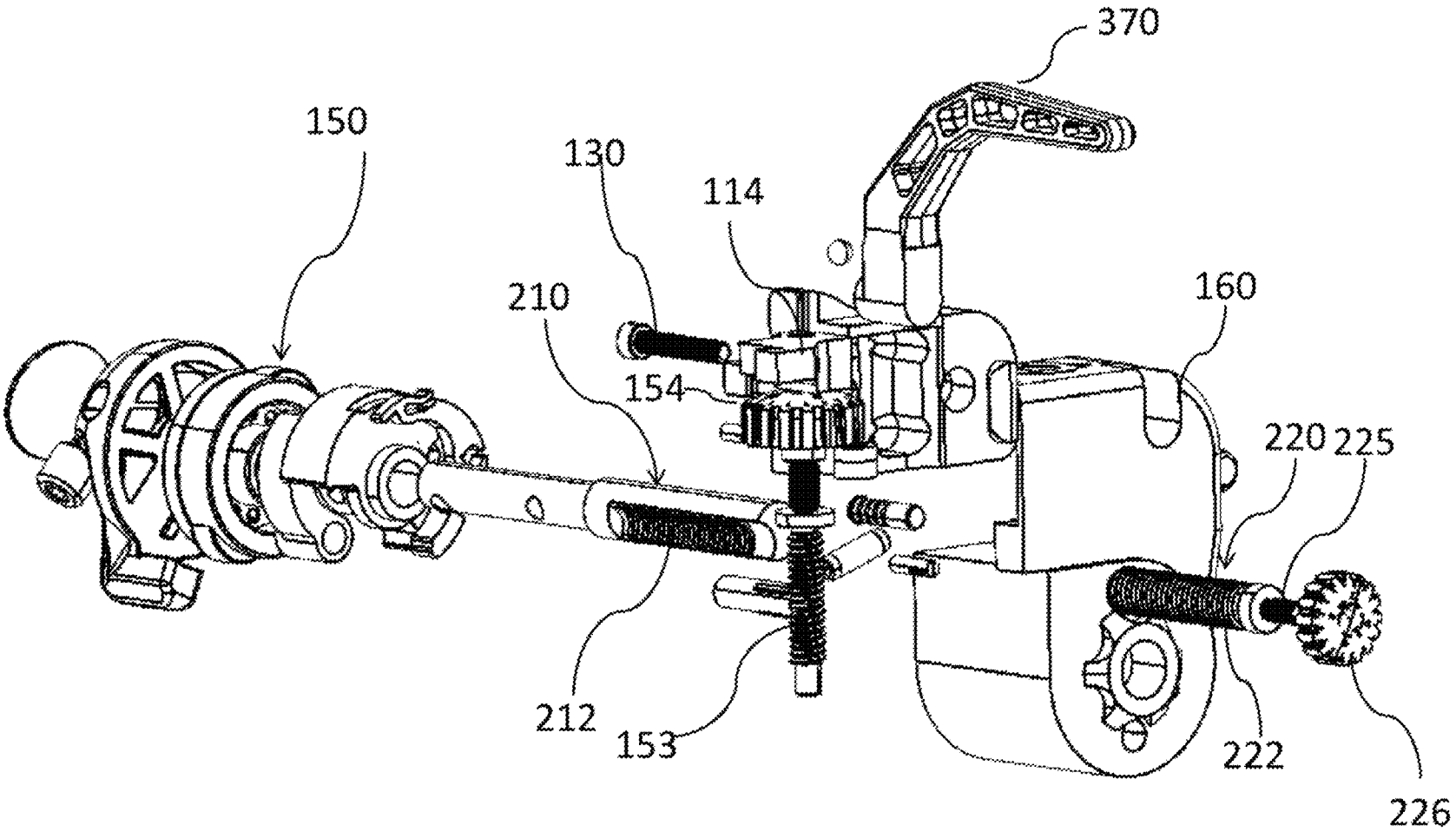
FIG. 33 is an exploded, isometric view of the arrow rest device of FIG. 23, illustrating an embodiment of the accessory support of FIG. 32A.
Figure 34:
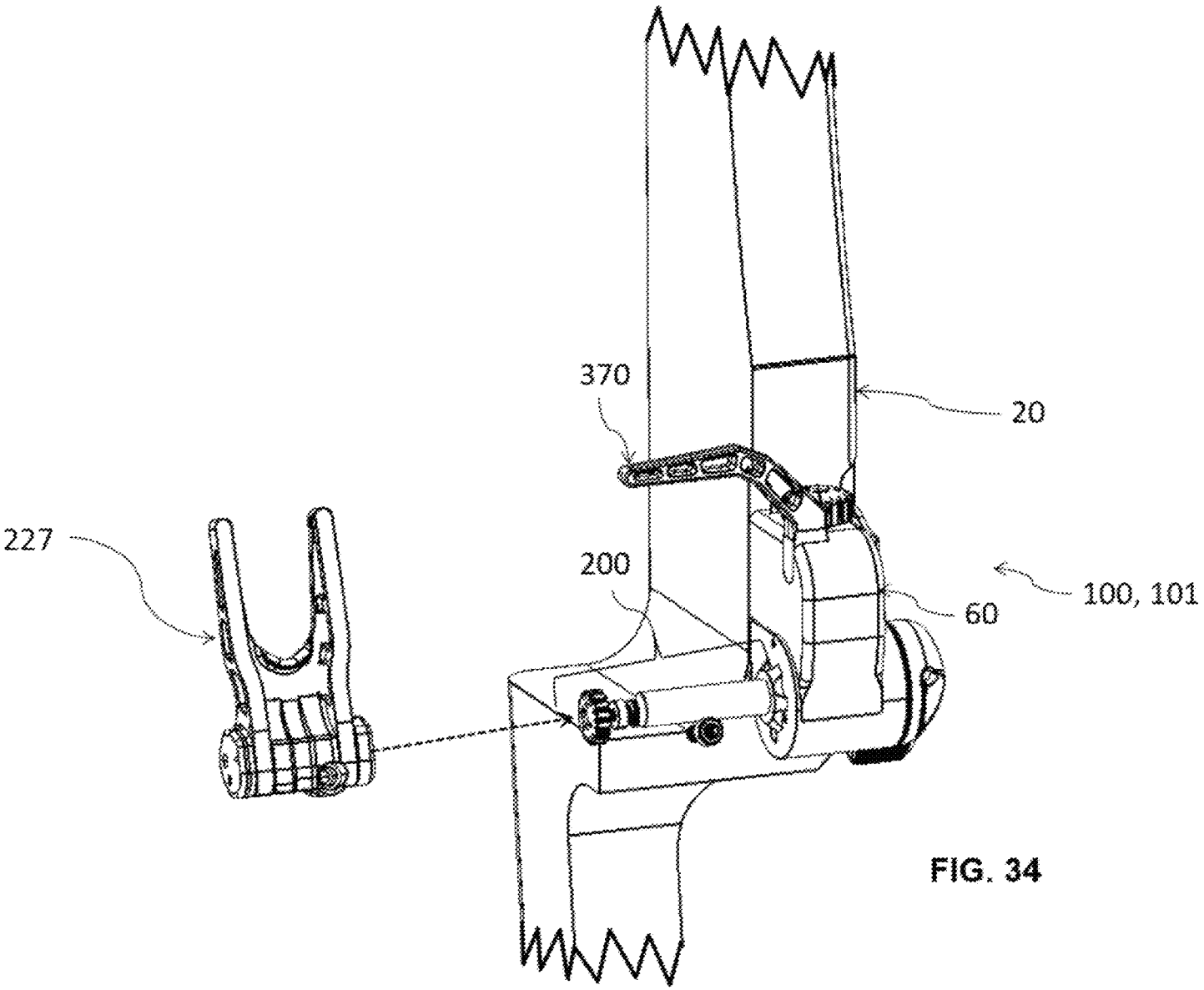
FIG. 34 is a rear isometric view of the arrow rest device of FIG. 23, illustrating an embodiment of an archery accessory adjustment assembly extending from the housing with a detached archery accessory element.
Figure 35:
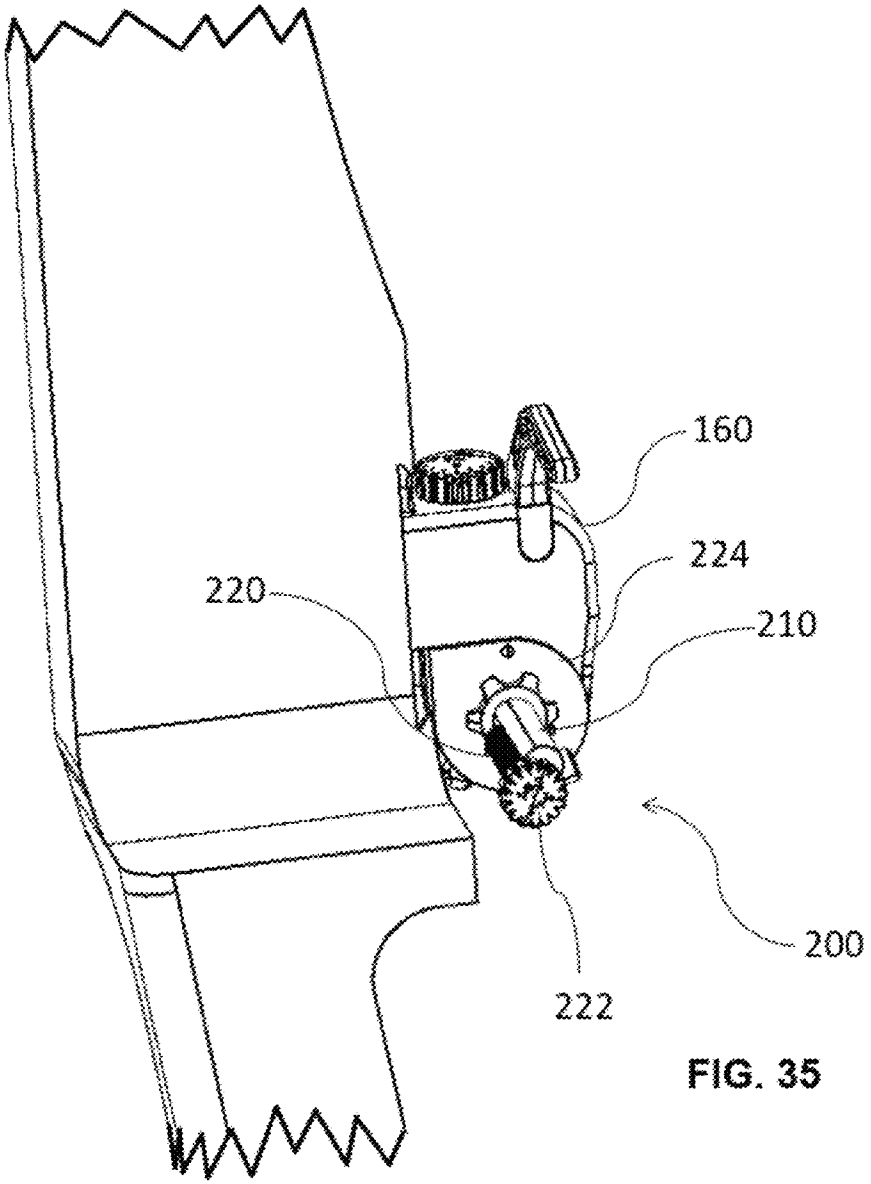
FIG. 35 is a right side isometric view of the archery accessory adjustment assembly of FIG. 34 without the archery accessory element.

(k) The user screws the locking fastener 190 to tighten the locking device 180 onto the housing 160, which generates a final compression force on the archery riser 20, which is greater than the initial compression force. As illustrated in FIG. 32C, during this tightening process, the locking device riser engager 185 engages the first and second mount surfaces 34*b*, 36*b* of mounting sub-portion 30*b* (FIG. 11), and the housing riser engager 165 engages the first and second mount surfaces 34*a*, 36*a* of mounting sub-portion 30*a* (FIG. 11). As shown in FIGS. 21 and 32C, in this configuration, the locking device riser engager 185 surrounds the clamp portion 134. Likewise, the housing riser engager 165 surrounds the first clamp portion 114.

(l) Referring to FIG. 22, the vertical adjuster 153 is immobilized because the knob 154 and stopper 157 are fixedly connected to the vertical adjuster 153, and the housing top 161 is trapped between (and engaged with) the stopper 157 and knob 154.

(m) Since the housing 160 is locked in position relative to the archery riser 20, the vertical adjuster 153 is also locked in position relative to the archery riser 20, preventing or inhibiting any unintentional movement of the vertical adjuster 153, such as forces caused by inadvertent contact between the knob 154 and people or the environment.

Archery Accessory Adjustment Assembly

Referring to FIGS. 34-39, an archery accessory adjustment assembly 200 is configured to allow adjustment of an archery accessory element 227 of an archery accessory 100 in relation to the housing 160, accessory support 150 (FIG. 20) or archery riser mount 110 (FIG. 22). It should be appreciated that the accessory adjustment assembly 200 may be coupled to any support, accessory or archery mount X, as illustrated in FIG. 36B.

Figure 36A:
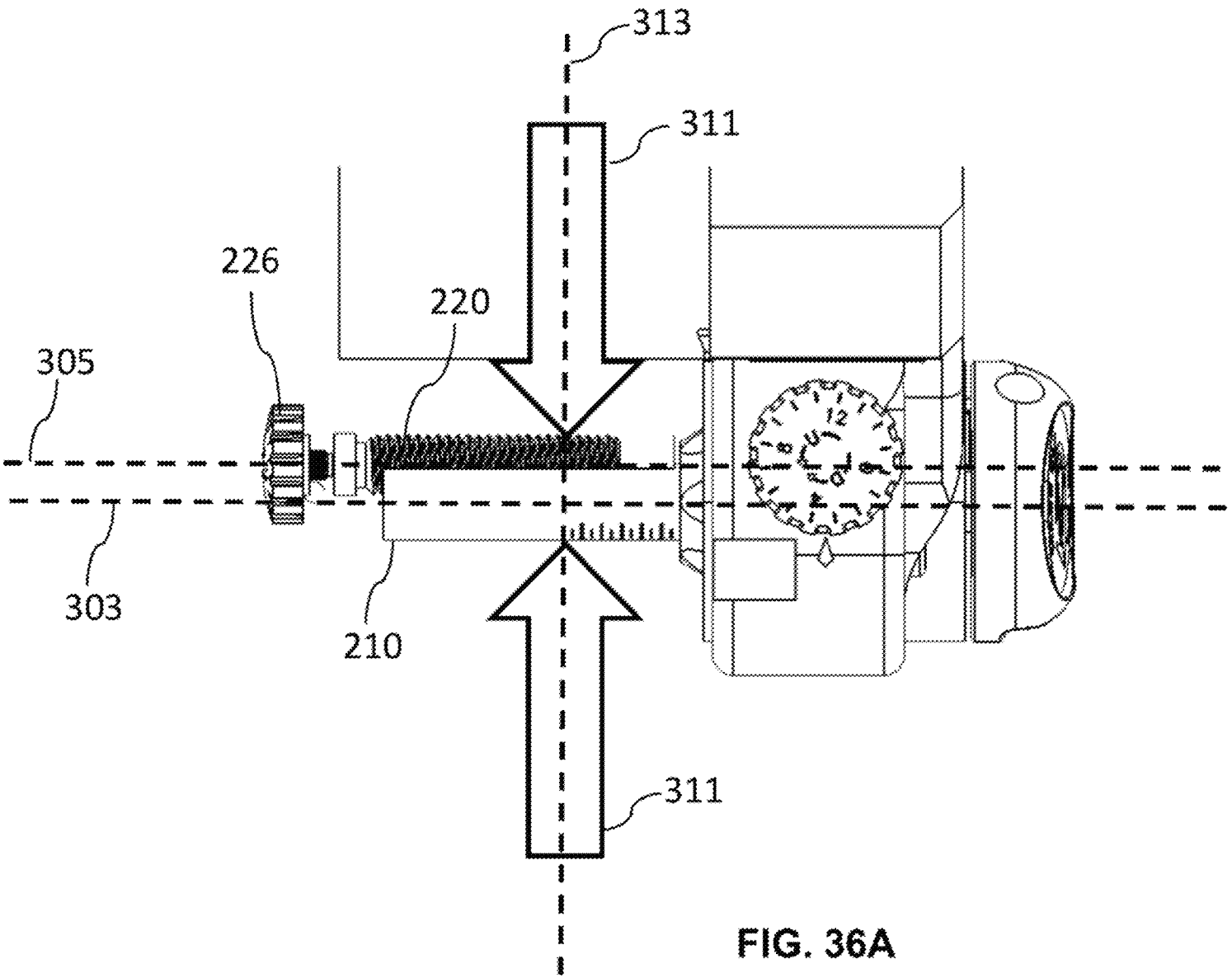
FIG. 36A is a top view of the archery accessory adjustment assembly of FIG. 35.
Figure 37:
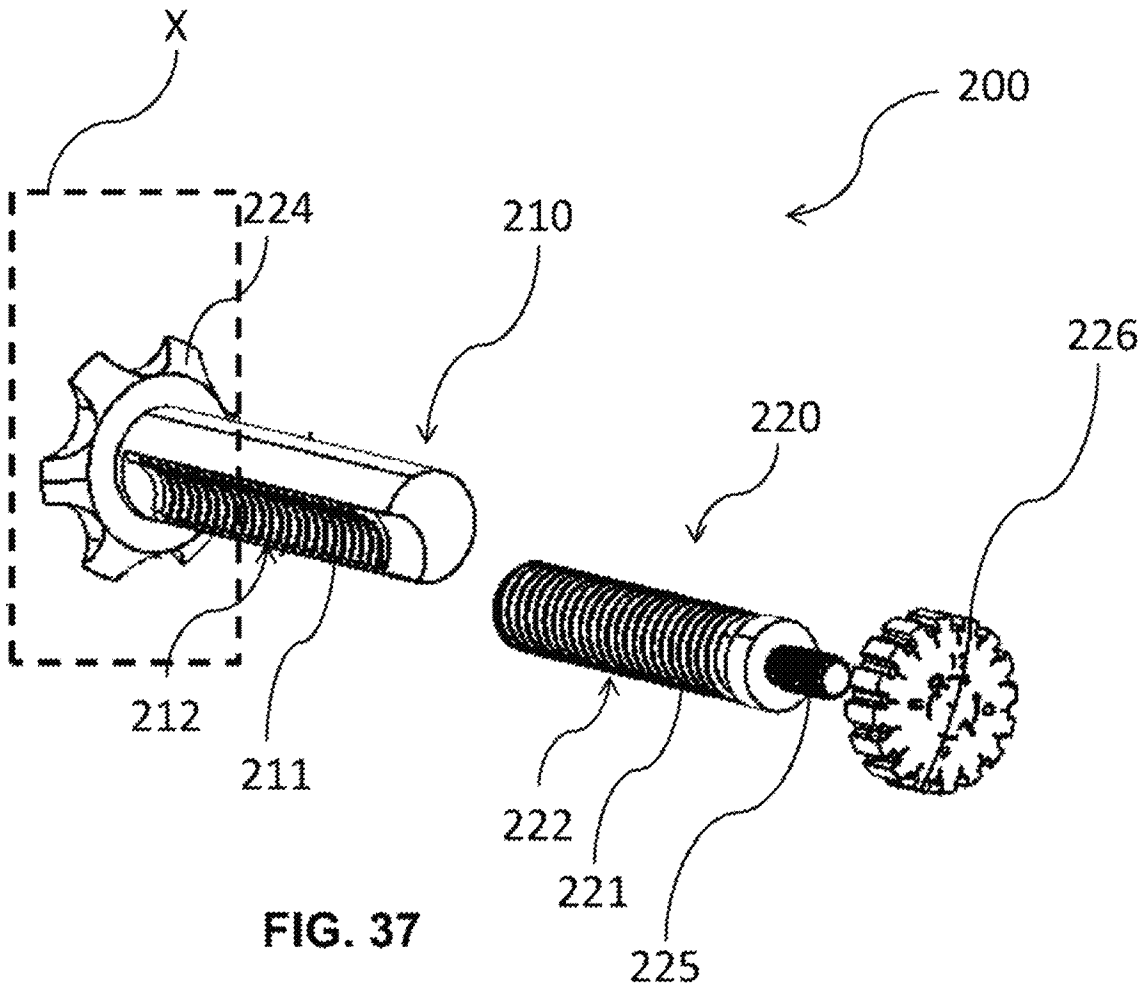
FIG. 37 is an exploded, isometric view of the embodiment of archery accessory adjustment assembly of FIG. 36B.
Figure 38:
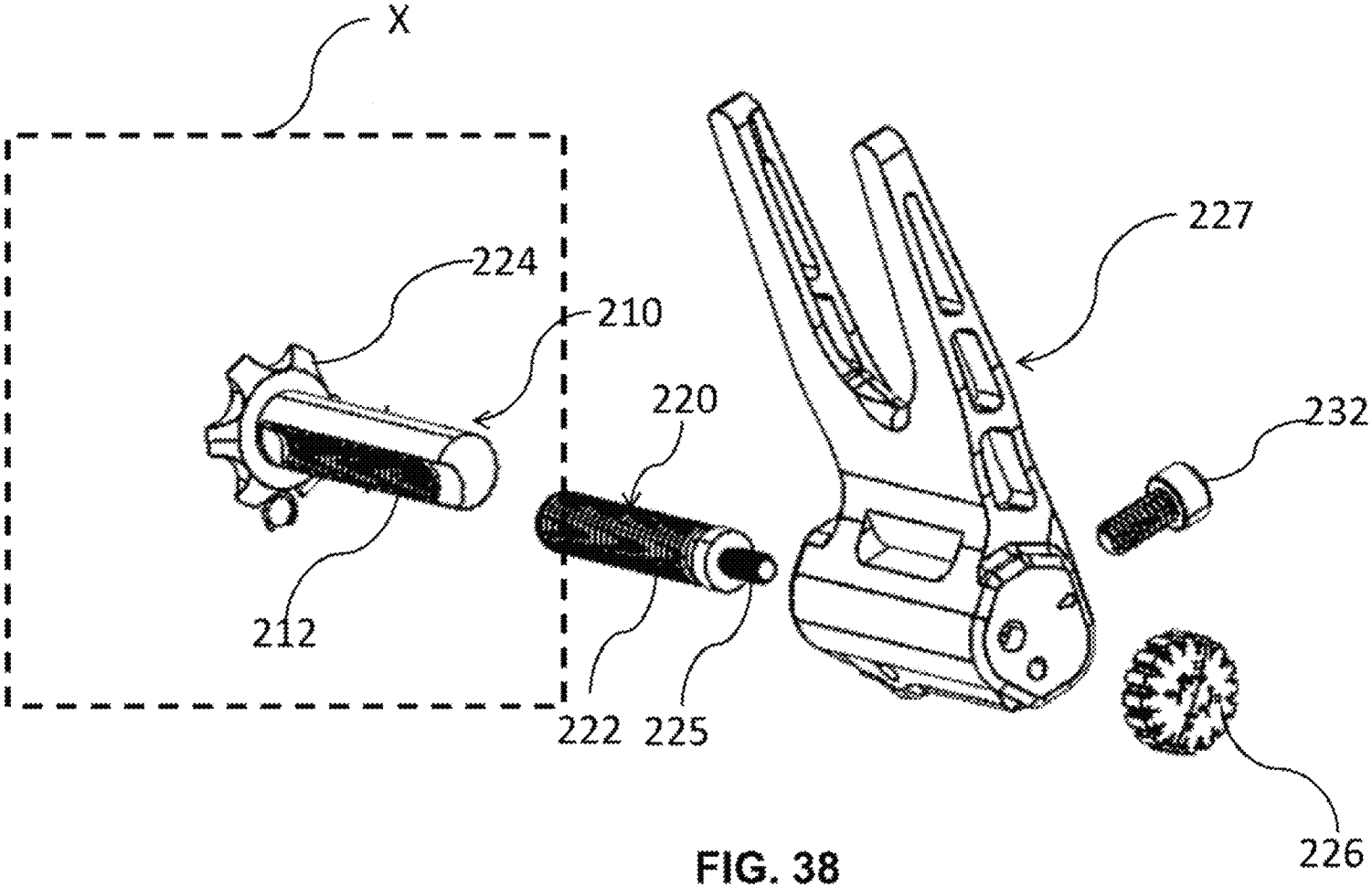
FIG. 38 is an exploded, isometric view of the embodiment of the archery accessory adjustment assembly of FIG. 37 and the archery accessory element from FIG. 34.

In an embodiment, the archery accessory adjustment assembly 200 generally includes a first extension 210 that is coupled at one end to an archery mount 224 and extends along a first extension plane 303 (FIG. 36A). As shown in FIGS. 37 and 38, the first extension 210 further includes a first drive interface 212 that, in an embodiment, includes a first threaded area 211. In an embodiment, the first extension 210 and the archery mount X are formed as a single integrated unit. In another embodiment, the first extension 210 is separate from, but connected to, the archery mount X using any suitable fastener or securement method.

A second extension 220 extends along a second extension plane 305 and is configured to couple to a knob 226 or handle at one end via a coupling stem 225. The coupling stem 225 of the second extension 220 is configured to protrude from the end of the archery accessory to receive a portion of the adjustment knob 226, insert into a portion of the adjustment knob 226 or otherwise couple to the adjustment knob 226. In an embodiment, the adjustment knob 226 is press-fit, screwed onto or fixedly attached to the coupling stem 225. As a result, the twisting of the adjustment knob 226 causes the rotation of the second extension 220.

Figure 36B:
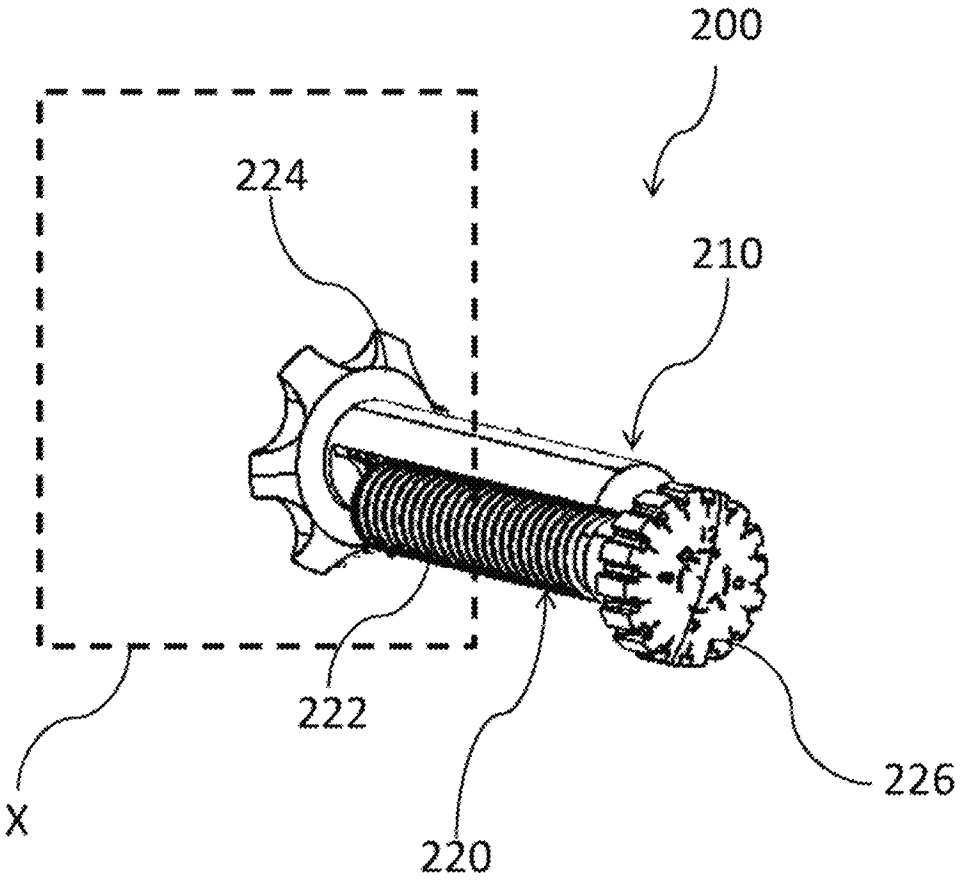
FIG. 36B is an enlarged, isometric view of the archery accessory adjustment assembly of FIG. 35.

The second extension 220 further includes a second drive interface 222 that includes, in an embodiment, a second threaded area 221. Referring to FIG. 36B, the adjustment knob 226 and the second drive interface 222 may be formed as separate components that are coupled together during assembly of the archery accessory adjustment assembly 200. In another embodiment, the components of the second extension 220 and adjustment knob 226 may be formed as a single integrated unit. As shown in FIG. 37, the first threaded area 211 of the first drive interface 212 and the second threaded area 221 of the second drive interface 222 are configured to mate or threadably interact with each other when the archery adjustment assembly 200 is in the assembled state as shown in FIG. 36B.

In an embodiment, the second drive interface 222 is rounded and substantially cylindrical in shape, and the first drive interface 212 has a substantially cylindrical shape having an arc-shaped, concave surface configured to partially receive the second drive interface 222. Referring to FIG. 39, in order to assemble the archery adjustment accessory 200, the second extension 220 is positioned against the first extension 210 such that the first drive interface 212 contacts the second drive interface 222. The archery accessory element 227, such as an arrow rest device (or portion thereof), sandwiches the first and second extensions 210, 220.

As shown, the first and second drive interfaces 212, 222 threadably engage with each other such that rotation of the adjustment knob 226 causes the second drive interface 222 to rotate about a longitudinal axis of the second extension 220 and move relative to the first extension 210 along the first drive interface 212. Movement of the second extension 220 along the first drive interface 212 results in movement of the archery accessory element 227 relative to the first extension 210 along an axis that is parallel to the longitudinal axis of the first extension 210. Likewise, movement of the second extension 220 along the first drive interface 212 also results in movement of the archery accessory element 227 towards or away from the archery riser 20.

Figure 39B:
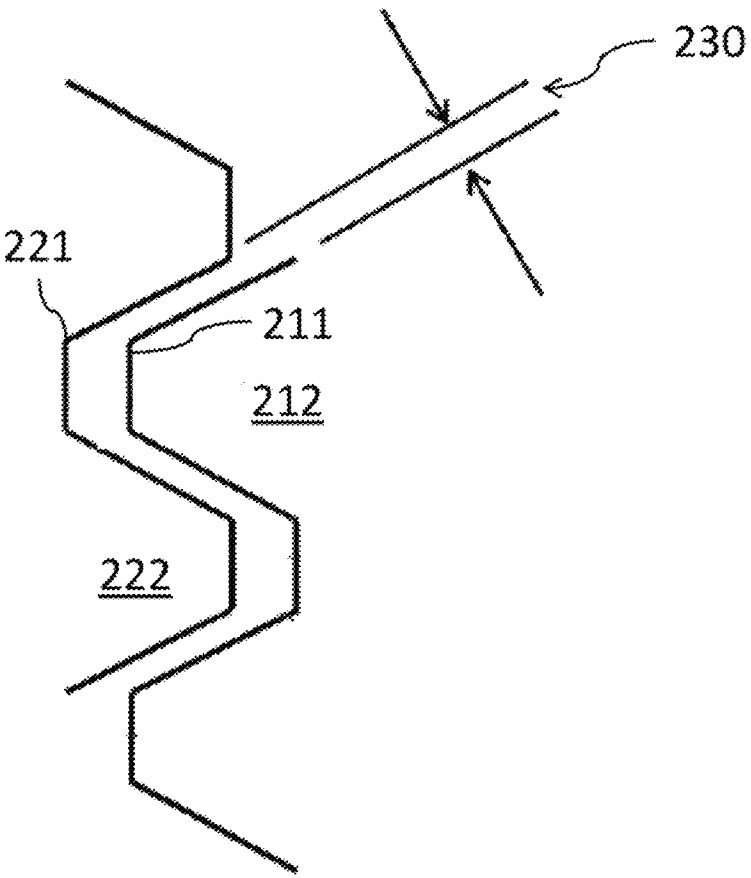
FIG. 39B is an enlarged schematic view of a gap formed between the first and second extensions of the archery accessory element from FIG. 34.
Figure 39A:
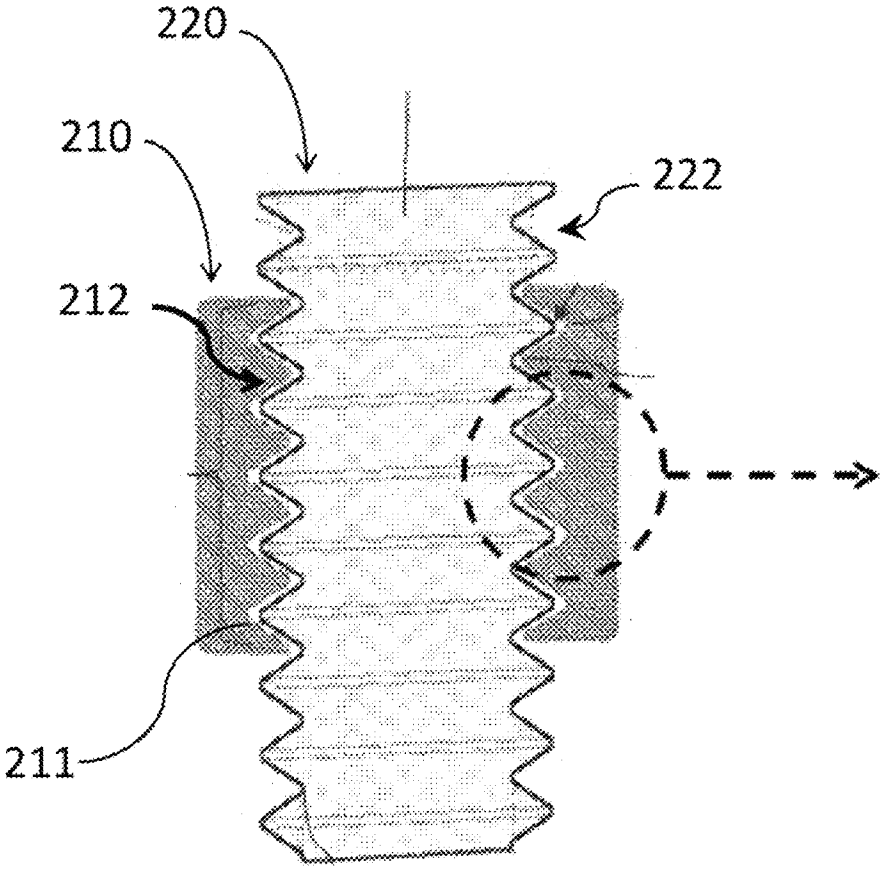
FIG. 39A is a schematic view of an interaction between embodiments of the first and second extensions of the archery accessory element from FIG. 34.

Referring to FIG. 39B, the engagement of the first threaded area 211 of the first drive interface 212 with the second threaded area 221 of the second drive interface 222 results in a gap 230. This gap 230 causes or enables an additional movement between the first extension 210 and the second extension 220 after the positon of the second extension 220 relative to the first extension 210 has been set by the adjustment knob 226. This additional movement, referred to as slop or play, is undesirable. This undesirable movement can be increased as the result of imperfections in manufacturing tolerances of the first threaded area 211 of the first drive interface 212 and the second threaded area 221 of the second drive interface 222. The slop in the threads can lead to inaccuracies, errors and imprecisions during the adjustment and use of the archery accessory element 227.

In a securement mode, an accessory securement member 232 (FIG. 38) is configured to decrease or eliminate slop between the first drive interface 212 and the second drive interface 222. Referring to FIGS. 39-41 and 49, the archery accessory element 227 may have a base 314 that includes a plurality of spaced-apart element portions 307, 309 (FIG. 49) that define or entrap a cavity or passageway 318. The archery accessory element 227 further defines an archery accessory opening 331 (FIG. 49) configured to accept the accessory securement member 232. A user can install the archery accessory element 227 onto the first and second extensions 210, 220 by sliding the first and second extensions 210, 220 through the passageway 318. Then, the user can rotate and tighten the accessory securement member 232 until the element portions 307, 309 are firmly compressed onto the first and second extensions 210, 220.

During the compression process, the diameter of the passageway 318 is gradually decreased. The element portions 307, 309 exert or apply a securing force 311 (FIG. 36A) that compresses the element portions 307, 309 onto the first and second extensions 210, 220. The securing force 311 acts along a force direction or force axis 313 that intersects with at least (or, as in the embodiment shown) each of the extension plans 303, 305. This securing force 311 acts to decrease or eliminate the gap 230 (FIG. 39B) between the first drive interface 212 and the second drive interface 222, thereby reducing or eliminating slop and securing the second extension 220 in position relative to the first extension 210 in a secured state. While in the securement mode, the first extension 210 is, therefore, fixedly secured to the second extension 220 despite separation forces caused by contact with users, the environment and shooting vibrations. In one embodiment, in this secured state, the threaded areas 211, 221 are in direct, physical contact with each other with no gap 230 between them. In another embodiment, in this secured state, the threaded areas 211, 221 are in direct, physical contact with each other with a minimal or reduced gap 230 between them. The elimination or reduction of thread slop improves the adjustment control of the user by providing increased, mechanical responsiveness to the fine tune adjustments performed by the user's incremental rotation of the adjustment knob 226.

Projectile Support Device

Figure 40:
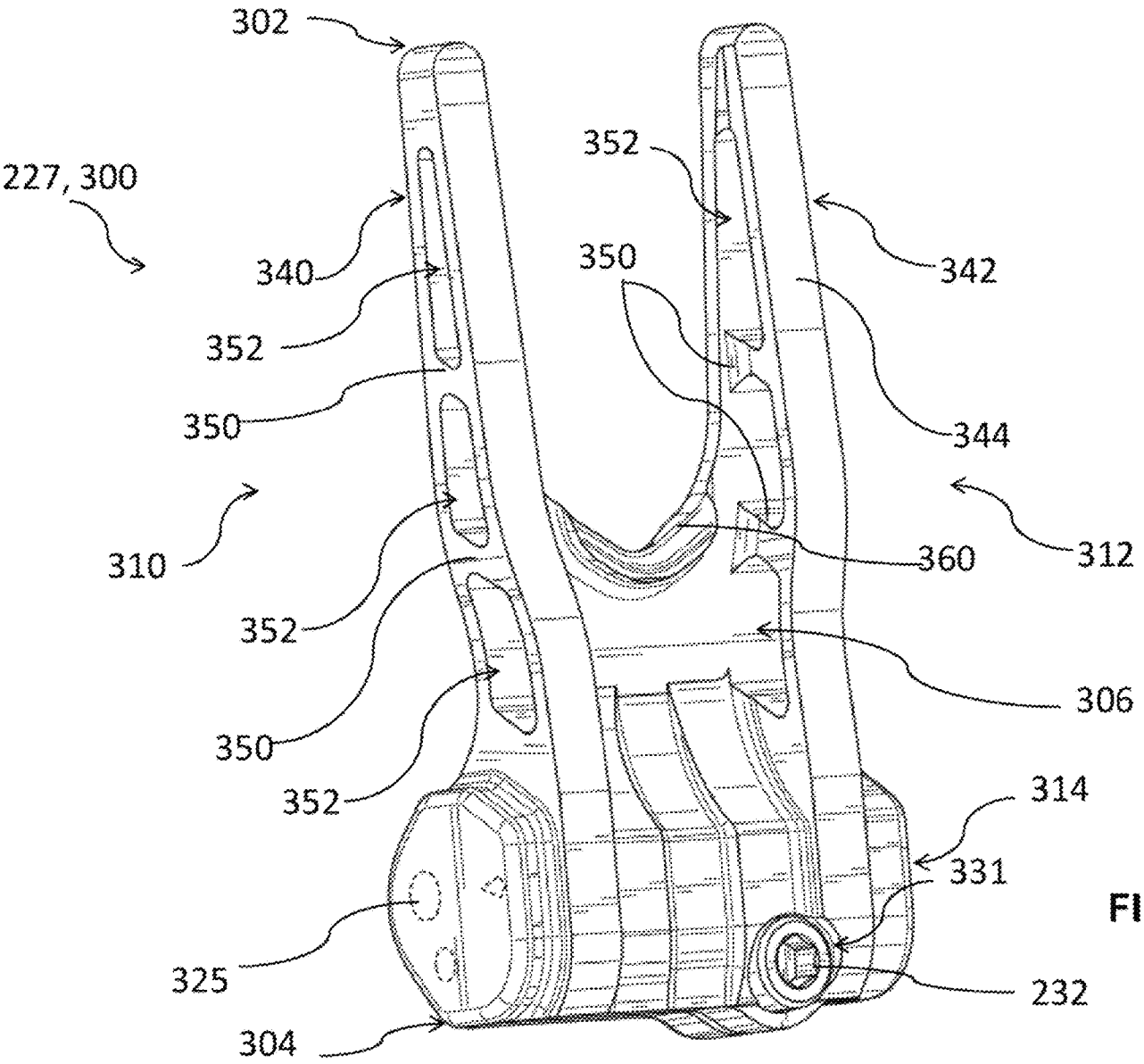
FIG. 40 is a rear, left isometric view of an embodiment of an archery accessory element that is a projectile support device.
Figure 41:
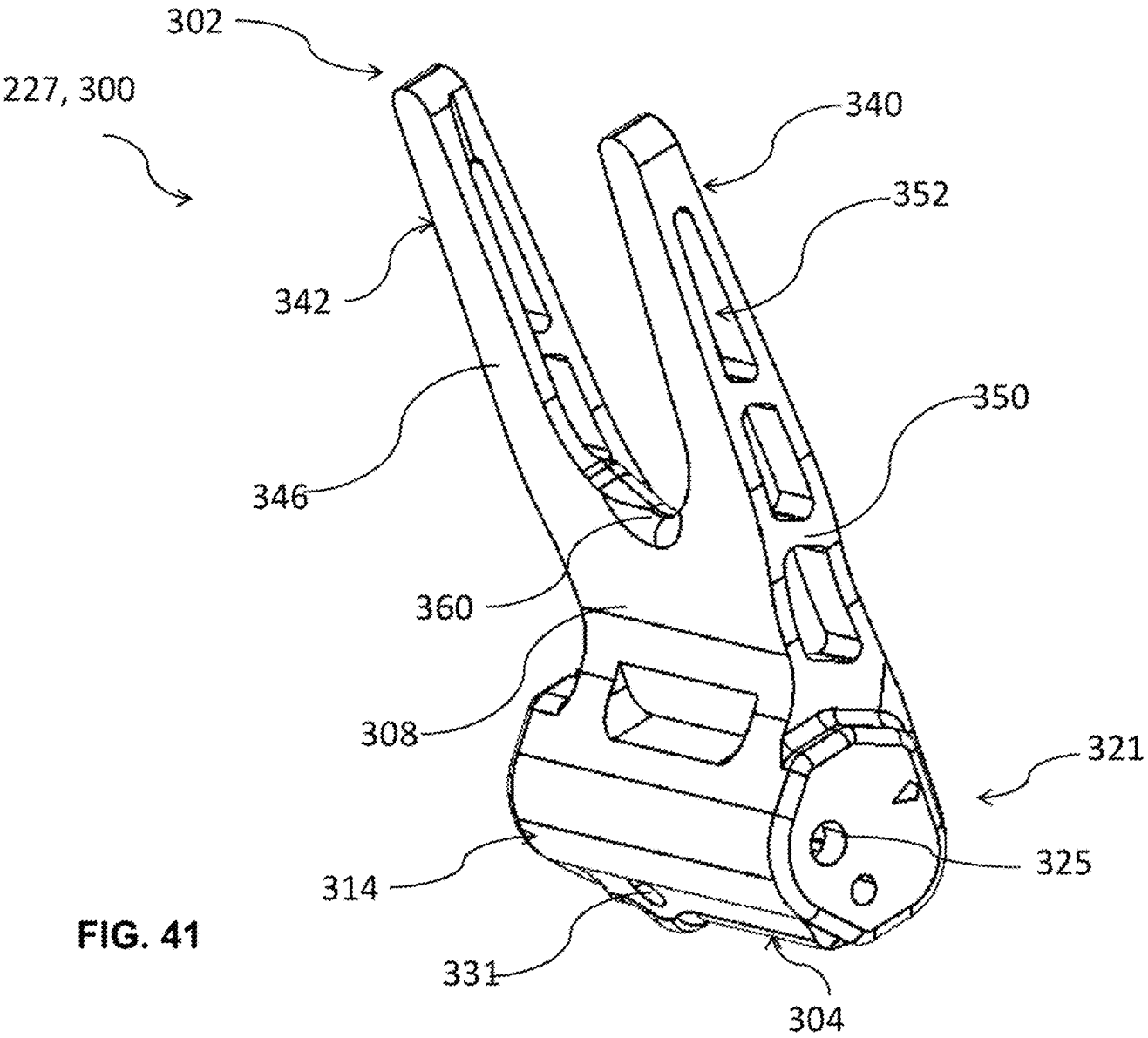
FIG. 41 is a front, left isometric view of the projectile support device of FIG. 40.
Figure 42:
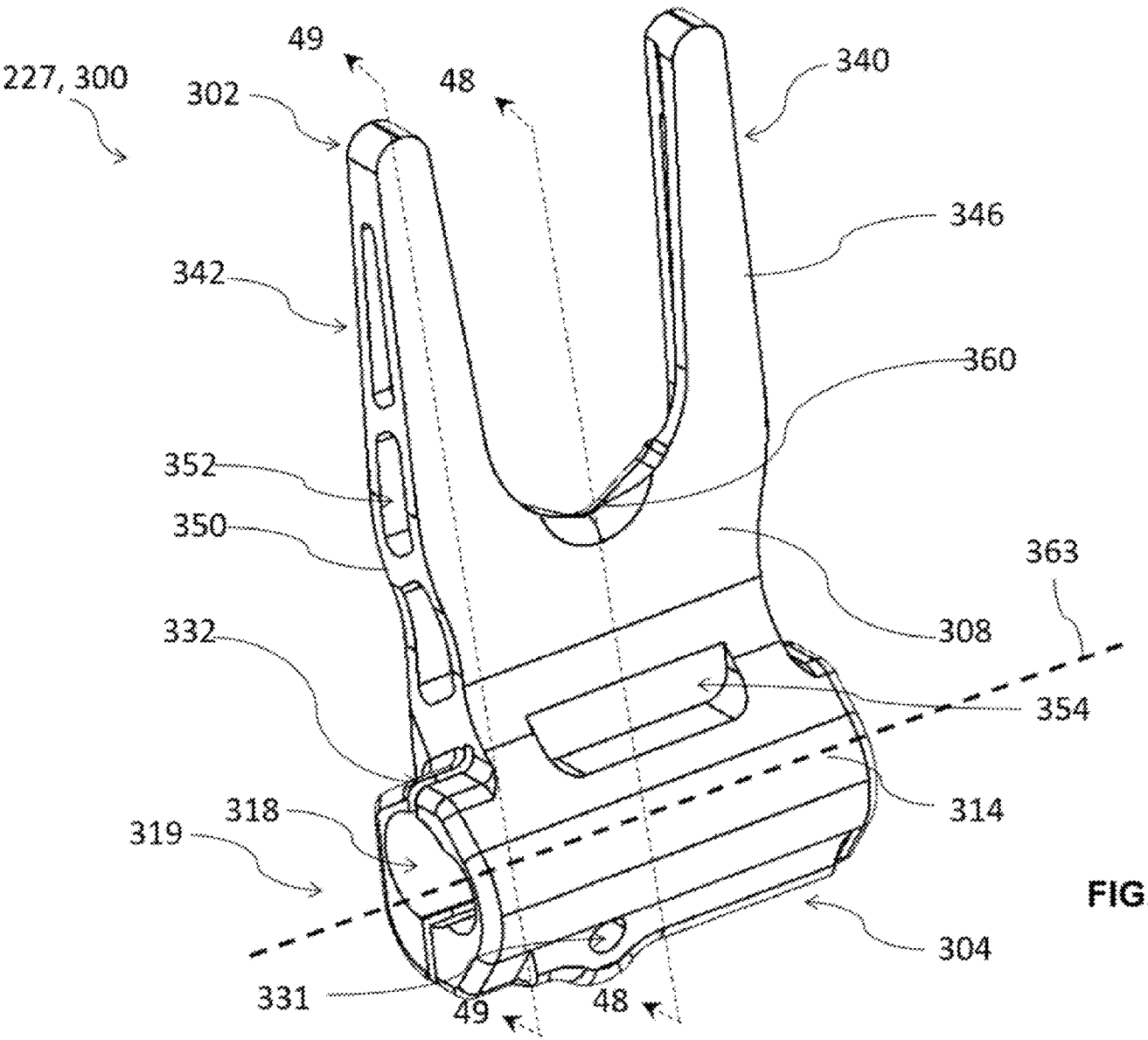
FIG. 42 is a front isometric view of the projectile support device of FIG. 40.

Referring now to FIGS. 40-49, an archery projectile support device 300 can include two halves that are connected together or can include multiple spaced-apart portions that are joined or integrated at one or more ends. The latter embodiment is illustrated in FIGS. 40-49 and is described below. In an embodiment, the projectile support device 300 includes a top end 302, a bottom end 304, a front 306 configured to face toward a target T (FIG. 3), a rear 308 configured to face in a direction opposite of the target T, and left and right sides 310, 312, respectively. A base 314 is located proximate the bottom end 304 and defines the passageway 318 (FIG. 48A) that extends at least partially through the base 314 between the ends of the right and left sides 310, 312. As shown in FIGS. 38 and 42, the passageway 318 is configured to at least partially house the first extension 210 and the second extension 220 of the archery adjustment assembly 200. One of the ends of the passageway 318 is open such as the right side 319 of base 314 as illustrated in FIG. 42. In the embodiment shown, the left side 321 (FIG. 41) of base 314 is at least partially closed. As shown in FIG. 41, the left side 321 includes or defines a coupling stem channel or opening 325 that is configured to allow the coupling stem 225 of the second extensions 220 to protrude from the passageway 318 when the projectile support device 300 is positioned onto the first and second extensions 210, 220 of the archery adjustment assembly 200.

The base 314 also defines a flex slot, flex gap or flex space 331 (FIGS. 46 and 49) that facilitates the flexing of the element portions 307, 309 when the base 314 is compressed onto the first and second extensions 210, 220, as described above. Also, the base defines a slot or slit 332 that extends generally from the passageway 318 to the bottom end 304 of the projectile support device 300. The slit 332 is configured to enable the passageway 318 of the base 314 to expand to easily receive the first extension 210 and the second extension 220.

As shown in FIG. 40, the archery accessory securement member 232 is configured to be inserted into the archery accessory opening 331 and tightened to exert radial compression on the base 314, and thereby at least partially close the slit 332. This acts to constrict the diameter of the passageway 318, which exerts a radial securing force 311 (FIG. 36A) on the first and second extensions 210, 220. Referring to FIG. 40 again, the radial securing force 311 exerted by the base 314 acts to eliminate, minimize or reduce the gap 230 (FIG. 39B) between the first and second drive interfaces 212, 222.

In an embodiment, the projectile support device 300 also has a plurality of ear-shaped projectile guides 340, 342 extending upward from the base 314. The projectile guides 340, 342 include a front surface 344 that generally faces the target T and a rear surface 346 that generally faces the archer or in the opposite direction of the front surface 344. As shown, the projectile support device 300 has two projectile guides 340, 342, however in other embodiments, the projectile support device 300 may have more than two projectile guides. A plurality of bridges, trusses or cross members 350 extend between the front surface 344 and the rear surface 346. A plurality of cavities 352 are defined within the projectile guides 340, 342. In the embodiment shown, the cavities 352 are bounded by: (a) the front surface 344; (b) the rear surface 346; and (c) the cross members 350. The cavities 352 may act to decrease manufacturing costs as well as the overall weight of the projectile support device 300 by decreasing the amount of material needed to fabricate the projectile guides 340, 342.

In an embodiment, the projectile support device 300 includes one or more inserts or elements (not shown) that are securely positioned within one or more of the cavities 352. Depending upon the embodiment, the elements can include weighted members or weights, vibration dampeners, vibration reducers, light sources (e.g., light emitting diodes), luminescent elements, electrical elements, sensors, motion detectors or other electronic input/output devices that include a battery power source. The use of weight members can improve the overall balance and performance of the projectile support device 300. The use of vibration dampeners can improve overall balance and decrease vibrations caused by the operation of the projectile support device 300. In an embodiment, the elements are coupled to the projectile support device 300 through a press-fit or friction-fit securement or through use of an adhesive. The vibration dampeners can include springs, foam, rubber, silicone, polyurethane or any other resilient material capable of reducing vibrations.

Figure 43:
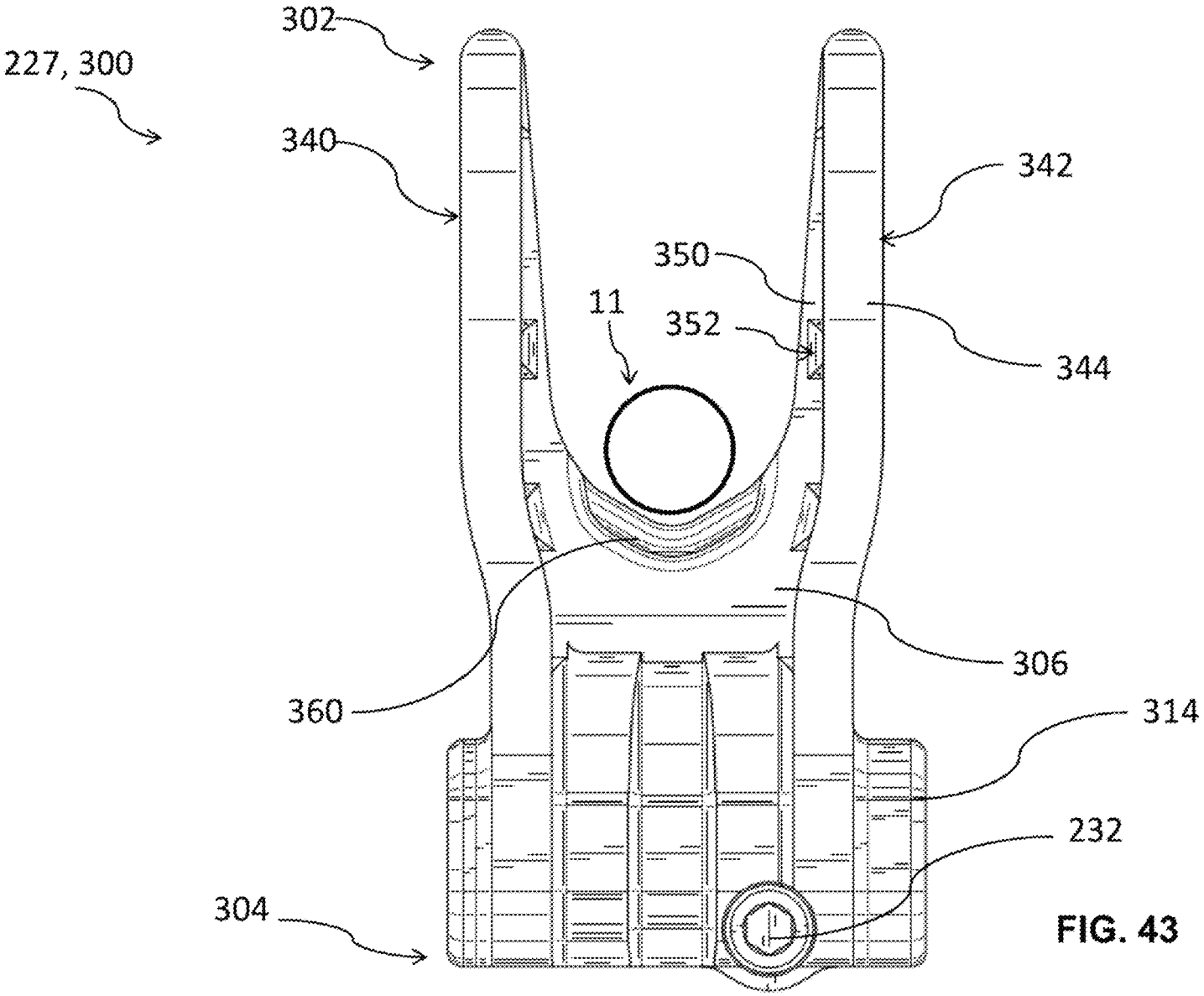
FIG. 43 is a rear elevation view of the projectile support device of FIG. 40.
Figure 44:
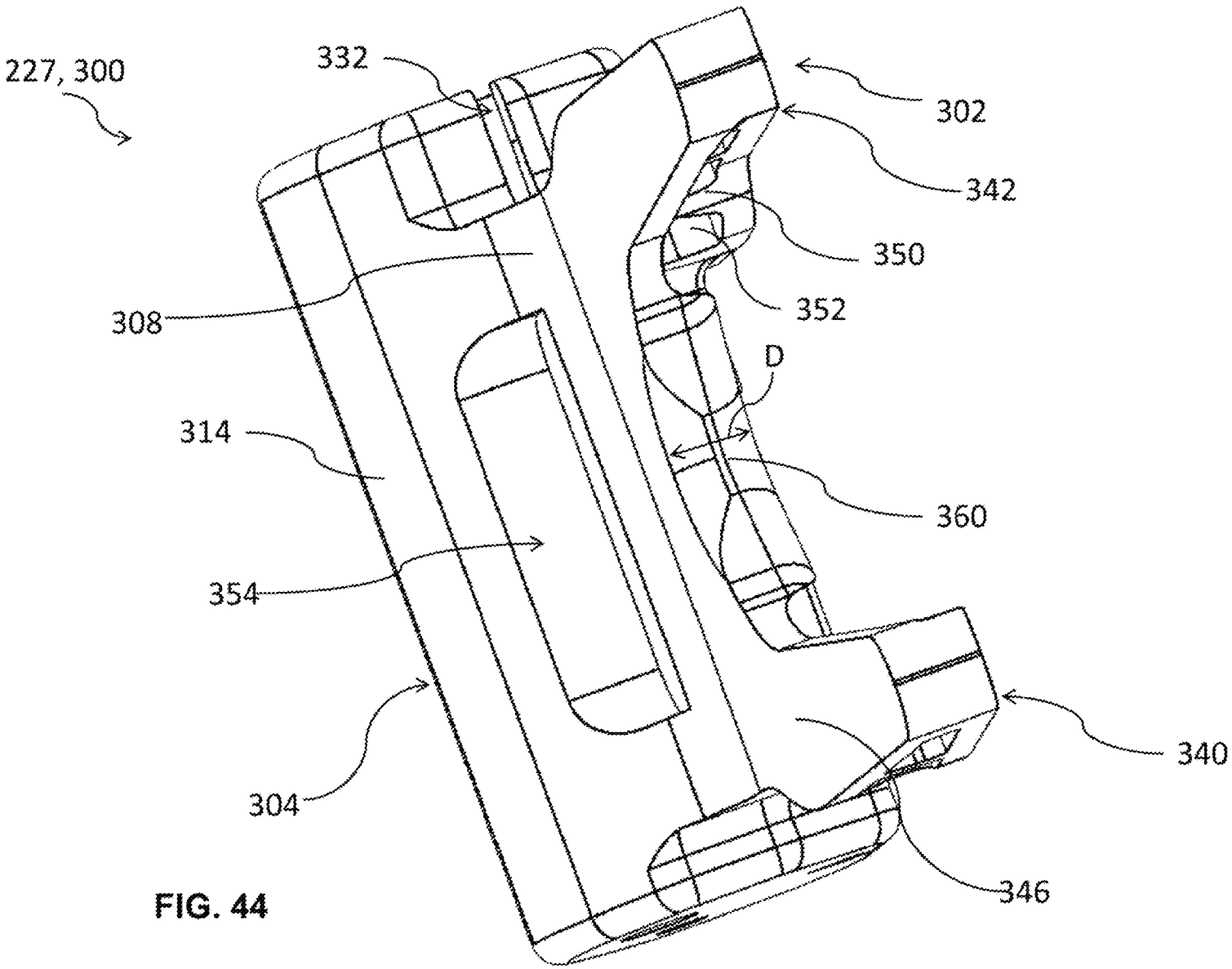
FIG. 44 is a top isometric view of the projectile support device of FIG. 40.
Figure 45:
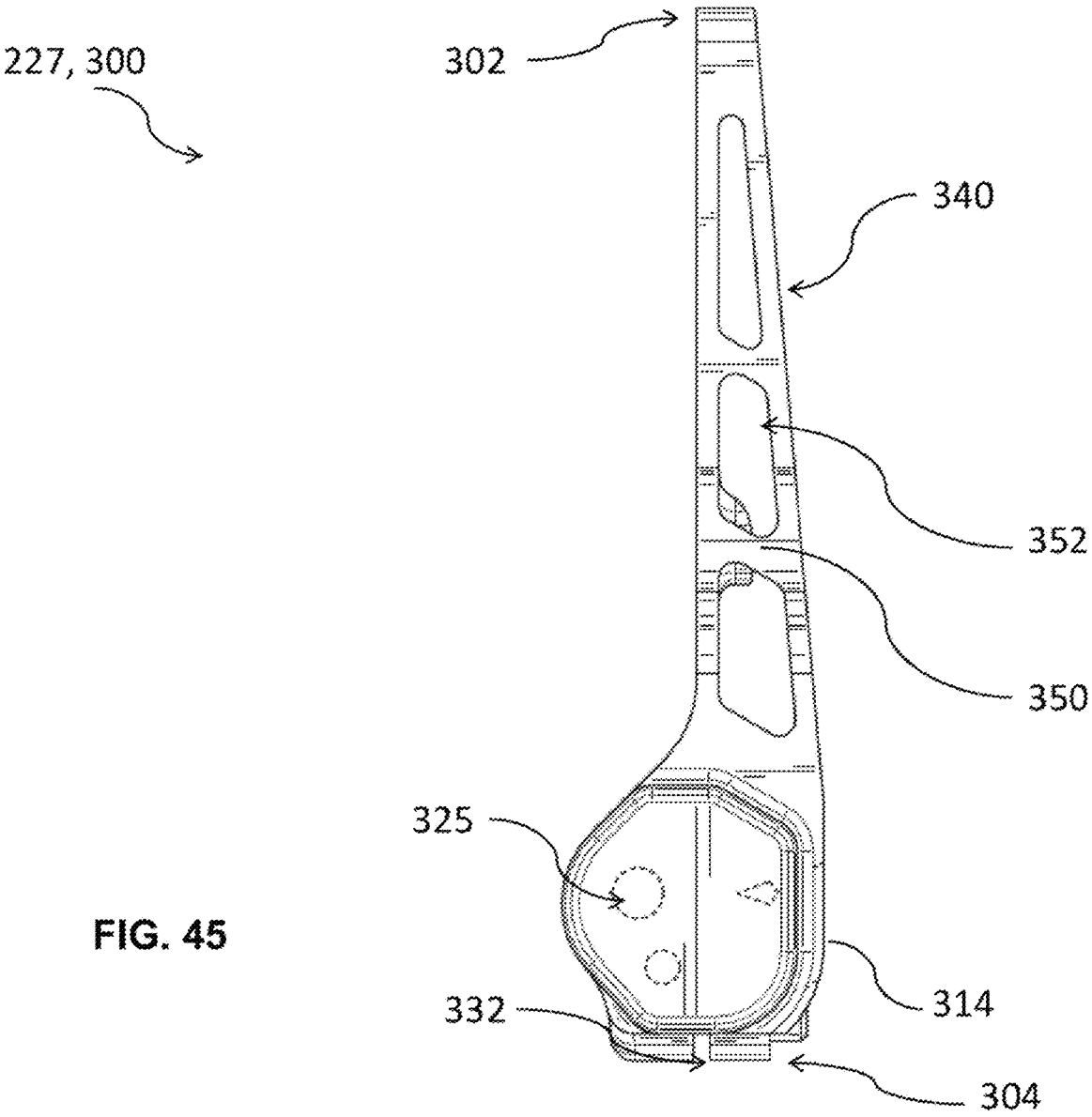
FIG. 45 is a left side elevation view of the projectile support device of FIG. 40.
Figure 46:
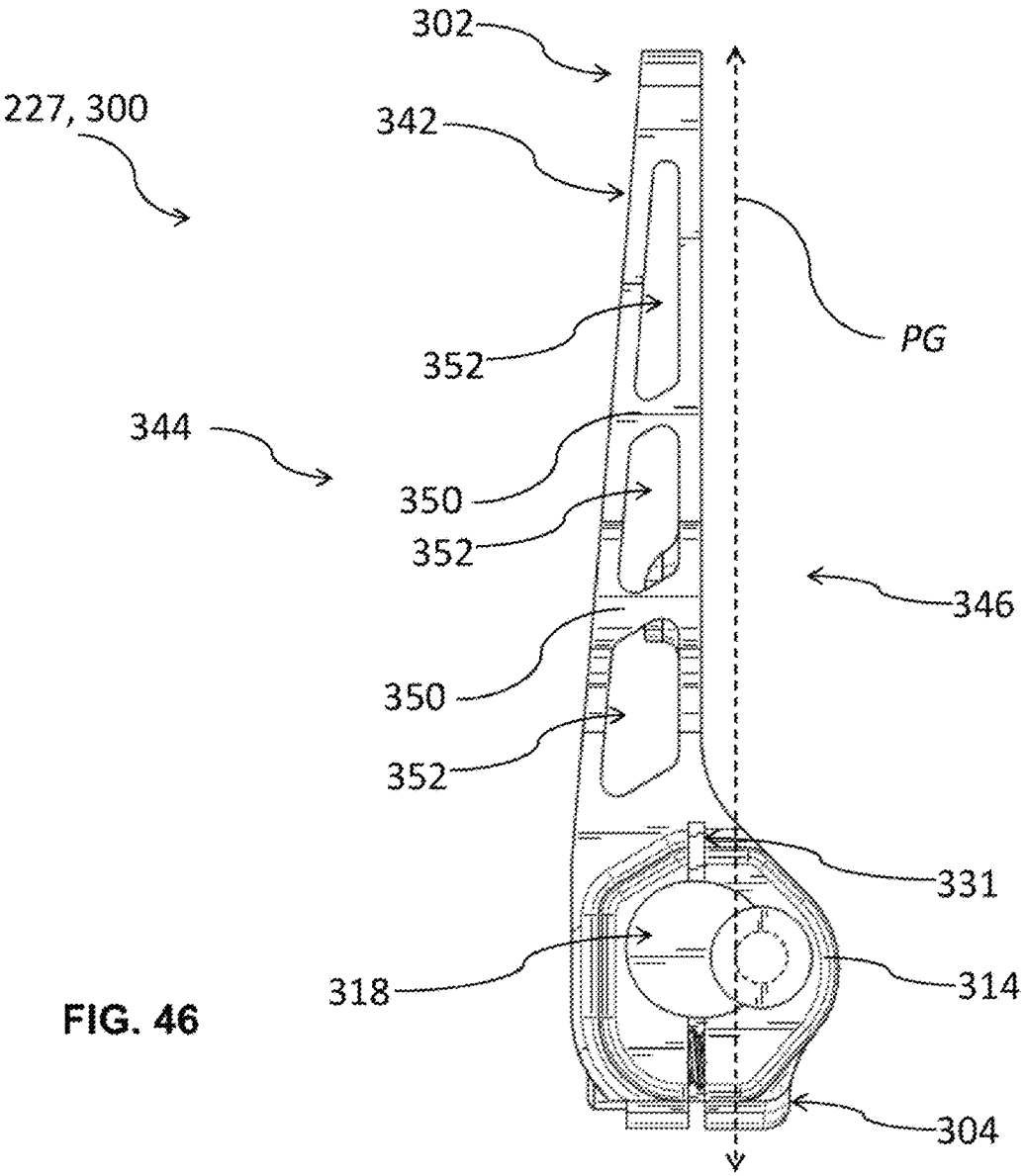
FIG. 46 is a right side elevation view of the projectile support device of FIG. 40.
Figure 47A:
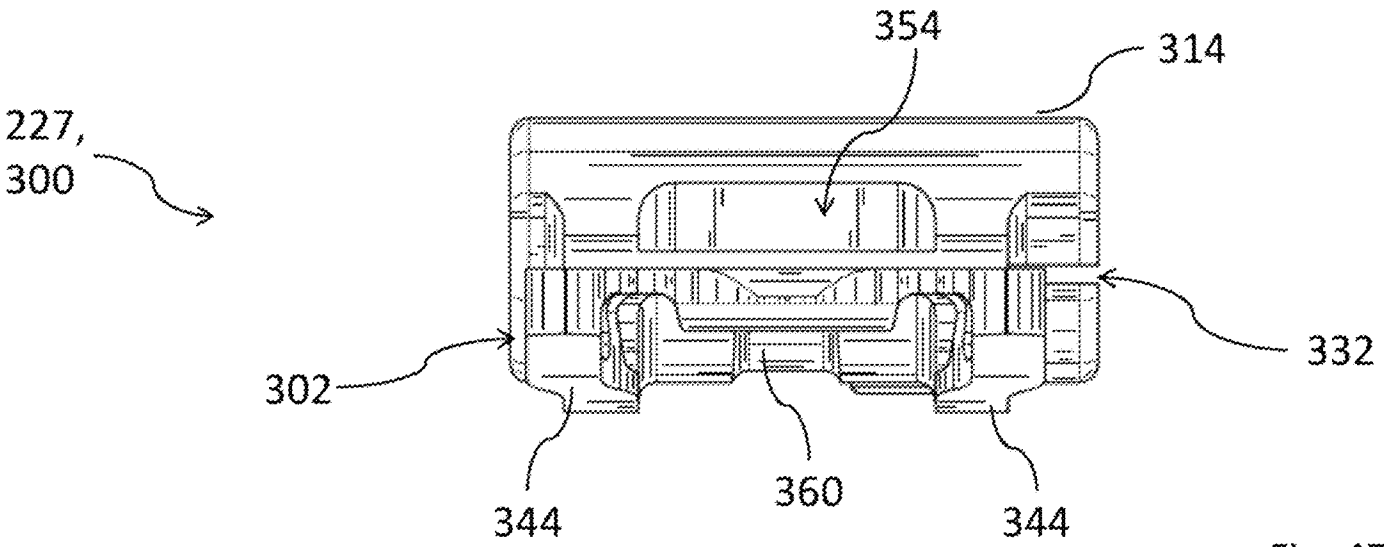
FIG. 47A is a top view of the projectile support device of FIG. 40.
Figure 47B:
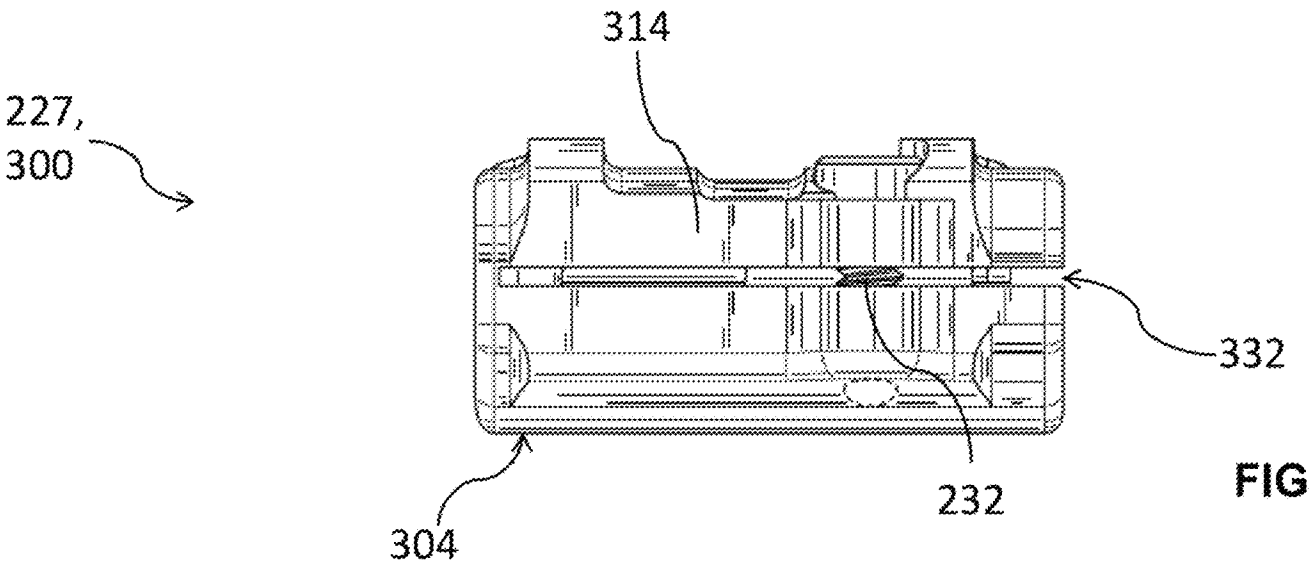
FIG. 47B is a bottom view of the projectile support device of FIG. 40.
Figure 48A:
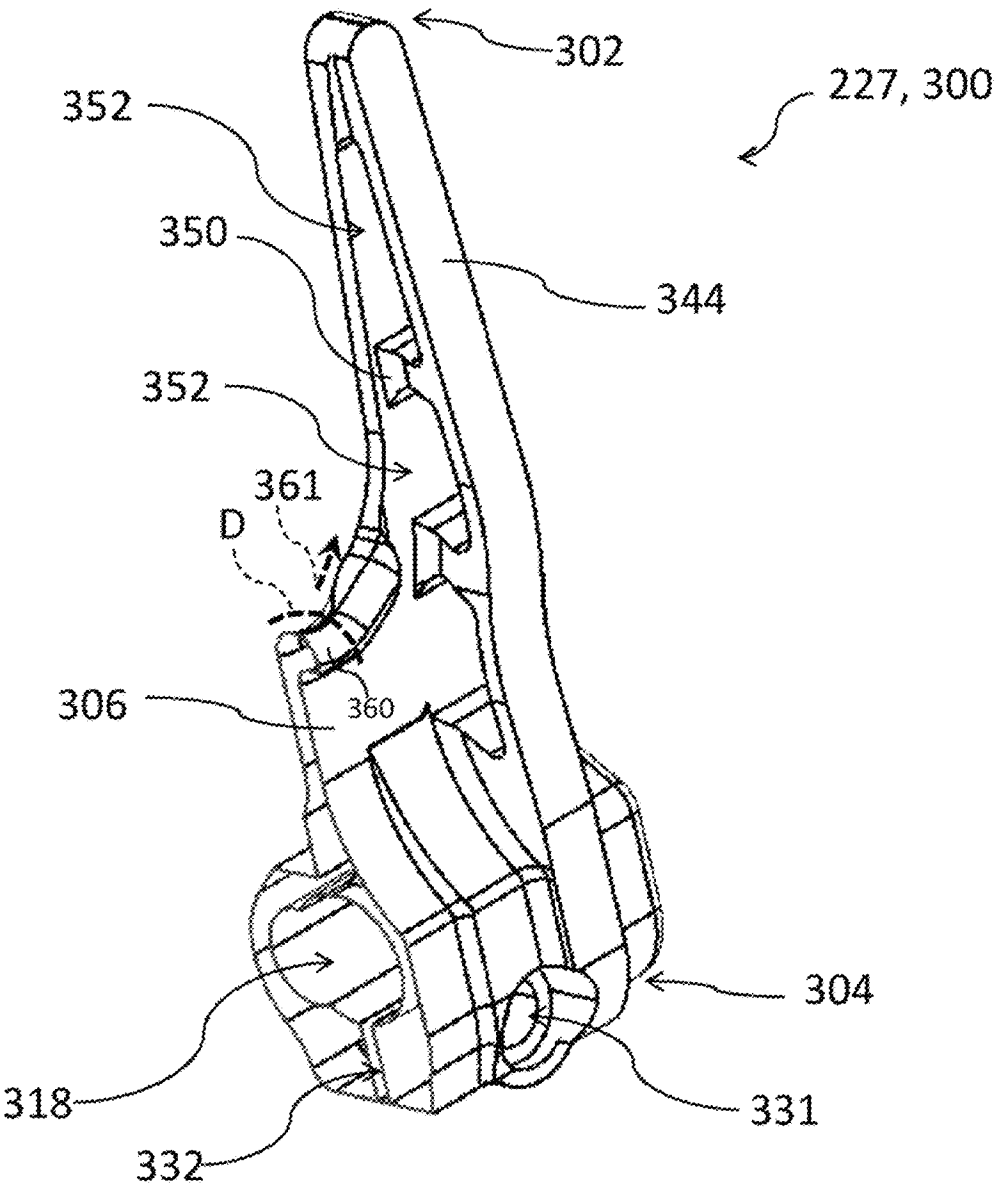
FIG. 48A is a cross sectional view of the projectile support device of FIG. 42, taken substantially along line 48-48.
Figure 48C:
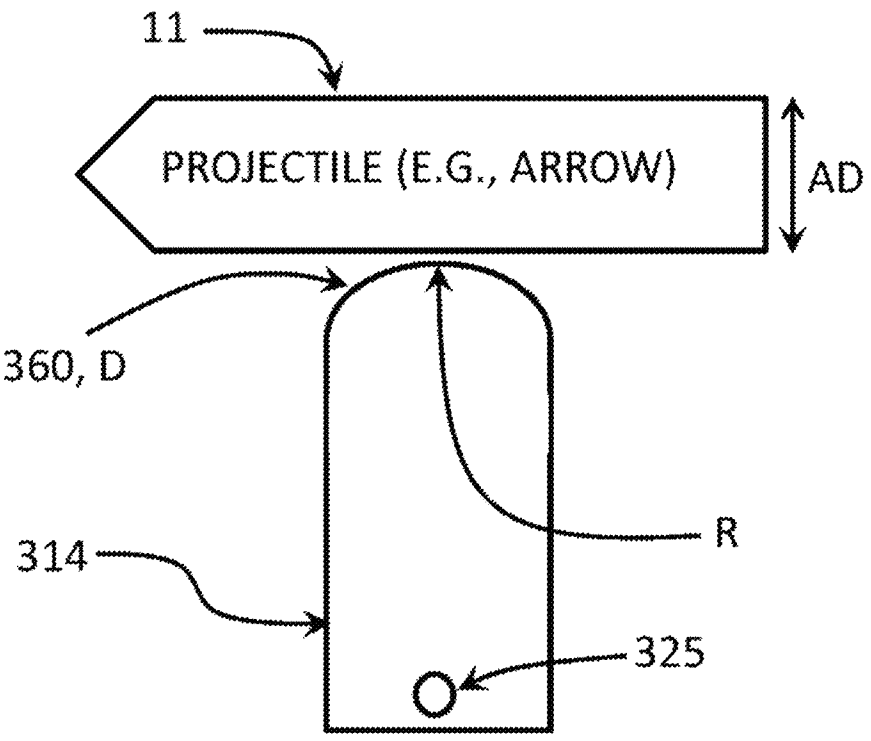
FIG. 48C is a schematic diagram illustrating an embodiment of a projectile support surface of the projectile support device of FIG. 42.
Figure 48B:
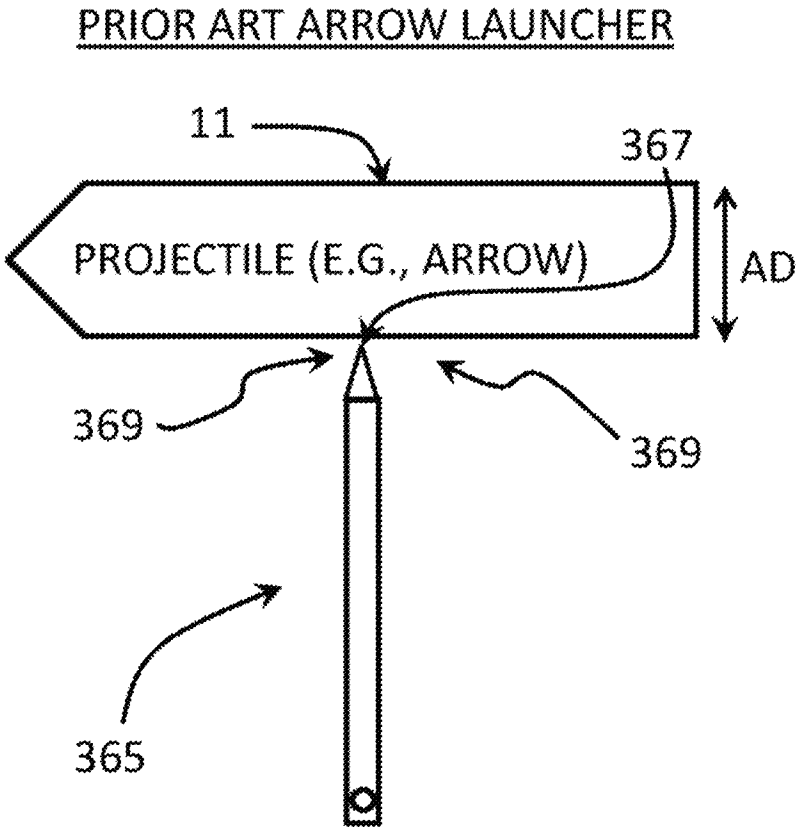
FIG. 48B is a schematic diagram illustrating the projectile support surface of a prior art arrow launcher.
Figure 49:
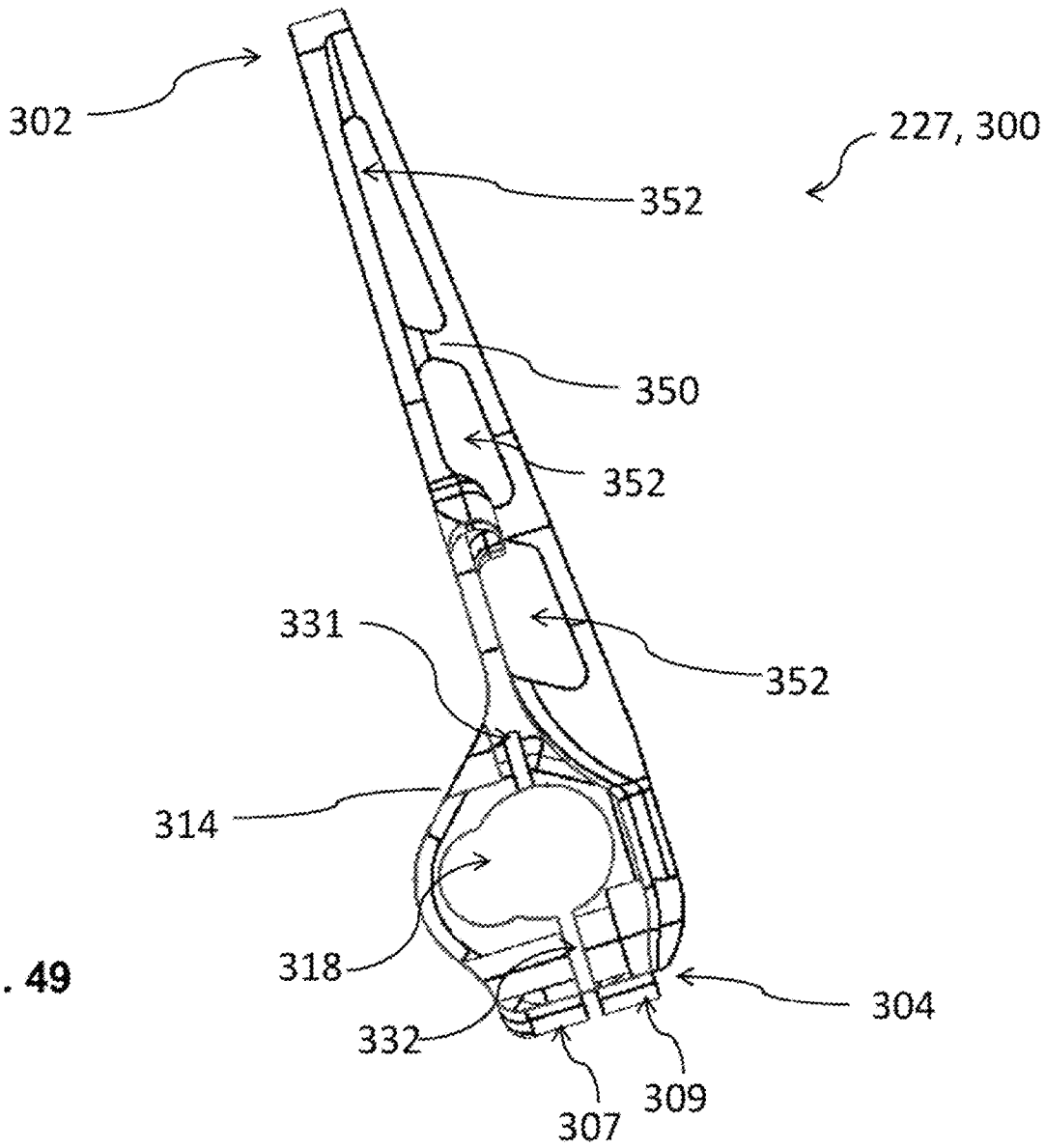
FIG. 49 is a cross sectional view of the projectile support device of FIG. 42, taken substantially along line 49-49.

In an embodiment, the projectile support device 300 also has a projectile support surface 360. As shown in FIG. 43, the projectile support surfaced 360 is configured to support a projectile 11 that is positioned between the projectile guides 340, 342. As shown in FIGS. 44 and 48A-48B, the projectile support surface 360 extends the length of an arc distance D from the front 306 and rear 308 sides of the projectile support device 300. As shown in FIGS. 44, 48A-48B and 49, the projectile support surface 360 extends along the arc distance D in accordance with a relatively large radius R for the arc. For example, the radius R of the arc distance D can be within the range of 0.33 inches to 0.35 inches to support an archery arrow having an arrow diameter AD (FIGS. 48B-48C) within the range of 0.230 inches to 0.45 inches. This relatively large radius of the projectile support surface 360 reduces the contact force between the projectile 11 and the projectile support device 300.

In contrast to the prior art launcher 365 shown in FIG. 48B, the force applied to the projectile support surface 360 is distributed over a greater surface area, which leads to a reduction in wear, tear and deterioration of the projectile 11 as it travels and slides across the projectile support surface 360. The prior art launcher 365 has a relatively narrow support surface 367 that includes relatively sharp corners or an edge 369. When the prior art launcher 365 rotates or pivots relative to the projectile 11, the edge 369 make physical contact with the projectile 11, scraping, wearing, damaging and deteriorating the projectile 11. The projectile support surface 360, in contrast, has no edges or minimal edges, as shown in FIG. 48C. As a result, the projectile support surface 360 avoids or minimizes deteriorating of the projectile 11 when the base 314 pivots about the channel 325 relative to the projectile 11. Also, as shown in FIG. 48A, the projectile support surface 360 is upwardly sloped along an arc path 361 on each side as it approaches the respective projectile guide 340, 342. The arc path 361 serves as a guide surface configured to reduce or minimize deterioration of the projectile 11.

In an embodiment, one or more additional cavities or openings 354 (FIGS. 42, 44 and 47B) are formed in the projectile support device 300 and extend between the front surface 344 and the rear surface 346. The one or more additional openings 354 may act to improve performance by decreasing air resistance, overall weight, as well as improving stability of the projectile support device 300. As shown, the one or more additional openings are positioned between the base 314 and the projectile guides 340, 342, however in other embodiments, the one or more additional openings 354 may be alternatively positioned relative to the base 314 and the projectile guides 340, 342. The projectile support device 300 is further configured to rotate about an axis 363 (FIG. 42) that is substantially parallel to the first and second extension planes 303, 305 (FIG. 36A).

During operation, the projectile support device 300 is in an up position, as shown in FIG. 15. In this up position, the projectile support device 300 is oriented such that the projectile guide axis PG (FIG. 46) is substantially upright, substantially vertical or substantially parallel to the bow axis B (FIG. 3). The projectile 11 is positioned such that it lies along the shooting axis S (FIG. 3), and a portion of the projectile 11 rests on the projectile support surface 360. During the firing of the projectile 11 along the shooting axis S, the spring-based mechanism within the housing 60 of the accessory 100, 101 causes the projectile support device 300 to pivot or rotate to a down position where the projectile guide axis PG (FIG. 46) is substantially parallel to the shooting axis S (FIG. 3).

By moving from the up to the down position, the projectile support device 300 provides clearance for the projectile 11 (Fig.l). For example, by moving down, the projectile support device 300 avoids interference with the fletching of an arrow or other type of projectile 11. In some embodiments, the projectile support device 300 may further include a top guide 370 (FIGS. 23 and 31-33) that extends along a top guide axis TG. The top guide 370 is configured to prevent the projectile 11 from jumping from its initial position between the projectile guides 340, 342 to a position outside of the projectile support device 300. The top guide 370 can also assist in aiming or shooting performance.

The archery riser and method described above enhance the adjustability of an archery accessory relative to an archery riser while the archery accessory is coupled to the archery riser. Also, the projectile support device described above improves performance, decreases wear of projectiles, and decreases overall weight and manufacturing costs.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

The parts, components, and structural elements of mounting portion 30 can be combined into an integral or unitary, one-piece object, or such parts, components, and structural elements can be distinct, removable items that are attachable to each other through screws, bolts, pins and other suitable fasteners.

The parts, components, and structural elements of archery accessory 100 can be combined into an integral or unitary, one-piece object, or such parts, components, and structural elements can be distinct, removable items that are attachable to each other through screws, bolts, pins and other suitable fasteners.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female) configured to receive the second element (functioning as a male). In either such embodiment, the first and second elements are configured to mate with, fit with or otherwise interlock with each other.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claim. Moreover, although specific terms are employed herein, as well as in the claim which follows, they are used only in a generic and descriptive sense, and not for the purposes of limiting the present disclosure, nor the claim which follows.

The following is claimed:

1. An archery assembly comprising:

a coupler comprising a riser mounting portion that is configured to be positioned behind a rear surface of a riser of an archery bow, the rear surface facing away from a shooting target when the archery bow is aimed at the shooting target, wherein:

the riser mounting portion is configured to be secured to the rear surface; and the securing of the riser mounting portion to the rear surface is based, at least partially, on a force caused by at least one fastener that is coupled to the coupler;

the coupler, when vertically oriented, extends at least partially along a vertical axis;

a device configured to be coupled to the coupler, wherein:

the coupler and the device are configured to cooperate so that the device is adjustably moveable to comprise a movement relative to the coupler; and the movement occurs along the vertical axis; and a projectile support configured to be coupled to the device, wherein, when the device is coupled to the coupler and the projectile support is coupled to the device, the coupler is configured to be coupled to the riser based, at least in part, on the securing of the riser mounting portion to the rear surface of the riser.

2. The archery assembly of claim 1, the project support is pivotally coupled to the device.

3. The archery assembly of claim 1, wherein:

the coupler comprises a positioning clamp assembly; and the positioning clamp assembly comprises:

a first clamping surface configured to at least partially fit within a first slot defined by the riser; and a second clamping surface configured to at least partially within a second slot defined by the riser, wherein the first clamping surface comprises a rightward location relative to the second clamping surface, wherein the second clamping surface comprises a leftward location relative to the first clamping surface.

4. The archery assembly of claim 1, wherein:

the device comprises a vertical adjuster; and the projectile support comprises a housing supported by the vertical adjuster.

5. The archery assembly of claim 1, comprising the at least one fastener, wherein:

the coupler defines a bore configured to at least partially receive the at least one fastener; and the at least one fastener, when engaged with the coupler, is configured to be adjusted to apply the force to the riser when the coupler is coupled to the riser.

6. The archery assembly of claim 1, wherein the force comprises a compression force.

7. The archery assembly of claim 6, wherein the compression force acts on the coupler when the coupler is coupled to the riser.

8. An arrow rest device comprising the archery assembly of claim 1.

9. The archery assembly of claim 1, wherein:

(a) the coupler comprises a plurality of clamp portions that, when assembled together, comprise the riser mounting portion; and (b) the at least one fastener comprises a positioning fastener configured to pull the clamp portions toward each other.

10. The archery assembly of claim 1, wherein:

the device comprises a vertical adjuster; and the vertical adjuster comprises a knob.

11. The archery assembly of claim 1, wherein the riser mounting portion comprises a dovetail shape, wherein the riser mounting portion is configured to be at least partially in contact with the rear surface of the riser.

12. The archery assembly of claim 11, wherein:

the riser mounting portion comprises a positioning clamp assembly; and the positioning clamp assembly comprises first and second clamp portions that are configured to be arranged to define the dovetail shape.

13. The archery assembly of claim 11, wherein:

the riser mounting portion is configured to be positioned entirely rearward of the rear surface when the riser mounting portion is secured to the rear surface by the at least one fastener while the riser is aimed at the shooting target and the rear surface of the riser faces in a rearward direction away from the shooting target; and the coupler is configured to be positioned entirely rearward of the rear surface when the riser mounting portion is secured to the rear surface by the at least one fastener while the riser is aimed at the shooting target and the rear surface of the riser faces in a rearward direction away from the shooting target.

14. The archery assembly of claim 11, wherein the riser mounting portion is configured to be positioned entirely behind the rear surface when the riser mounting portion is secured to the rear surface by the at least one fastener while the riser is aimed at the shooting target and the rear surface of the riser faces in a behind direction away from the shooting target.

15. The archery assembly of claim 11, wherein:

the riser mounting portion comprises a dovetail-shaped portion that is configured to at least partially contact the rear surface of the riser when the riser mounting portion is secured to the rear surface; and when the coupler is vertically oriented while coupled to the riser that is aimed at the shooting target, the coupler comprises:

(a) a front surface configured to face in a forward direction toward the shooting target;

(b) a right side surface configured to face in a rightward direction; and (c) a left side surface configured to face in a leftward direction;

the right and left side surfaces are positioned within a space that is bound by right and left riser planes;

the right riser plane faces in the rightward direction and extends vertically along a right side of the riser; and the left riser plane faces in the leftward direction and extends vertically along a left side of the riser.

16. The archery assembly of claim 11, wherein:

the device comprises a vertical adjuster configured to control the movement; and when the coupler is vertically oriented while coupled to the riser that is aimed at the shooting target, the coupler comprises:

(a) a front surface configured to face in a forward direction toward the shooting target;

(b) a right side surface configured to face in a rightward direction; and (c) a left side surface configured to face in a leftward direction;

the vertical adjuster is positioned entirely between right and left riser planes;

the right riser plane faces in the rightward direction and extends vertically along a right side of the riser; and the left riser plane faces in the leftward direction and extends vertically along a left side of the riser.

17. The archery assembly of claim 16, wherein:

the vertical adjuster comprises a rotatable knob; and when the coupler is vertically oriented while coupled to the riser that is aimed at the shooting target, the rotatable knob is entirely positioned between the right and left riser planes.

18. The archery assembly of claim 11, wherein:
the device comprises a first weight;
the projectile support comprises a second weight;
when the device is coupled to the coupler and the projectile support is coupled to the device, the coupler transfers at least part of the first and second weights to the riser mounting portion;
the at least part is at least partially subsequently transferred to the rear surface of the riser
the device and the projectile support are parts of an arrow rest assembly;
the device comprises: (a) a housing that houses a spring-based mechanism; and (b) an extension;
the projectile support comprises an arrow launcher configured to support an arrow, wherein the arrow launcher is supported by the extension; and
the spring-based mechanism is configured to cause the arrow launcher to pivot to become out of contact with the arrow.

19. The archery assembly of claim 1, wherein:
the device and the projectile support are parts of an arrow rest assembly;
the device comprises: (a) a housing that houses at least one spring; and (b) an extension; and
the projectile support comprises an arrow launcher configured to support an arrow, wherein the arrow launcher is supported by the extension.

20. The archery assembly of claim 19, wherein the coupler is configured to be positioned entirely behind the rear surface when the riser mounting portion is secured to the rear surface by the at least one fastener while the riser is aimed at the shooting target and the rear surface of the riser faces in a behind direction away from the shooting target.

21. The archery assembly of claim 19, wherein, when the riser is aimed at the shooting target and the rear surface of the riser faces in a rearward direction away from the shooting target:
the coupler comprises a first end and a second end located opposite of the first end;
the first end is configured to face in a forward direction, which is opposite of the rearward direction;
the first end comprises the riser mounting portion; and
the first end faces the rear surface of the riser when the riser mounting portion is secured to the rear surface.

22. The archery assembly of claim 21, wherein the first end comprises a foremost portion of the coupler.

23. The archery assembly of claim 19, wherein the riser mounting portion comprises a dovetail-shaped portion that at least partially contacts the rear surface of the riser when the riser mounting portion is secured to the rear surface.

24. The archery assembly of claim 19, wherein the riser mounting portion is covered by the rear surface of the riser when the riser mounting portion is secured to the rear surface.

25. The archery assembly of claim 19, wherein:
when the coupler is vertically oriented while coupled to the riser that is aimed at the shooting target, the coupler comprises:
(a) a front surface configured to face in a forward direction toward the shooting target;
(b) a right side surface configured to face in a rightward direction; and
(c) a left side surface configured to face in a leftward direction;
the at least one fastener is positioned at least partially between right and left riser planes when the at least one fastener is coupled to the coupler;
the right riser plane faces in the rightward direction and extends vertically along a right side of the riser; and
the left riser plane faces in the leftward direction and extends vertically along a left side of the riser.

26. The archery assembly of claim 25, wherein the at least one fastener is entirely positioned between the right and left riser planes when the at least one fastener is coupled to the coupler.

27. The archery assembly of claim 19, wherein:
the movement comprises a first movement;
the device comprises a first adjuster configured to control the first movement;
the device comprises a second adjuster configured to control a second movement of the device relative to the coupler; and
when the coupler is vertically oriented while coupled to the riser that is aimed at the shooting target:
(a) the second movement occurs along an axis that intersects with one of a right riser plane or a left riser plane;
(b) the right riser plane faces in a rightward direction and extends vertically along a right side of the riser; and
(c) the left riser plane faces in a leftward direction and extends vertically along a left side of the riser.

28. The archery assembly of claim 19, wherein the housing houses a spring-based mechanism configured to cause the arrow launcher to pivot to become out of contact with the arrow.

29. The archery assembly of claim 28, wherein:
the riser mounting portion comprises a dovetail-shaped portion that is configured to at least partially contact the rear surface of the riser when the riser mounting portion is secured to the rear surface; and
when the coupler is vertically oriented while coupled to the riser that is aimed at the shooting target, the coupler comprises:
(a) a front surface configured to face in a forward direction toward the shooting target;
(b) a right side surface configured to face in a rightward direction; and
(c) a left side surface configured to face in a leftward direction;
the right and left side surfaces are entirely positioned between right and left riser planes;
the right riser plane faces in the rightward direction and extends vertically along a right side of the riser; and
the left riser plane faces in the leftward direction and extends vertically along a left side of the riser.

30. The archery assembly of claim 29, wherein the front surface comprises the riser mounting portion.

31. The archery assembly of claim 28, wherein:
when the coupler is vertically oriented while coupled to the riser that is aimed at the shooting target, the coupler comprises:
(a) a front surface configured to face in a forward direction toward the shooting target;
(b) a right side surface configured to face in a rightward direction; and
(c) a left side surface configured to face in a leftward direction; and
when the riser mounting portion is secured to the rear surface:
(a) the coupler covers no part of a right side of the riser or a left side of the riser;
(b) the right side of the riser faces in the rightward direction and extends vertically; and (c) the left side of the riser faces in the leftward direction and extends vertically.

32. The archery assembly of claim 19, wherein:

the extension comprises: (a) first and second ends; and (b) a first section comprising the first end, wherein the first section is coupled to the arrow launcher;

the device comprises a member that is coupled to the second end, wherein the member is positioned outside of the housing; and the arrow launcher is configured to pivot relative to the housing, wherein the pivoting is at least partially caused by a force produced by the at least one spring.

33. An archery assembly comprising:

a coupler comprising a portion that is configured to be positioned behind a rear surface of a riser of an archery bow, the rear surface facing away from a shooting target when the archery bow is aimed at the shooting target, wherein:

the portion comprises a dovetail shape, and the portion is configured to: (a) at least partially contact the rear surface; and (b) be secured to the rear surface; and the coupler, when vertically oriented, extends at least partially along a vertical axis; and a device configured to be coupled to the coupler, wherein:

the device is adjustably moveable to comprise a movement relative to the coupler; and the movement occurs along the vertical axis, wherein the coupler is configured to be coupled to the riser due, at least in part, to the securing of the portion to the rear surface of the riser.

34. The archery assembly of claim 33, comprising a projectile support configured to be coupled to the device.

35. The archery assembly of claim 34, wherein the projectile support comprises an arrow rest.

36. The archery assembly of claim 35, wherein:

the device comprises a vertical adjuster; and the projectile support comprises a housing supported by the coupler.

37. The archery assembly of claim 33, comprising at least one fastener, wherein:

the coupler defines a bore configured to at least partially receive the at least one fastener;

the at least one fastener, when engaged with the coupler, is configured to be adjusted to apply a force to the coupler when the coupler is coupled to the riser; and the force causes the securing of the portion to the rear surface of the riser.

38. The archery assembly of claim 33, comprising at least one fastener, wherein:

the coupler defines a bore configured to at least partially receive the at least one fastener;

the at least one fastener, when engaged with the coupler, is configured to generate a compression force; and when the coupler is vertically oriented:

the coupler comprises: (a) a front configured to face toward the rear surface of the riser; (b) a right side; and (c) a left side; and the compression force acts along an axis that extends through the right and left sides of the coupler.

39. The archery assembly of claim 33, comprising at least one fastener configured to secure the portion to the rear surface, wherein:

(a) the coupler comprises a plurality of clamp portions that collectively comprise the portion; and (b) the at least one fastener comprises a positioning fastener configured to pull the clamp portions toward each other.

40. The archery assembly of claim 33, wherein the portion comprises a dovetail-shaped structure that is configured to at least partially contact the rear surface when the portion is secured to the rear surface by at least one fastener while the riser is aimed at the shooting target and the rear surface of the riser faces in a rearward direction away from the shooting target.

41. The archery assembly of claim 40, wherein:

the portion is configured to be positioned entirely rearward of the rear surface when the portion is secured to the rear surface by at least one fastener while the riser is aimed at the shooting target and the rear surface of the riser faces in a rearward direction away from the shooting target; and the coupler is configured to be positioned entirely rearward of the rear surface when the portion is secured to the rear surface by at least one fastener while the riser is aimed at the shooting target and the rear surface of the riser faces in a rearward direction away from the shooting target.

42. The archery assembly of claim 40, wherein:

the portion is configured to be positioned entirely behind the rear surface when the portion is secured to the rear surface by at least one fastener while the riser is aimed at the shooting target and the rear surface of the riser faces in a behind direction away from the shooting target; and the archery assembly comprises an arrow rest assembly; and the arrow rest assembly comprises: (a) the device; and (b) a project support that is moveably coupled to the device.

43. The archery assembly of claim 40, wherein:

when the coupler is vertically oriented while coupled to the riser that is aimed at the shooting target, the coupler comprises:

(a) a front surface configured to face in a forward direction toward the shooting target;

(b) a right side surface configured to face in a rightward direction; and (c) a left side surface configured to face in a leftward direction;

the right and left side surfaces are positioned within a space that is bound by right and left riser planes;

the right riser plane faces in the rightward direction and extends vertically along a right side of the riser; and the left riser plane faces in the leftward direction and extends vertically along a left side of the riser.

44. The archery assembly of claim 40, wherein:

the device comprises a vertical adjuster configured to control the movement;

when the coupler is vertically oriented while coupled to the riser that is aimed at the shooting target, the coupler comprises:

(a) a front surface configured to face in a forward direction toward the shooting target;

(b) a right side surface configured to face in a rightward direction; and (c) a left side surface configured to face in a leftward direction;

the vertical adjuster is positioned entirely between right and left riser planes;

the right riser plane faces in the rightward direction and extends vertically along a right side of the riser;

the left riser plane faces in the leftward direction and extends vertically along a left side of the riser; and the archery assembly comprises a projectile support that is moveably coupled to the device.

45. The archery assembly of claim 44, wherein:

the vertical adjuster comprises a rotatable knob; and when the coupler is vertically oriented while coupled to the riser that is aimed at the shooting target, the rotatable knob is entirely positioned between the right and left riser planes.

46. The archery assembly of claim 33, wherein:

the portion comprises a positioning clamp assembly; and the positioning clamp assembly comprises first and second clamp portions that are configured to be arranged to define the dovetail shape.

47. The archery assembly of claim 33, comprising a projectile support, wherein:

the device and the projectile support are parts of an arrow rest assembly;

the device comprises: (a) a housing that houses at least one spring; and (b) an extension; and the projectile support comprises an arrow launcher configured to support an arrow, wherein the arrow launcher is supported by the extension.

48. The archery assembly of claim 47, wherein the coupler is configured to be positioned entirely behind the rear surface when the portion is secured to the rear surface by at least one fastener while the riser is aimed at the shooting target and the rear surface of the riser faces in a behind direction away from the shooting target.

49. The archery assembly of claim 47, wherein, when the riser is aimed at the shooting target and the rear surface of the riser faces in a rearward direction away from the shooting target:

the coupler comprises a first end and a second end located opposite of the first end;

the first end is configured to face in a forward direction, which is opposite of the rearward direction;

the first end comprises the portion; and the first end faces the rear surface of the riser when the portion is secured to the rear surface.

50. The archery assembly of claim 47, wherein the portion comprises a dovetail-shaped element that at least partially contacts the rear surface of the riser when the portion is secured to the rear surface.

51. The archery assembly of claim 50, wherein a surface of the portion is covered by the rear surface of the riser when the portion is secured to the rear surface.

52. The archery assembly of claim 47, wherein:

when the coupler is vertically oriented while coupled to the riser that is aimed at the shooting target, the coupler comprises:

(a) a front surface configured to face in a forward direction toward the shooting target;

(b) a right side surface configured to face in a rightward direction; and (c) a left side surface configured to face in a leftward direction;

the archery assembly comprises at least one fastener that is positioned at least partially between right and left riser planes when the at least one fastener is coupled to the coupler;

the right riser plane faces in the rightward direction and extends vertically along a right side of the riser; and the left riser plane faces in the leftward direction and extends vertically along a left side of the riser.

53. The archery assembly of claim 52, wherein the at least one fastener is entirely positioned between the right and left riser planes when the at least one fastener is coupled to the coupler.

54. The archery assembly of claim 47, wherein:

the movement comprises a first movement;

the device comprises a first adjuster configured to control the first movement;

the device comprises a second adjuster configured to control a second movement of the device relative to the coupler; and when the coupler is vertically oriented while coupled to the riser that is aimed at the shooting target:

(a) the second movement occurs along an axis that intersects with one of a right riser plane or a left riser plane;

(b) the right riser plane faces in a rightward direction and extends vertically along a right side of the riser; and (c) the left riser plane faces in a leftward direction and extends vertically along a left side of the riser.

55. The archery assembly of claim 47, wherein the housing at least partially houses a spring-based mechanism configured to cause the arrow launcher to pivot to become out of contact with the arrow.

56. The archery assembly of claim 55, wherein:

when the coupler is vertically oriented while coupled to the riser that is aimed at the shooting target, the coupler comprises:

(a) a front surface configured to face in a forward direction toward the shooting target;

(b) a right side surface configured to face in a rightward direction; and (c) a left side surface configured to face in a leftward direction;

the right and left side surfaces are entirely positioned between right and left riser planes;

the right riser plane faces in the rightward direction and extends vertically along a right side of the riser; and the left riser plane faces in the leftward direction and extends vertically along a left side of the riser.

57. The archery assembly of claim 56, wherein the front surface comprises the portion.

58. The archery assembly of claim 55, wherein:

when the coupler is vertically oriented while coupled to the riser that is aimed at the shooting target, the coupler comprises:

(a) a front surface configured to face in a forward direction toward the shooting target;

(b) a right side surface configured to face in a rightward direction; and (c) a left side surface configured to face in a leftward direction; and when the portion is secured to the rear surface:

(a) the coupler covers no part of a right side of the riser or a left side of the riser;

(b) the right side of the riser faces in the rightward direction and extends vertically; and (c) the left side of the riser faces in the leftward direction and extends vertically.

59. The archery assembly of claim 47, wherein:

the device is configured to at least partially surround the portion;

the extension comprises: (a) first and second ends; and (b) a first section comprising the first end, wherein the first section is coupled to the arrow launcher;

the device comprises a member that is coupled to the second end, wherein the member is positioned outside of the housing; and the arrow launcher is configured to pivot relative to the housing, wherein the pivoting is at least partially caused by a force produced by the at least one spring.

60. The archery assembly of claim 33, wherein:

the archery assembly comprises a projectile support that is supported by the device;

the device comprises a first weight;

the projectile support comprises a second weight;

when the device is coupled to the coupler and the projectile support is supported by the device, the coupler transfers at least part of the first and second weights to the portion;

the at least part is at least partially subsequently transferred to the rear surface of the riser;

the device and the projectile support are parts of an arrow rest assembly;

the device comprises: (a) a housing that at least partially houses a spring-based mechanism; and (b) an extension;

the projectile support comprises an arrow launcher configured to support an arrow, wherein the arrow launcher is supported by the extension; and the spring-based mechanism is configured to cause the arrow launcher to pivot relative to the housing.

61. A method for manufacturing an archery assembly, the method comprising:

configuring a coupler, wherein the configuring of the coupler comprises:

configuring the coupler to be positioned behind a rear surface of a riser of an archery bow, the rear surface facing away from a shooting target when the archery bow is aimed at the shooting target, configuring the coupler so that, when the coupler is vertically oriented, the coupler extends at least partially along a vertical axis;

configuring a portion of the coupler to:

define a dovetail shape;

at least partially contact the rear surface; and be secured to the rear surface; and configuring the coupler to be coupled to the riser due, at least in part, to the securing of the portion to the rear surface of the riser; and configuring a device to be coupled to the coupler so that the coupler and the device are configured to cooperate so that the device is adjustably moveable to comprise a movement relative to the coupler, wherein the movement occurs along the vertical axis.

62. The method of claim 61, comprising:

configuring the device to be coupled to a projectile support;

obtaining at least one fastener; and configuring the coupler to define a bore configured to at least partially receive the at least one fastener, wherein the at least one fastener, when engaged with the coupler, is configured to generate a force, wherein the force secures the portion to the rear surface of the riser.

63. The method of claim 61, the configuring of the portion comprises configuring a dovetail-shaped structure to define the dovetail shape, at least partially contact the rear surface, and be secured to the rear surface.

64. The method of claim 63, comprising:

configuring the portion to be positioned entirely rearward of the rear surface when the portion is secured to the rear surface by at least one fastener while the riser is aimed at the shooting target and the rear surface of the riser faces in a rearward direction away from the shooting target; and configuring the coupler to be positioned entirely rearward of the rear surface when the portion is secured to the rear surface by at least one fastener while the riser is aimed at the shooting target and the rear surface of the riser faces in a rearward direction away from the shooting target.

65. The method of claim 63, wherein:

when the coupler is vertically oriented while coupled to the riser that is aimed at the shooting target, the coupler comprises:

(a) a front surface configured to face in a forward direction toward the shooting target;

(b) a right side surface configured to face in a rightward direction; and (c) a left side surface configured to face in a leftward direction;

the right and left side surfaces are positioned within a space that is bound by right and left riser planes;

the right riser plane faces in the rightward direction and extends vertically along a right side of the riser; and the left riser plane faces in the leftward direction and extends vertically along a left side of the riser.

66. The method of claim 63, wherein:

the device comprises a vertical adjuster configured to control the movement;

when the coupler is vertically oriented while coupled to the riser that is aimed at the shooting target, the coupler comprises:

(a) a front surface configured to face in a forward direction toward the shooting target;

(b) a right side surface configured to face in a rightward direction; and (c) a left side surface configured to face in a leftward direction;

the vertical adjuster is positioned entirely between right and left riser planes;

the right riser plane faces in the rightward direction and extends vertically along a right side of the riser; and the left riser plane faces in the leftward direction and extends vertically along a left side of the riser.

67. The method of claim 66, wherein:

the vertical adjuster comprises a rotatable knob; and when the coupler is vertically oriented while coupled to the riser that is aimed at the shooting target, the rotatable knob is entirely positioned between the right and left riser planes.

68. The method of claim 63, wherein:

coupling a projectile support to the device;

the device comprises a first weight;

the projectile support comprises a second weight;

when the device is coupled to the coupler and the projectile support is coupled to the device, the coupler transfers at least part of the first and second weights to the portion; and the at least part is at least partially subsequently transferred to the rear surface of the riser the device and the projectile support are parts of an arrow rest assembly;

the device comprises: (a) a housing that houses a spring-based mechanism; and (b) an extension;

the projectile support comprises an arrow launcher configured to support an arrow, wherein the arrow launcher is supported by the extension; and the spring-based mechanism is configured to cause the arrow launcher to pivot to become out of contact with the arrow.

69. The method of claim 63, comprising:

configuring the portion to be positioned entirely behind the rear surface when the portion is secured to the rear surface by at least one fastener while the riser is aimed at the shooting target and the rear surface of the riser faces in a behind direction away from the shooting target; and coupling a projectile support to the device so that the projectile support is pivotal relative to the device.

70. The method of claim 61, wherein the configuring of the portion comprises configuring a positioning clamp assembly, wherein the positioning clamp assembly comprises first and second clamp portions that are configured to be arranged to define the dovetail shape.

71. The method of claim 61, comprising coupling a projectile support to the device, wherein:

the device and the projectile support are parts of an arrow rest assembly;

the device comprises: (a) a housing that houses at least one spring; and (b) an extension; and the projectile support comprises an arrow launcher configured to support an arrow, wherein the arrow launcher is supported by the extension.

72. The method of claim 71, comprising configuring the coupler to be positioned entirely behind the rear surface when the portion is secured to the rear surface by at least one fastener while the riser is aimed at the shooting target and the rear surface of the riser faces in a behind direction away from the shooting target.

73. The method of claim 71, wherein, when the riser is aimed at the shooting target and the rear surface of the riser faces in a rearward direction away from the shooting target:

the coupler comprises a first end and a second end located opposite of the first end;

the first end is configured to face in a forward direction, which is opposite of the rearward direction;

the first end comprises the portion; and the first end faces the rear surface of the riser when the portion is secured to the rear surface.

74. The method of claim 73, comprising configuring the first end to comprise a foremost portion of the coupler.

75. The method of claim 71, comprising configuring the portion to be covered by the rear surface of the riser when the portion is secured to the rear surface.

76. The method of claim 71, wherein:

when the coupler is vertically oriented while coupled to the riser that is aimed at the shooting target, the coupler comprises:

(a) a front surface configured to face in a forward direction toward the shooting target;

(b) a right side surface configured to face in a rightward direction; and (c) a left side surface configured to face in a leftward direction;

the archery assembly comprises at least one fastener that is positioned at least partially between right and left riser planes when the at least one fastener is coupled to the coupler;

the right riser plane faces in the rightward direction and extends vertically along a right side of the riser; and the left riser plane faces in the leftward direction and extends vertically along a left side of the riser.

77. The method of claim 76, wherein the at least one fastener is entirely positioned between the right and left riser planes when the at least one fastener is coupled to the coupler.

78. The method of claim 71, wherein:

the movement comprises a first movement;

the device comprises a first adjuster configured to control the first movement;

the device comprises a second adjuster configured to control a second movement of the device relative to the coupler; and when the coupler is vertically oriented while coupled to the riser that is aimed at the shooting target:

(a) the second movement occurs along an axis that intersects with one of a right riser plane or a left riser plane;

(b) the right riser plane faces in a rightward direction and extends vertically along a right side of the riser; and (c) the left riser plane faces in a leftward direction and extends vertically along a left side of the riser.

79. The method of claim 71, wherein the housing houses a spring-based mechanism configured to cause the arrow launcher to pivot to become out of contact with the arrow.

80. The method of claim 79, wherein:

when the coupler is vertically oriented while coupled to the riser that is aimed at the shooting target, the coupler comprises:

(a) a front surface configured to face in a forward direction toward the shooting target;

(b) a right side surface configured to face in a rightward direction; and (c) a left side surface configured to face in a leftward direction;

the right and left side surfaces are entirely positioned between right and left riser planes;

the right riser plane faces in the rightward direction and extends vertically along a right side of the riser; and the left riser plane faces in the leftward direction and extends vertically along a left side of the riser.

81. The method of claim 80, comprising configuring the front surface to comprise the portion.

82. The method of claim 79, wherein:

when the coupler is vertically oriented while coupled to the riser that is aimed at the shooting target, the coupler comprises:

(a) a front surface configured to face in a forward direction toward the shooting target;

(b) a right side surface configured to face in a rightward direction; and (c) a left side surface configured to face in a leftward direction; and when the portion is secured to the rear surface:

(a) the coupler covers no part of a right side of the riser or a left side of the riser;

(b) the right side of the riser faces in the rightward direction and extends vertically; and (c) the left side of the riser faces in the leftward direction and extends vertically.

83. The method of claim 71, wherein:

the extension comprises: (a) first and second ends; and (b) a first section comprising the first end, wherein the first section is coupled to the arrow launcher;

the method comprises configuring the device to comprise a member that is coupled to the second end, wherein the member is positioned outside of the housing; and the arrow launcher is configured to pivot relative to the housing, wherein the pivoting is at least partially caused by a force produced by the at least one spring.

* * * * *